US006465144B2

(12) United States Patent
Hashimoto et al.

(10) Patent No.: US 6,465,144 B2
(45) Date of Patent: Oct. 15, 2002

(54) MAGNETIC TONER, PROCESS FOR PRODUCTION THEREOF, AND IMAGE FORMING METHOD, APPARATUS AND PROCESS CARTRIDGE USING THE TONER

(75) Inventors: Akira Hashimoto; Kenji Okado, both of Mishima; Tsutomu Kukimoto, Yokohama; Tatsuya Nakamura, Mishima; Tsuyoshi Takiguchi, Shizuoka-ken; Tatsuhiko Chiba, Kamakura; Michihisa Magome, Shizuoka-ken; Keiji Komoto, Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/800,655

(22) Filed: Mar. 8, 2001

(65) Prior Publication Data

US 2002/0009661 A1 Jan. 24, 2002

(30) Foreign Application Priority Data

Mar. 8, 2000 (JP) ..... 2000-064083
Dec. 21, 2000 (JP) ..... 2000-388603

(51) Int. Cl.[7] ..... G03G 9/083

(52) U.S. Cl. ..... 430/106.1; 430/110.4; 430/111.41; 430/137.17; 430/126; 399/297

(58) Field of Search ..... 430/106.2, 108.2, 430/110.1, 110.2, 110.3, 110.4, 111.4, 137.17, 126

(56) References Cited

U.S. PATENT DOCUMENTS

| | | | | |
|---|---|---|---|---|
| 3,909,258 A | | 9/1975 | Kotz | 96/1 R |
| 4,530,894 A | | 7/1985 | Imamura et al. | 430/106.6 |
| 4,620,987 A | | 11/1986 | Yamashita et al. | 427/131 |
| 4,664,504 A | | 5/1987 | Oda et al. | 355/15 |
| 4,769,676 A | | 9/1988 | Mukai et al. | 355/15 |
| 4,804,609 A | | 2/1989 | Imanaka et al. | 430/106.6 |
| 4,820,603 A | | 4/1989 | Sakashita | 430/106.6 |
| 4,851,960 A | | 7/1989 | Nakamura et al. | 361/225 |
| 5,014,089 A | | 5/1991 | Sakashita et al. | 355/251 |
| 5,096,798 A | | 3/1992 | Kanbe et al. | 430/120 |
| 5,106,815 A | | 4/1992 | Akada et al. | 503/229 |
| 5,222,005 A | | 6/1993 | Inoue | 360/99.06 |
| 5,282,007 A | | 1/1994 | Oshiumi | 355/296 |
| 5,422,707 A | | 6/1995 | Takiguichi et al. | 355/245 |
| 5,432,037 A | | 7/1995 | Nishikiori et al. | 430/126 |
| 5,450,180 A | | 9/1995 | Ohzeki et al. | 355/274 |
| 5,508,139 A | * | 4/1996 | Tanaka et al. | 430/106 |
| 5,672,454 A | | 9/1997 | Sasaki et al. | 430/106.6 |
| 5,885,740 A | | 3/1999 | Tokunaga et al. | 430/106.6 |
| 5,976,755 A | | 11/1999 | Yoshida et al. | 430/126 |
| 6,002,900 A | * | 12/1999 | Ishiyama | 399/149 |
| 6,077,636 A | | 6/2000 | Moriki et al. | 430/126 |
| 6,124,067 A | | 9/2000 | Mikuriya et al. | 430/106.6 |
| 6,128,456 A | | 10/2000 | Chigono et al. | 399/176 |

FOREIGN PATENT DOCUMENTS

| | | |
|---|---|---|
| EP | 0851307 | 11/1986 |
| JP | 55-18656 | 2/1980 |
| JP | 56-142540 | 11/1981 |
| JP | 57-151952 | 9/1982 |
| JP | 59-133573 | 7/1984 |
| JP | 59-168458 | 9/1984 |
| JP | 59-200254 | 11/1984 |
| JP | 59-200256 | 11/1984 |
| JP | 59-200257 | 11/1984 |
| JP | 59-224102 | 12/1984 |
| JP | 60-3181 | 1/1985 |
| JP | 60-69660 | 4/1985 |
| JP | 61-34070 | 2/1986 |
| JP | 61-141452 | 6/1986 |
| JP | 61-249059 | 11/1986 |
| JP | 61-275864 | 12/1986 |
| JP | 62-203182 | 9/1987 |
| JP | 62-258472 | 11/1987 |
| JP | 62-279352 | 12/1987 |
| JP | 63-133179 | 6/1988 |
| JP | 63-149668 | 6/1988 |
| JP | 63-250660 | 10/1988 |
| JP | 64-20587 | 1/1989 |
| JP | 1-112253 | 4/1989 |
| JP | 2-120865 | 3/1990 |
| JP | 2-123385 | 5/1990 |
| JP | 2-248158 | 10/1990 |
| JP | 2-302772 | 12/1990 |
| JP | 4-9860 | 1/1992 |
| JP | 4-264453 | 9/1992 |
| JP | 5-2289 | 1/1993 |
| JP | 5-6608 | 1/1993 |
| JP | 5-53482 | 3/1993 |
| JP | 5-61383 | 3/1993 |

(List continued on next page.)

*Primary Examiner*—John Goodrow
(74) *Attorney, Agent, or Firm*—Fitzpatrick, Cella, Harper & Scinto

(57) ABSTRACT

A magnetic toner includes: magnetic toner particles each comprising at least a binder resin and magnetic toner, and inorganic fine powder. The magnetic toner has an average circularity of at least 0.970, and a magnetization of 10–50 $Am^2/kg$ at a magnetic field of 79.6 kA/m. The magnetic powder comprises at least magnetic iron oxide. The magnetic toner particles retain carbon in an amount of A and iron in an amount of B at surfaces thereof as measured by X-ray photoelectron spectroscopy, satisfying: $B/A<0.001$. The binder resin comprises a resin formed by polymerization of a monomer comprising at least styrene monomer. The magnetic toner has a residual styrene monomer content of less than 300 ppm, and contains at least 50% by number of toner particles satisfying a relationship of: $D/C \leqq 0.02$, wherein C represents a volume-average particle size of the magnetic toner, and D represents a minimum distance between the surface of a magnetic toner particle and magnetic powder particles contained in the magnetic toner particle. Owing to the above features, the magnetic toner can exhibit good electrohotographic performances, including excellent chargeability and little transfer-residual toner, even in a cleanerless-mode image forming system.

109 Claims, 4 Drawing Sheets

FOREIGN PATENT DOCUMENTS

| | | |
|---|---|---|
| JP | 5-150539 | 6/1993 |
| JP | 5-346682 | 12/1993 |
| JP | 7-60273 | 3/1995 |
| JP | 7-209904 | 8/1995 |
| JP | 2662410 | 10/1995 |
| JP | 8-169717 | 7/1996 |
| JP | 9-043904 | 2/1997 |
| JP | 10-20548 | 1/1998 |
| JP | 10-101339 | 4/1998 |
| JP | 10-239897 | 9/1998 |
| JP | 10-307421 | 11/1998 |
| JP | 10-307455 | 11/1998 |
| JP | 10-307456 | 11/1998 |
| JP | 10/307458 | 11/1998 |
| JP | 11-15206 | 1/1999 |
| JP | 3-9045 | 2/2000 |
| JP | 3-103878 | 10/2000 |

* cited by examiner

MAGNETIC TONER, PROCESS FOR PRODUCTION THEREOF, AND IMAGE FORMING METHOD, APPARATUS AND PROCESS CARTRIDGE USING THE TONER

FIELD OF THE INVENTION AND RELATED ART

The present invention relates to a magnetic toner used in image forming methods, such as electrophotography, electrostatic recording, magnetic recording and toner jetting; a process for production of the magnetic toner; and an image forming method, an image forming apparatus and a process cartridge using the magnetic toner.

Hitherto, many proposals have been made regarding a magnetic toner (i.e., a magnetically susceptible toner) and an image forming method using the toner.

U.S. Pat. No. 3,909,258 has proposed a developing method using a magnetic toner, having electroconductivity. According to the proposal, an electroconductive magnetic toner is supplied onto a cylindrical electroconductive sleeve enclosing a magnet at an inside thereof and is caused to contact an electrostatic latent image for development. In this instance, at the developing position, an electroconductive path is formed of the toner particles between a recording member surface and the sleeve surface, charges are guided to the toner particles from the sleeve via the electroconductive path, and the charged toner particles are attached onto an image part of an electrostatic image due to a Coulomb force acting between the image part and the toner particles, thereby to effect a development. The developing method using such an electroconductive magnetic toner is an excellent method capable of obviating the problems accompanying the conventional two-component developing method, but on the other hand, involves a problem that it becomes difficult to effect the transfer of a developed image from the recording member to a final supporting material, such as plain paper, because the toner is electro-conductive.

As a developing method using a high-resistivity magnetic toner allowing electrostatic transfer, a developing method using dielectric polarization of toner particles is known. However, such a method involves essential problems of a slow developing speed or inability of obtaining a sufficiently high image density.

Other known developing methods using a high-resistivity insulating magnetic toner includes a method wherein toner particles are triboelectrically charged through friction between individual toner particles, friction between a sleeve and toner particles, etc. This method is accompanied with a problem that the toner particles are liable to have an insufficient triboelectric charge leading to image defects due to charging failure because of a low opportunity of contact between the toner particles and the friction member and the magnetic toner particles used contain much magnetic powder exposed to the toner particle surfaces.

Japanese Laid-Open Patent Application (JP-A) 55-18656 and others have proposed a jumping developing method, wherein a magnetic toner is applied as a very thin coating layer, then triboelectrically charged and then brought to very proximity to an electrostatic image to develop the electrostatic image. This method is excellent in that the magnetic toner is applied in a very thin layer on the sleeve to increase the opportunity of contact between the sleeve and the toner, thereby allowing a sufficient triboelectric charge. However, such a developing method using an insulating magnetic toner is accompanied with uncertain factors inherent to the use of an insulating magnetic toner. Such uncertain factors are caused by exposure of a portion of magnetic fine powder mixed and dispersed in a substantial amount in the insulating magnetic toner, and as a result, several performances, such as developing performance and durability, required of a magnetic toner, are changed or deteriorated.

It is considered that the above-mentioned problem encountered in the case of using a conventional magnetic toner containing magnetic powder has been principally caused by exposure of the magnetic powder to the magnetic toner surface. More specifically, if magnetic powder having a relatively low resistivity is exposed to the surface of magnetic toner particles principally composed of a resin having a larger resistivity, toner performance lowering are caused, such as a lowering in toner chargeability, lowering in toner flowability, and a lowering in image density or occurrence of a density irregularity called sleeve ghost caused by liberation of the magnetic powder due to friction between individual toner particles and between toner particles and the regulating member during a long term of use. Hitherto, proposals have been made regarding magnetic iron oxide contained in magnetic toners, but have left problems yet to be solved.

For example, JP-A 62-279352 has proposed a magnetic toner containing silicon-containing magnetic iron oxide. In the magnetic iron oxide, silicon (element) is intentionally incorporated at an inner part of magnetic iron oxide particles, but the flowability of a magnetic toner containing the magnetic iron oxide has still left a room for improvement.

Japanese Patent Publication (JP-B) 3-9045 has proposed to control the shape of magnetic iron oxide particles into a spherical one by adding a silicate salt. As a result of the use of a silicate salt for particle shape control, the magnetic iron oxide particles contain much silicon inside thereof and have little silicon at the surfaces, thereby having a smooth surface, so that the resultant toner is caused to have somewhat improved flowability but the adhesion between the magnetic iron oxide particles and the binder resin constituting the magnetic toner is insufficient.

JP-A 61-34070 has proposed a process for producing triiron tetroxide characterized by addition of a hydrosilicate solution during oxidation to triiron tetroxide. The triiron tetroxide obtained through this process retains Si at proximity to its surface, but the Si is present in a layer proximate to the surface, so that the surface thereof is weak against a mechanical impact such as abrasion.

On the other hand, a toner is generally produced through the pulverization process, wherein toner ingredients such a a binder resin, a colorant, etc., are melt-kneaded for uniform dispersion, pulverized and classified to recover toner particles of a desired particle size. According to this process, however, the range of material selection is restricted if toner particle size reduction is intended. For example, it is necessary that the colorant-dispersed resin is sufficiently fragile and can be finely pulverized by an economically feasible apparatus. As a result of providing a fragile colorant-dispersed resin from this requirement, an actual high-speed pulverization of the colorant-dispersed resin is liable to result in particles of a broad particle size range, particularly including a relatively large proportion of fine powder fraction (excessively pulverized particles). Moreover, a toner of such a highly fragile material is liable to be further fine pulverization or powder formation during its use as a developer in a copying machine, etc.

Further, according to toner production by the pulverization process, it is difficult to completely uniformly disperse solid particles, such as magnetic powder or colorant into a resin, and a lower degree of dispersion is liable to result in increased fog and a lower image density. Further, the pulverization process essentially and inevitably results in exposure of magnetic iron oxide particles to the toner particle surfaces, thus leaving problems regarding toner flowability and charging stability in a severe environment.

Thus, the pulverization process essentially poses a limit in production of small-size toner particles required for high resolution and high-quality images, as it is accompanied with inevitable problems regarding uniform chargeability and flowability of the toner.

On the other hand, as the toner particle size is reduced, the particle size of the magnetic material used therefor is necessarily reduced correspondingly. For example, as for magnetite which is a magnetic material having a wide applicability and also functioning as a colorant, a higher coloring power is given at a smaller particle size and a smaller particle size is considered more advantageous from the viewpoint of probability for distribution of even amounts to individual toner particles in the case of smaller particle size toner production. However magnetite generally has a tendency of assuming a high residual magnetization at an increased surface area accompanying particle size reduction. Accordingly, in case where magnetite of smaller particle size exhibiting a higher coloring power is used, the magnetite is liable to cause magnetic agglomeration during toner production, thus leaving problems in developing performance in some cases. Moreover, the residual magnetization of the resultant toner particle is increased, so that the toner particles are liable to exhibit a lower flowability also due to magnetic agglomeration or a lower developing performance due to an increased magnetic constraint force exerted from the sleeve in the magnetic mono-component developing method. Moreover, during the continued use for a long period, a portion of the toner exhibiting a relatively low developing performance is gradually accumulated without being consumed for development, various problems, such as image density lowering occur. In this way, in order to provide a magnetic toner of smaller particle size with excellent performances, it becomes an important factor to uniformly disperse fine particle size magnetite of controlled magnetic properties in the toner.

As a proposal noting magnetic properties of a toner, JP-B 7-60273 has proposed a small-particle size toner obtained by classification into a specific particle size distribution and having residual magnetization of 1–5 emu/g ($Am^2/kg$) prepared through the pulverization process. Further, Japanese Patent No. 2662410 has disclosed a pulverization toner having a residual magnetization of 2.7–5.5 emu/g and comprising a binder resin having a molecular weight distribution showing at least two peaks. The toners disclosed in these publications are however pulverization toners, and are therefore accompanied with difficulty in suppressing the exposure of the magnetic powder to the toner particle surfaces, so that they are accompanied with problems in dispersibility of the magnetic powder, toner flowability, charging stability in a severe environment, a lower circularity and transferability. Further, these publications include only Examples wherein a magnetic blade exerting less load on the toner is used as a toner layer thickness-regulating member in the image forming apparatus, so that these publications do not clarify at all how the toner residual magnetization affects the image quality in the case of using a toner layer thickness regulating member exerting a mechanical load on the toner, such as an elastic blade abutted against a toner-carrying member, for providing an improved toner chargeability.

In order to overcome the problems of the toner produced by the pulverization process and for complying with recent requirement for improved properties of the toner as mentioned above, the production of a toner through a suspension polymerization process has been proposed. A toner produced by suspension polymerization (hereinafter sometimes called "polymerization toner") is advantageous for complying with higher image qualities, because of easiness for production of smaller toner particles, and production of spherical toner particles. However, if a polymerization toner contains magnetic powder, the flowability and the chargeability thereof are liable to be remarkably lowered. This is because magnetic powder is generally hydrophilic and is therefore liable to be present at the toner surface. In order to solve the problem, the surface property modification of magnetic powder becomes important.

As for surface treatment of magnetic powder for improved dispersion thereof in a polymerization toner, many proposals have been made. For example, JP-A 59-200254, JP-A 59-200256, JP-A 59-200257 and JP-A 59-224102 have proposed treatment of magnetic powder with various silane coupling agents, and JP-A 63-250660 and JP-A 10-239897 have disclosed treatment of silicon-containing magnetic powder with silane coupling agents. These treatments provide a somewhat improved dispersibility in the toner but are accompanied with a problem that it is difficult to uniformly hydrophobize magnetic powder surfaces, so that it is difficult to obviate the coalescence of magnetic powder particles and the occurrence of untreated magnetic powder particles, thus being insufficient to improve the dispersibility in the toner to a satisfactory level.

Incidentally, JP-A 10-20548 has disclosed a process for producing a polymerization toner by using a non-aromatic organic peroxide having a molecular weight of at most 250 as a polymerization initiator. According to the publication, it is possible to produce a toner which contains little polymerization initiator decomposition products or residual monomer and has little odor. However, the publication describes carbon as the colorant and does not clarify any regarding the effect in the case of using magnetic powder. Further, the amount of residual monomer provided as a result is still substantial, so that a further improvement is necessary. Further, in the process disclosed in the publication, the suspension liquid after the suspension polymerization is immediately subjected to the addition of an acid for acid washing of the toner particles without a prior filtration of the suspension liquid, so that a carboxylic acid as a polymerization initiator decomposition product is not dissolved in and removed together with the waste water but is allowed to remain in the toner particle in an amount substantially identical to that produced during the polymerization. As a result, the product toner is still accompanied with problems regarding not only odor at the time of heating but also fixability and chargeability according to our study.

JP-A 9-43904 has disclosed a process for producing a polymerization toner containing hydrophobized magnetic powder by using a peroxide polymerization initiator of bis(t-butylperoxy)hexane. The publication however does not disclose how the hydrophobization of magnetic powder was performed. The publication discloses a process wherein core particles are first produced by polymerization in the presence of an azo polymerization initiator and then the shell is formed by polymerization in the presence of the above-mentioned peroxide polymerization initiator. As a result, the publication does not clarify the effects in the case where toner particles are formed by polymerization of a polymerizable mixture including magnetic powder, styrene monomer and a peroxide polymerization initiator. In the disclosed process, only 46 wt. parts of magnetic powder is added per 100 wt. parts of the binder resin to produce core particles which are then coated with a shell resin, so that the magnetic polymer is presumably substantially completely enclosed at an inner portion in the toner particles. The thus-produced toner is used for providing a two-component developer.

Further, JP-B 4-73442 has disclosed a process wherein a resin for a toner is suspension-polymerized in the presence of partially saponified polyvinyl alcohol as a dispersing agent, followed by addition of an alkali metal hydroxide into the polymerization system, heating and filtration, to remove acidic impurities originated from the starting materials or by-produced during polymerization. However, no description is made regarding the production of a polymerization toner. Thus, the publication does not clarify at all what effects are attained when the alkali treatment is applied to the production of a polymerization toner containing magnetic powder.

In recent years, the printer utilizing the electrophotography includes an LED printer and an LBP printer which principally comply with the demand on the market and for which higher resolutions of 400, 600 and 1200 dpi are being required compared with conventional levels of 240–300 dpi. Accordingly, the developing scheme therefor is also required to have a higher resolution. Also in the copying apparatus, higher performances are required, and a principal demand is directed to a digital image forming technique as a trend. The digital image formation principally involves the use of a laser for forming electrostatic images for which a higher resolution is intended. Thus, similarly as in the printer, a developing scheme of a higher resolution and a higher definition is demanded. For complying with such demands, JP-A 1-112253 and JP-A 2-284158 have proposed toners of smaller particle sizes. However, the above-mentioned various problems have not been fully solved as yet.

As for developers for developing electrostatic images, there have been known a two-component developer comprising a carrier and a toner, and a mono-component developer (inclusive of a magnetic toner and a non-magnetic toner) requiring no carrier. The toner is charged principally by friction between the carrier and the toner in the two-component developer system, and principally by friction between the toner and a charge-imparting member in the mono-component developer system. Further, regardless of the toner is for the two-component developer or the mono-component developer, it has been widely practiced to add inorganic fine powder as an external additive to toner particles in order provide the toner with an improved flowability, an improved chargeability, etc.

For example, JP-A 5-66608 and JP-A 4-9860 disclose hydrophobized inorganic fine powder or inorganic fine powder hydrophobized and then treated with silicone oil. Further, JP-A 61-249059, JP-A 4-264453 and JP-A 5-346682 disclosed to add hydrophobized inorganic fine powder and silicone oil-treated inorganic fine powder in combination.

Further, many proposals have been made regarding addition of electroconductive fine powder as an external additive. For example, carbon black as electroconductive fine powder is widely known as an external additive to be attached to or fixed on toner particles for the purpose of, e.g., imparting electroconductivity to the toner, or suppressing excessive charge of the toner to provide a uniform triboelectric charge distribution. Further, JP-A 57-151952, JP-A 59-168458 and JP-A 60-69660 have disclosed to externally add electroconductive fine powder of tin oxide, zinc oxide and titanium oxide, respectively, to high-resistivity toner particles. JP-A 56-142540 has proposed a toner provided with both developing performance and transferability by adding electroconductive magnetic particles, such as iron oxide, iron powder or ferrite, to high-resistivity magnetic toner particles so as to promote charge induction to the magnetic toner. Further, JP-A 61-275864, JP-A 62-258472, JP-A 61-141452 and JP-A 02-120865 have disclosed the addition of graphite, magnetite, polypyrrole electroconductive fine powder and polyaniline electroconductive fine powder to the respective toners. Further, the addition of various species of electroconductive fine powder to the toner is known.

Hitherto, image forming methods, such as electrophotography, electrostatic recording, magnetic recording, and toner jetting have been known. In the electrophotography, for example, an electrical latent image is formed on a latent image-bearing member which is generally a photosensitive member comprising a photoconductor material by various means, the electrostatic image is developed with a toner to form a visible toner image, and the toner image is, after being transferred onto a recording medium, such as paper, as desired, followed by fixing of the toner image onto the recording medium under application of heat, pressure or heat and pressure to form a fixed image.

In the conventional image forming methods, the residual portion of the toner remaining on the image-bearing member after the transfer is generally recovered by various means into a waste vessel in a cleaning step, and the above-mentioned steps are repeated for a subsequent image forming cycle.

The toner recovery or cleaning step has been conventionally performed by using, e.g., a cleaning blade, a cleaning fur brush, a cleaning roller, etc. According to any of these methods, the transfer residual toner is mechanically scraped off or collected by damming into a waste toner vessel. The system including such a cleaning step has been generally accompanied with a difficulty that the life of the latent image-bearing member is shortened due to abrasion caused by abutting of the cleaning member against the latent image-bearing member. The provision of the cleaning device results in an increase in apparatus size and has provided an obstacle against apparatus compactization. From the viewpoints of resource economization, reduction of waste materials and effective utilization of toner, it has been desired to develop an image forming system which is free from waste toner and exhibits excellent fixability and anti-offset property.

In contrast thereto, a so-called development and simultaneous cleaning system (developing-cleaning system) or cleanerless system has been proposed as a system free from generation of waste toner. Such a system has been developed principally for obviating image defects, such as positive memory and negative memory due to residual toner. This system has not been satisfactory for various recording media which are expected to receive transferred toner images in view of wide application of electrophotography in recent years.

Cleanerless systems have been disclosed in, e.g., JP-A 59-133573, JP-A 62-203182, JP-A 63-133179, JP-A 64-20587, JP-A 2-302772, JP-A 5-2289, JP-A 5-53482 and JP-A 5-61383. These systems have not been described with respect to desirable image forming methods or toner compositions.

As for the developing step of developing a latent image with a toner, various methods have been known. For example, as methods for visualizing electrostatic latent images, the cascade developing method, the pressure developing method and the magnetic brush developing method using a two-component developer comprising a carrier and a toner, are known. There are also practiced the non-contact mono-component developing method of causing a toner to jump onto an image-bearing member from a toner-carrying member disposed in no contact with the image-bearing member, the magnetic mono-component developing method of causing a magnetic toner onto a photosensitive member from a rotating sleeve enclosing magnetic poles at an inside thereof and an electric field between the photosensitive member and the sleeve, and the contact mono-component developing method of transferring a toner under an electric field between an image-bearing member and a toner-carrying member abutted against the image-bearing member.

Among such various developing methods, as a developing method suitably applicable to a system essentially free from a cleaning device, a cleanerless system or a development and simultaneous cleaning system, it has been considered essential to rub the electrostatic latent image-bearing member surface with a toner and a toner-carrying member, so that contact developing methods wherein the toner or developer is caused to contact the latent image-bearing member have been principally considered. This is because the mode of rubbing the latent image-bearing member with the toner or developer has been considered advantageous for recovery of the transfer residual toner particles by developing means. However, such a development and simultaneous cleaning system or a cleanerless system is liable to cause toner deterioration, and the deterioration or wearing of the toner-carrying member surface or photosensitive member surface, so that a sufficient solution has not been given to the durability problem. Accordingly, a simultaneous development and cleaning system according to a non-contact developing scheme is desired.

On the other hand, as image forming methods applied to electrophotographic apparatus and electrostatic recording apparatus, various methods are also known as methods of forming latent images on image bearing members, such as an electrophotographic photosensitive member and an electrostatic recording dielectric member. In the electrophotography, for example, it is a general practice to uniformly charge a photosensitive member comprising a photoconductor as a latent image-bearing member in a desired polarity and at desired potential, and then subject the photosensitive member to imagewise pattern exposure to form an electrical latent image.

Hitherto, a corona charger (or corona discharger) has been generally used as a charging device for uniformly charging (including a case for charge removal) a latent image-baring member to desired polarity and potential.

A corona charger is a non-contact-type charging device comprising a discharge electrode such as a wire electrode and a shield electrode surrounding the discharge electrode while leaving a discharge opening, and the device is disposed in no contact with an image-bearing member as a member to be charged so that the discharge opening is directed to the image-bearing member for a prescribed charging operation wherein a high voltage is applied between the discharge electrode and the shield electrode to cause a discharge current (corona shower), to which the image-bearing member surface is exposed to be charged to a prescribed potential.

In recent years, a contact charging device has been proposed and commercialized as a charging device for a member to be charged such as a latent image-bearing member because of advantages, such as low ozone-generating characteristic and a lower power consumption, than the corona charging device.

A contact charging device is a device comprising an electroconductive charging member (which may also be called a contact charging member or a contact charger) in the form of a roller (charging roller), a fur brush, a magnetic brush or a blade, disposed in contact with a member-to-be-charged, such as an image-bearing member, so that the contact charging member is supplied with a prescribed charging bias voltage to charge the member-to-be-charged to prescribed polarity and potential.

The charging mechanism (or principle) during the contact charging may include (1) discharge (charging) mechanism and (2) direct injection charging mechanism, and may be classified depending on which of these mechanism is predominant.

(1) Discharge Charging Mechanism

This is a mechanism wherein a member is charged by a discharge phenomenon occurring at a minute gap between the member and a contact charging member. As a certain discharge threshold is present, it is necessary to apply to the contact charging member a voltage which is larger than a prescribed potential to be provided to the member-to-be-charged. Some discharge product occurs wile the amount thereof is remarkably less than in a corona charger, and active ions, such as ozone, occur though the amount thereof is small.

(2) Direct Injection Charging Mechanism

This is a mechanism wherein a member surface is charged with a charge which is directly injected into the member from a contact charging member. This mechanism may also be called direct charging, injection charging or charge-injection charging. More specifically, a charging member of a medium resistivity is caused to contact a member-to-be-charged to directly inject charges to the member-to-be-charged basically without relying on a discharge phenomenon. Accordingly, a member can be charged to a potential corresponding to an applied voltage to the charging member even if the applied voltage is below a discharge threshold. This mechanism is not accompanied with occurrence of active ions, such as ozone, so that difficulties caused by discharge products can be obviated. However, based on the direct injection charging mechanism, the charging performance is affected by the contactivity of the contact charging member onto the member-to-be-charged. Accordingly, it is preferred that the charging member is provided with a relative moving speed difference from the member-to-be-charged so as to provide a more frequent contact and more dense points of contact with the member-to-be-charged.

As a contact charging device, a roller charging scheme using an electroconductive roller as a contact charging member is preferred because of the stability of charging performance and is widely used. During the contact charging according to the conventional roller charging scheme, the above-mentioned discharge charging mechanism (1) is predominant.

A charging roller has been formed of a conductive or medium-resistivity rubber or foam material optionally disposed in lamination to provide desired characteristics. Such a charging roller is provided with elasticity so as to ensure a certain contact with a member-to-be-charged, thus causing a large frictional resistance. The charging roller is moved following the movement of the member-to-be-charged or with a small speed difference with the latter. Accordingly, even if the direct injection charging is intended, the lowering in charging performance, and charging irregularities due to insufficient contact, contact irregularity due to the roller shape and attachment onto the member-to-be-charged, are liable to be caused.

FIG. 7 is a graph illustrating examples of charging efficiencies for charging photosensitive members by several contact charging members. The abscissa represents a bias voltage applied to the contact charging member, and the ordinate represents a resultant charged potential provided to the photosensitive member. The charging performance in the case of roller charging is represented by a line A. Thus, the surface potential of the photosensitive member starts to increase at an applied voltage exceeding a discharge threshold of ca. −500 volts. Accordingly, in order to charge the photosensitive member to a charged potential of −500 volts, for example, it is a general practice to apply a DC voltage of −1000 volts, or a DC voltage of −500 volts in superposition of an AC voltage at a peak-to-peak voltage of, e.g., 1200 volts, so as to keep a potential difference exceeding the discharge threshold, thereby causing the charged photosensitive member potential to be converged to a prescribed charged potential.

To describe based on a specific example, in a case where a charging roller is abutted against an OPC photosensitive member having a 25 $\mu$m-thick photosensitive layer, the surface potential of the photosensitive member starts to increase in response to an applied voltage of ca. 640 volts or higher and thereafter increases linearly at a slope of 1. The threshold voltage may be defined as a discharge inclination voltage Vth. Thus, in order to obtain a photosensitive member surface potential Vd required for electrophotography, it is necessary to apply a DC voltage of Vd+Vth exceeding the required potential to the charging roller. Such a charging scheme of applying only a DC voltage to a contact charging member may be termed a "DC charging scheme". In the DC charging scheme, however, it has been difficult to charge the photosensitive member to a desired potential, since the resistivity of the contact charging member is liable to change in response to a change in environmental condition, and because of a change in Vth due to a surface layer thickness change caused by abrasion of the photosensitive member.

For this reason, in order to achieve a more uniform charging, it has been proposed to adopt an "AC charging scheme" wherein a voltage formed by superposing a DC voltage corresponding to a desired Vd with an AC voltage having a peak-to-peak voltage in excess of 2×Vth is applied to a contact charging member as described in JP-A 63-149669. According to this scheme, the charged potential of the photosensitive member is converged to Vd which is a central value of the superposed AC voltage due to the potential smoothing effect of the AC voltage, whereby the charged potential is not affected by the environmental change. In the above-described contact charging scheme, the charging mechanism essentially relies on discharge from the contact charging member to the photosensitive member, so that a voltage exceeding a desired photosensitive member surface potential has to be applied to the contact charging member and a small amount of ozone is generated.

Further, in the AC-charging scheme for uniform charging, ozone generation is liable to be promoted, a vibration noise (AC charging noise) between the contact charging member and the photosensitive member due to AC voltage electric field is liable to caused, and the photosensitive member surface is liable to be deteriorated due to the discharge, thus posing a new problem.

Fur brush charging is a charging scheme, wherein a member (fur brush charger) comprising a brush of electroconductive fiber is used as a contact charging member, and the conductive fiber brush in contact with the photosensitive member is supplied with a prescribed charging bias voltage to charge the photosensitive member surface to prescribed polarity and potential. In the fur brush charging scheme, the above-mentioned discharge charging mechanism may be predominant.

As the fur brush chargers, a fixed-type charger and a roller-type charger have been commercialized. The fixed-type charger is formed by bonding a pile of medium-resistivity fiber planted to or woven together with a substrate to an electrode. The roller-type charger is formed by winding such a pile about a core metal. A fiber density of ca. 100/mm$^2$ can be relatively easily obtained, but even at such a high fiber density, the contact characteristic is insufficient for realizing sufficiently uniform charging according to the direct injection charging. In order to effect a sufficiently uniform charging according to the direct injection charging, it is necessary to provide a large speed difference between the fur brush charger and the photosensitive member, and this is not practically feasible.

An example of the charging performance according to the fur brush charging scheme under DC voltage application is represented by a line B in FIG. 7. Accordingly, in the cases of fur brush charging using any of the fixed-type charger and the roller-type charger, a high charging bias voltage is applied to cause a discharge phenomenon to effect the charging.

In contrast to the above-mentioned charging schemes, in a magnetic brush scheme, a charging member (magnet brush charger) obtained by constraining electroconductive magnetic particles in the form of a magnetic brush under a magnetic field exerted by a magnet roll is used as a contact charging member, and the magnetic brush in contact with a photosensitive member is supplied with a prescribed charging bias voltage to charge the photosensitive member surface to prescribed polarity and potential. In the magnetic brush charging scheme, the above-mentioned direct injection charging scheme (2) is predominant. Uniform direct injection charging becomes possible, e.g., by using magnetic particles of 5–50 $\mu$m in particle size and providing a sufficient speed difference with the photosensitive member.

An example of the charging performance according to the magnetic brush scheme under DC voltage application is represented by a line C in FIG. 3, thus allowing a charged potential almost proportional to the applied bias voltage. The magnetic brush charging scheme is however accompanied with difficulties that the device structure is liable to be complicated, and the magnetic particles constituting the magnetic brush are liable to be liberated from the magnetic brush to be attached to the photosensitive member.

Further, regarding the contact charging scheme and the contact transfer scheme, there is disclosed a method wherein an electroconductive elastic roller is abutted against an image-bearing member and is supplied with a voltage to uniformly charge the image-bearing member surface, followed by exposure and development to form a toner image, another electroconductive roller is abutted against the image-bearing member, and a transfer material is passed therebetween to transfer the toner image on the transfer material, followed by a fixing step to obtain a copy image (JP-A 63-149669 and JP-A 2-123385).

The contact charging scheme or the contact transfer scheme, unlike the corona discharge scheme, is accompanied with problems. More specifically, in the contact transfer step, the transfer member is abutted against the image-bearing member via a transfer material, so that the toner image is pressed between the image-bearing member and the transfer material by a pressing force exerted by the transfer member, thus being liable to cause a local transfer failure called "transfer (hollow) dropout". In addition, in response to demand for high-resolution and high-definition images in recent years, there is a tendency of using small-particle size toners. As the toner particle size becomes smaller, compared with a Coulomb force acting on the toner particles in the transfer step, the forces acting for attaching the toner particles onto the image-bearing member (such as an image force and a van der Waals force) become relatively larger, to increase the transfer-residual toner.

On the other hand, in the contact charging step, the charging member is pressed against the image-bearing member surface, so that the transfer-residual toner is also pressed against the image-bearing member by the charging member, whereby the image-bearing member is liable to cause surface abrasion or wearing, and further toner melt-sticking is liable to occur at the abraded part of the image-bearing member as the nuclei. This is liable to be more pronounced as the transfer-residual toner is increased in amount.

The abrasion and toner melt-sticking on the image-bearing member result in serious defects in latent image formation on the image-bearing member. More specifically, the abraded part of the image-bearing member causes a primary charging failure to result in black spots in a halftone image, and the toner melt-sticking causes an exposure failure to result in white spots in a halftone image. Further, these surface defects result in poorer toner transfer. As a result, in combination with the above-mentioned transfer failure due to the contact transfer, the image defects can be synergistically promoted.

The abrasion and transfer failure on the image-bearing member is liable to be pronounced in the case of using a developer comprising indefinite-shaped toner particles. This is presumably because such an indefinite shaped toner is liable to scrape the image-bearing member surface in addition to its inherent lower transferability due to the shape.

The abrasion problem is promoted especially when a magnetic developer comprising toner particle surfaces at which the magnetic powder is exposed. This is readily understood since the exposed magnetic powder is directly pressed against the photosensitive member.

Further, in case where the transfer-residual toner is increased, it becomes difficult to retain a sufficient contact between the contact charging member and the photosensitive member to result in a lower chargeability, so that in the reversal development system, fog, i.e., toner transfer onto non-image parts, is liable to occur. This phenomenon becomes more noticeable in a low-humidity environment wherein the resistivities of the members are liable to increase.

In view of also such environmental factors, in order to realize an image forming method satisfactorily employing the contact charging scheme and the contact transfer scheme, it is desired to develop a magnetic toner (developer) which shows a high transferability and is free from the abrasion and toner melt-sticking on the image-bearing member.

Now, the application of such a contact charging scheme to a development and simultaneous cleaning method or a cleanerless image forming method as described, is considered.

The development and simultaneous cleaning method or the cleanerless image forming method does not use a cleaning member, so that the transfer residual toner particles remaining on the photosensitive member are caused to contact the contact charging system wherein the discharge charging mechanism is predominant. If an insulating toner is attached to or mixed into the contact charging member, the charging performance of the charging member is liable to be lowered.

In the charging scheme wherein the discharge charging mechanism is predominant, the lowering in charging performance is caused remarkably from a time when the toner layer attached to the contact charging member surface provides a level of resistance obstructing a discharge voltage. On the other hand, in the charging scheme wherein the direct injection charging mechanism is predominant, the lowering in charging performance is caused as a lowering in chargeability of the member-to-be-charged due to a lowering in opportunity of contact between the contact charging member surface and the member-to-be-charged due to the attachment or mixing of the transfer residual toner particles into the contact charging member. The lowering in uniform chargeability of the photosensitive member (member-to-be-charged) results in a lowering in contrast and uniformity of latent image after imagewise exposure, and a lowering in image density and increased fog in the resultant images.

Further, in the development and simultaneous cleaning method or the cleanerless image forming method, it is important to control the charging polarity and charge of the transfer residual toner particles on the photosensitive member and stably recover the transfer residual toner particles in the developing step, thereby preventing the recovered toner from obstructing the developing performance. For this purpose, the control of the charging polarity and the charge of the transfer residual toner particles are effected by the charging member.

This is more specifically described with respect to an ordinary laser beam printer as an example. In the case of a reversal development system using a charging member supplied with a negative voltage, a photosensitive member having a negative chargeability and a negatively charged toner, the toner image is transferred onto a recording medium in the transfer step by means of a transfer member applying a positive voltage. In this case, the transfer residual toner particles are caused to have various charges ranging from a positive polarity to a negative polarity depending on the properties (thickness, resistivity, dielectric constant, etc.) of the recording medium and the image area thereon. However, even if the transfer residual toner is caused to have a positive charge in the transfer step, the charge thereof can be uniformized to a negative polarity by the negatively charged charging member for negatively charging the photosensitive member.

As a result, in the case of a reversal development scheme, the negatively charged residual toner particles are allowed to remain on the light-part potential where the toner is to be attached, and some irregularly charged toner attached to the dark-part potential is attracted to the toner carrying member due to a developing electric field relationship during the reversal development so that the transfer residual toner at the dark-part potential is not allowed to remain thereat but can be recovered. Thus, by controlling the charging polarity of the transfer residual toner simultaneously with charging of the photosensitive member by means of the charging member, the development and simultaneous cleaning or cleanerless image forming method can be realized.

However, if the transfer residual toner particles are attached to or mixed to the contact charging member in an amount exceeding the toner charge polarity-controlling capacity of the contact charging member, the charging polarity of the transfer residual toner particles cannot be uniformized so that it becomes difficult to recover the toner particles in the developing step. Further, even if the transfer residual toner particles are recovered by a mechanical force of rubbing, they adversely affect the triboelectric chargeability of the toner on the toner-carrying member if the charge of the recovered transfer residual toner particles has not been uniformized.

Thus, in the development and simultaneous cleaning or cleanerless image forming method, the continuous image-forming performance and resultant image quality are closely associated with the charge-controllability and attachment-mixing characteristic of the transfer residual toner particles at the time of passing by the charging member.

Further, JP-A 3-103878 discloses to apply powder on a surface of a contact charging member contacting the member-to-be-charged so as to prevent charging irregularity and stabilize the uniform charging performance. This system however adopts an organization of moving a contact charging member (charging roller) following the movement of the member-to-be-charged (photosensitive member) wherein the charging principle generally relies on the discharge charging mechanism simultaneously as in the above-mentioned cases of using a charging roller while the amount of ozone adduct has been remarkably reduced than in the case of using a corona charger, such as scorotron. Particularly, as an AC-superposed DC voltage is used for accomplishing a stable charging uniformity, the amount of ozone adducts is increased thereby. As a result, in the case of a continuous use of the apparatus for a long period, the defect of image flow due to the ozone products is liable to occur. Further, in case where the above organization is adopted in the cleanerless image forming apparatus, the attachment of the powder onto the charging member is obstructed by mixing with transfer-residual toner particles, thus reducing the uniform charging effect.

Further, JP-A 5-150539 has disclosed an image forming method using a contact charging scheme wherein a developer comprising at least toner particles and electroconductive particles having an average particle size smaller than that of the toner particles is used, in order to prevent the charging obstruction due to accumulation and attachment onto the charging member surface of toner particles and silica fine particles which have not been fully removed by the action of a cleaning blade on continuation of image formation for a long period. The contact charging or proximity charging scheme used in the proposal is one relying on the discharge charging mechanism and not based on the direct injection charging mechanism so that the above problem accompanying the discharge mechanism accrues. Further, in case where the above organization is applied to a cleanerless image forming apparatus, larger amounts of electroconductive particles and toner particles are caused to pass through the charging step and have to be recovered in the developing step. No consideration on these matters or influence of such particles when such particles are recovered on the developing performance of the developer has been paid in the proposal. Further, in a case where a contact charging scheme relying on the direct injection charging scheme is adopted, the electroconductive fine particles are not supplied in a sufficient quantity to the contact charging member, so that the charging failure is liable to occur due to the influence of the transfer residual toner particles.

Further, in the proximity charging scheme, it is difficult to uniformly charge the photosensitive member in the presence of large amounts of electroconductive fine particles and transfer residual toner particles, thus failing to achieve the effect of removing the pattern of transfer residual toner particles. As a result, the transfer residual toner particles interrupt the imagewise exposure pattern light to cause a toner particle pattern ghost. Further, in the case of instantaneous power failure or paper clogging during image formation, the interior of the image forming apparatus can be remarkably soiled by the developer.

In order to improve the charge control performance when the transfer residual toner particles are passed by the charging member in the development and simultaneous cleaning method, JP-A 11-15206 has proposed to use a toner comprising toner particles containing specific carbon black and a specific azo iron compound in mixture with inorganic fine powder. Further, it has been also proposed to use a toner having a specified shape factor and an improved transferability to reduce the amount of transfer residual toner particles, thereby improving the performance of the development and simultaneous cleaning image forming method. This image forming method however relies on a contact charging scheme based on the discharge charging scheme and not on the direct injection charging scheme, so that the system is not free from the above-mentioned problems involved in the discharge charging mechanism. Further, these proposals may be effective for suppressing the charging performance of the contact charging member due to transfer residual toner particles but cannot be expected to positively enhance the charging performance.

Further, among commercially available electrophotographic printers, there is a type of development and simultaneous cleaning image forming apparatus including a roller member abutted against the photosensitive member at a position between the transfer step and the charging step so as to supplement or control the performance of recovering transfer residual toner particles in the development step. Such an image forming apparatus may exhibit a good development and simultaneous cleaning performance and remarkably reduce the waste toner amount, but liable to result in an increased production cost and a difficulty against the size reduction.

JP-A 10-307456 has disclosed an image forming apparatus adapted to a development and simultaneous cleaning image forming method based on a direct injection charging mechanism and using a developer comprising toner particles and electroconductive charging promoter particles having particle sizes smaller than ½ of the toner particle size. According to this proposal, it becomes possible to provide a development and simultaneous cleaning image forming apparatus which is free from generation of discharge product, can remarkably reduce the amount of waste toner and is advantageous for producing inexpensively a small size apparatus. By using the apparatus, it is possible to provide good images free from defects accompanying charging failure, and interruption or scattering of imagewise exposure light. However, a further improvement is desired.

Further, JP-A 10-307421 has disclosed an image forming apparatus adapted to a development and simultaneous cleaning method, based on the direct injection charging mechanism and using a developer containing electroconductive particles having sizes in a range of 1/50–1/2 of the toner particle size so as to improve the transfer performance.

JP-A 10-307455 discloses the use of electroconductive fine particles having a particle size of 10 nm–50 μm so as to reduce the particle size to below one pixel size and obtain a better charging uniformity.

JP-A 10-307457 describes the use of electroconductive particles of at most about 5 μm, preferably 20 nm–5 μm, so as to bring a part of charging failure to a visually less recognizable state in view of visual characteristic of human eyes.

JP-A 10-307458 describes the use of electro-conductive fine powder having a particle size smaller than the toner particle size so as to prevent the obstruction of toner development and the leakage of the developing bias voltage via the electroconductive fine powder, thereby removing image defects. It is also disclosed that by setting the particle size of the electroconductive fine powder to be larger than 0.1 μm, the interruption of exposure light by the electroconductive fine powder embedded at the surface of the image-bearing member is prevented to realize excellent image formation by a development and simultaneous cleaning method based on the direct injection charging scheme. However, a further improvement is desired.

JP-A 10-307456 has disclosed a development and simultaneous cleaning image forming apparatus capable of forming without causing charging failure or interruption of imagewise exposure light, wherein electroconductive fine powder is externally added to a toner so that the electroconductive powder is attached to the image-bearing member during the developing step and allowed to remain on the image-bearing member even after the transfer step to be present at a part of contact between a flexible contact charging member and the image-bearing member.

These proposals however have left a room for further improvement regarding the stability of performance during repetitive use for a long period and performance in the case of using smaller size toner particles in order to provide an enhanced resolution.

SUMMARY OF THE INVENTION

A generic object of the present invention is to solve the above-mentioned problems of the prior art.

A more specific object of the present invention is to provide a magnetic toner free from generating unpleasant odor at the time of printing and showing a quick chargeability even in a relatively high temperature/high humidity environment.

Another object of the present invention is to provide a magnetic toner less liable to cause toner melt-sticking onto a toner layer thickness-regulating member or a photosensitive member and capable of maintaining high-quality images even in continuous printing on a large number of sheets.

A further object of the present invention is to provide a process for producing the above-mentioned magnetic toner.

Another object of the present invention is to provide an image forming method using the magnetic toner, free from generating discharge products and capable of remarkably reducing the waste toner.

Another object of the present invention is to provide an image forming method adopting a developing-cleaning step (i.e., a development and simultaneous cleaning step or a cleanerless system) and yet capable of stably obtaining good chargeability.

A further object of the present invention is to provide an image forming method adopting a developing-cleaning step and yet capable of exhibiting a good transferability and good performance in recovery of transfer-residual toner.

A further object of the present invention is to provide an image forming apparatus adopting a developing-cleaning system advantageous for production of an inexpensive compact apparatus and yet capable of providing good images free from charging failure even in a long period of repetitive use.

A still further object of the present invention is to provide an image forming apparatus and a process cartridge therefor capable of stably providing good images even in the case of small-size toner particles in order to realize a higher resolution.

According to the present invention, there is provided a magnetic toner, comprising: magnetic toner particles each comprising at least a binder resin and magnetic toner, and inorganic fine powder; wherein the magnetic toner has an average circularity of at least 0.970,

- the magnetic toner has a magnetization of 10 –50 $Am^2/kg$ at a magnetic field of 79.6 kA/m,
- the magnetic powder comprises at least magnetic iron oxide,
- the magnetic toner particles retain carbon in an amount of A and iron in an amount of B at surfaces thereof as measured by X-ray photoelectron spectroscopy, satisfying: $B/A<0.001$,
- the binder resin comprises a resin formed by polymerization of a monomer comprising at least styrene monomer,
- the magnetic toner has a residual styrene monomer content of less than 300 ppm, and the magnetic toner contains at least 50% by number of toner particles satisfying a relationship of $$D/C \leqq 0.02,$$

wherein C represents a volume-average particle size of the magnetic toner, and D represents a minimum distance between a magnetic toner particle and the magnetic toner contained in the magnetic toner particles.

The present invention further provides a process for producing the magnetic toner, and an image forming method, an image forming apparatus and a process cartridge using the above-mentioned magnetic toner.

These and other objects, features and advantages of the present invention will become more apparent upon a consideration of the following description of the preferred embodiments of the present invention taken in conjunction with the accompanying drawings.

DETAILED DESCRIPTION OF THE INVENTION

<1>Magnetic Toner

Figure 1:
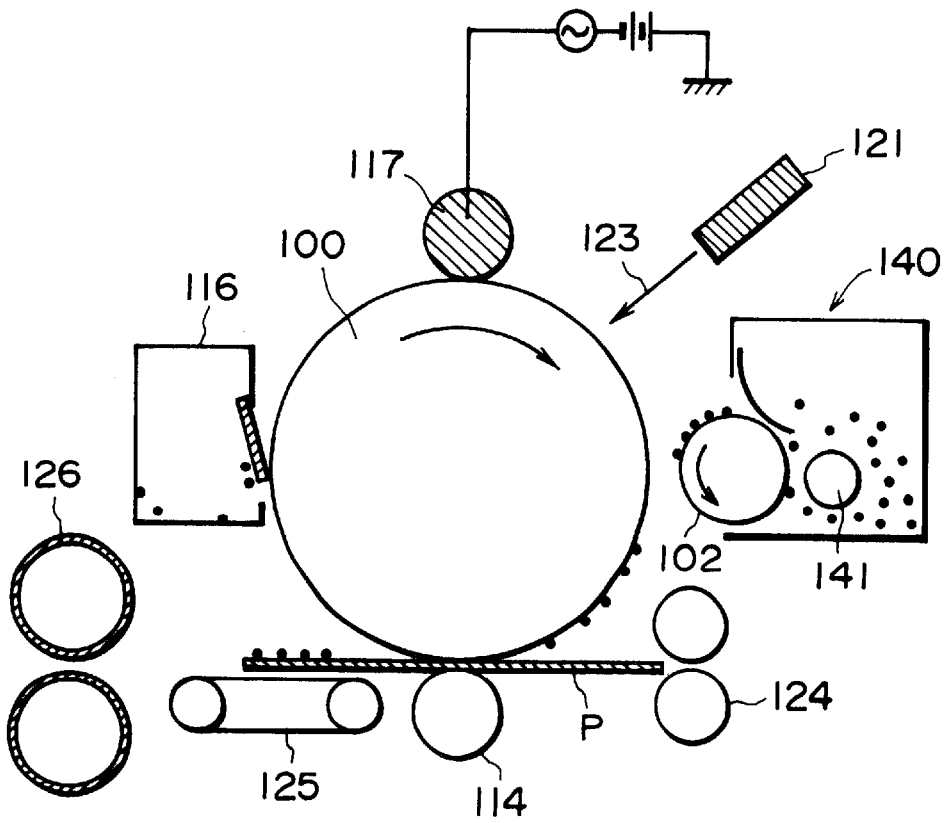
FIGS. 1, 5 and 6 respectively illustrate an embodiment of the image forming apparatus according to the invention.

The magnetic toner according to the present invention comprises at least toner particles each comprising a binder resin and magnetic powder, and inorganic fine powder externally blended with the toner particles.

The binder resin constituting the toner of the present invention principally comprises a styrene-based resin.

The styrene-based resin herein means a resin obtained by polymerizing a monomer (composition) comprising styrene monomer in general, and examples thereof may include: polystyrene; and styrene copolymers, such as styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethyl aminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleic acid ester copolymers.

Other resins can also be used together with a styrene-based resin to constitute the binder resin. Examples thereof may include: polymethyl methacrylate, polybutyl methacrylate, polyvinyl acetate, polyethylene, polypropylene, polyvinyl butyral, silicone resin, polyester resin, polyamide resin, epoxy resin, polyacrylic acid resin, rosin, modified rosin, terpene resin, phenolic resin, aliphatic or alicyclic hydrocarbon resins, and aromatic petroleum resin.

As described above, the binder resin can comprise a styrene-copolymer and another resin, but is preferred that the binder resin contains at least 50 wt. %, more preferably at least 60 wt. %, further preferably at least 70 wt. %, of polymerized styrene units.

The binder resin may preferably have a glass-transition temperature (Tg) of 50–70° C. Below 50° C., the storability of the toner is liable to be lowered, and above 70° C., the toner is liable to exhibit inferior fixability.

The glass transition temperature (Tg) of the binder resin may be measured by differential thermal analysis similarly as a heat-absorption peak of a wax as described hereinafter. More specifically, the glass transition temperature may be measured by using a differential scanning calorimeter (SC) (e.g., "DSC-7", available from Perkin-Elmer Corp.) according to ASTM D3418-8. Temperature correction of the detector may be effected based on melting points of indium and zinc, and calorie correction may be effected based on heat of fusion of indium. A sample is placed on an aluminum pan and subjected to heating at a temperature increasing rate of 10° C./min in parallel with a blank aluminum pan as a control.

The magnetic toner particles of the present invention may be obtained through a polymerization process. In this case, a polymerizable monomer composition including styrene monomer may be subjected to polymerization. Examples of other monomers which may be used together with styrene monomer may include: acrylate esters, such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, and phenyl acrylate; methacrylate esters, such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenylmethacrylate, dimethylaminoethyl methacrylate, and diethylaminoethyl methacrylate; acrylonitrile, methacrylonitrile and acrylamide. As a result, the adjustment of Tg as mentioned above may be facilitated.

It is preferred that the binder resin has been obtained through polymerization of a monomer composition comprising styrene monomer in the presence of a peroxide polymerization initiator. An azo-type polymerization initiator has also been widely used as a polymerization initiator. It is however difficult to attain the effect of the present invention by using an azo-type polymerization initiator alone. More specifically, an azo-type polymerization initiator has a low initiator efficiency, and the generated radical species are liable to cause radical coupling to by-produce a substantial amount of initiator decomposition products, which are liquid substances having high boiling points or crystalline substances having a low melting points and are thus difficult to remove by post-polymerization processing, thus remaining in a substantial amount in the resultant toner particles. The decomposition products have a certain degree of polarity and therefore are liable to be present in the vicinity of toner particle surfaces in the case of toner production through the polymerization process. Further, the decomposition products bring the magnetic powder in the toner particles to the vicinity of the surfaces, thus being liable to cause difficulties, such as inferior dispersion of magnetic powder in toner particles, lowering in fixability, chargeability and storability of the toner, and occurrence of unpleasant odor of the decomposition products at the time of printing. Further, an azo-type polymerization initiator is liable to leave a substantially larger amount of residual styrene monomer in the toner than in the case of using a peroxide polymerization initiator, thus being liable to cause monomer odor at the time of printing out unless careful refining treatment is performed. In contrast thereto, a peroxide polymerization initiator results in little initiator decomposition products and such decomposition products, even if occurred, can be relatively easily removed from the toner particles. Moreover, the amount of residual styrene monomer can be suppressed very low. As a result, the resultant toner can provide high-quality images while suppressing the occurrence of odor due to styrene monomer and initiator decomposition products.

The magnetic toner of the present invention is characterized by a low residual styrene monomer content of below 300 ppm (by weight), preferably below 100 ppm. If the residual styrene monomer content reaches 300 ppm or more, it is impossible to completely prevent the occurrence of odor at the time of fixation. Further, in the case of long hours of continuous printing in a relatively high-temperature environment, the residual styrene monomer vaporizes from the inside of the toner particles, so that the chargeability of the toner or the photosensitive member is liable to be lowered to result in a lower image density or fog. Further, at the time when the residual styrene monomer exudes from the inside of the toner, the styrene monomer is liable to be accompanied with wax also contained at the inside of the toner, so that the toner is liable to cause agglomeration. In a high temperature environment, a toner is inherently liable to thermally cause a lowering in mechanical strength, and such a high residual styrene monomer promotes the liability to cause toner melt-sticking onto the toner-carrying member, toner layer thickness-regulating member and photosensitive member, or agglomeration of the toner particles, so that it becomes difficult to obtain high-quality images.

The peroxide polymerization initiator used for producing the magnetic toner of the present invention may include organic peroxides, inclusive of peroxy esters, peroxy dicarbonates, dialkyl peroxides, peroxy ketals, ketone peroxides, hydroperoxides and diacyl peroxides; and inorganic peroxides, such as persulfate salts and hydrogen peroxide. Among these, organic peroxides soluble in the monomer are effective for suppressing the residual styrene monomer, and particularly peroxy esters, peroxy dicarbonates, dialkyl peroxides, diacyl peroxides, diaryl peroxides and peroxy ketals are preferred so as to also effect better dispersion of magnetic powder.

Moreover, the use of at least one of a peroxy ester and a diacyl peroxide is preferred so as to cause an appropriate degree of gellation of the binder due to co-occurrence of hydrogen-withdrawal reaction, thus providing advantageous low-temperature fixability.

Various organic peroxides may be used in the present invention. Specific examples thereof may include: peroxy esters, such as t-butyl peroxyacetate, t-butyl peroxylaurate, t-butyl peroxypivalate, t-butyl peroxy-2-ethylhexanoate, t-hexyl peroxyacetate, t-hexyl peroxylaurate, t-hexyl peroxypivalate, t-hexyl peroxy-2-ethylhexanoate, t-hexyl peroxyisobutylate, t-hexyl peroxyneodecanoate, t-butyl peroxybenzoate, α,α'-bis(neodecanoylperoxy) diisopropylbenzene, cumyl peroxyneodecanoate, 1,1,3,3-tetramethylbutyl peroxy-2-ethylhexanoate, 1,1,3,3-tetramethylbutyl peroxy-neodecanoate, 1-cyclohexyl-1-methylethyl peroxyneodecanoate, 2,5-dimethyl-2,5-bis(2-ethylhexanoylperoxy)hexane, 1-cyclohexyl-1-methylethyl peroxy-2-ethylhexanoate, t-hexyl peroxyisopropylmonocarbonate, t-butyl peroxyisopropylmonocarbonate, t-butyl peroxy-2-ethylhexylmonocarbonate, t-hexyl peroxybenzoate, 2,5-dimethyl-2,5-bis(benzoylperoxy)hexane, t-butyl peroxy-m-toluoylbenzoate, bis(t-butylperoxy)isophthalate, t-butyl peroxymaleic acid, t-butyl peroxy-3,5,5-trimethylhexanoate, and 2,5-dimethyl-2,5-bis(m-toluoylperoxy)hexane; peroxy dicarbonates, such as diisopropyl peroxydicarbonate, and bis(4-t-butylcyclohexyl) peroxydicarbonate; peroxyketals, such as 1,1-di-t-butylperoxycyclohexane, 1,1-di-t-hexylperoxycyclohexane, 1,1-di-butylperoxy-3,3,5-trimethylcyclohexane, and 2,2-di-t-butylperoxybutane; dialkyl peroxides, such as di-t-butyl peroxide, dicumyl peroxide, and t-butylcumyl peroxide; and further t-butylperoxylallyl monocarbonate. Among the organic peroxides, a peroxy ester or a diacryl peroxide is particularly suitable.

The above-mentioned peroxides can be used in two or more species in combination. Moreover, within an extent of not adversely affecting the present invention, it is possible to use an azo-type polymerization initiator, such as 2,2'-azobisisobutyronitrile, 1,1'-azobis(cyclohexane-1-carbonitrile), 2,2'-azobis-4-methoxy-2,4-dimethylvaleronitrile, or azobisiisobutyronitrile in combination with the peroxide polymerization initiator.

The peroxide polymerization initiation may preferably be used in 0.5–20 wt. parts, per 100 wt. parts of the monomer for polymerization so as to provide a polymer having a peak molecular weight in a region of $1\times10^4$–$1\times10^5$, thereby providing a toner with desirable strength and melt-characteristic.

The organic peroxide used in the present invention may desirably have a theoretical active oxygen content of 4.0–12.0 wt. %. Below 40 wt. %, a large amount of the initiator is used to be economically disadvantageous. Above 12.0 wt. %, the handling thereof and the polymerization control are liable to be difficult.

The magnetic toner of the present invention may preferably contain at most 2000 ppm (by weight) of carboxylic acid originated from the peroxy ester or diacyl peroxide. If a peroxy ester as a polymerization initiator is thermally decomposed, corresponding alkoxy radicals and carboxylic acid radicals are first produced, and then these radicals and alkyl radicals caused by de-carboxylation of the carboxylic acid radicals are attached to monomer molecules to proceed with polymerization. Similarly, diacyl peroxide is thermally decomposed first into corresponding carboxylic radicals, and the carboxylic acid radicals and alkyl radicals caused by de-carboxylation are attached to monomer molecules to proceed with polymerization.

As a result of our study, however, it has been found that a carboxylic acid which has not been considered to be not by-produced in production of polymerization toner is actually by-produced in a substantial amount (presumably due to withdrawal of hydrogen from the charge control agent, magnetic toner, hydrophobization agent for the magnetic powder, monomer and polymer, by the carboxylic acid radicals). It has been also found that the carboxylic acid functions to improve the dispersion of the magnetic powder in the toner. On the other hand, the carboxylic acid is a hydrophilic compound having a polar group, so that it is liable to cause a lowering in chargeability in a high humidity environment and an excessive charge in a low humidity environment; and also adversely affect the fixability. As a result, the carboxylic acid may be advantageous in the toner particle production step but may preferably be removed after the toner production.

More specifically, a carboxylic acid content in excess of 2000 ppm in the magnetic toner of the present invention is liable to lower the environmental stability and fixability of the toner in printing. Thus, the carboxylic acid content in the magnetic toner of the present invention may preferably be at most 1000 ppm, more preferably 500 ppm or below.

The residual monomer content and carboxylic acid content in the toner described herein are based on values measured in the following manner. Ca. 500 mg of a toner sample is accurately weighed in a sample bottle. Then, ca. 10 g of acetone is accurately weighed into the bottle, and the content is well mixed and then subjected to 30 min. of ultrasonic wave application by an ultrasonic washing machine. Then, the content is filtrated through a membrane filter (e.g., a disposable membrane filter "25JP020AN", made by Advantec Toyo K.K.), and 2 ml of the filtrate liquid is subjected to gas chromatography. The results are compared with calibration curves prepared in advance by using styrene and carboxylic acids. The gas chromatography conditions are as follows.

Gas chromatograph: "Model 6890GC", made by Hewlett-Packard Corp.

Column: INNOWax (200 μm×0.40 μm×25 m) made by Hewlett-Packard Corp.

Carrier gas: He (constant pressure mode: 20 psi)

Oven: Held at 50° C. for 10 min., heated up to 200° C. at a rate of 10° C./min. and held at 200° C. for 5 min.

INJ: 200° C., pulsed split-less mode (20–40 psi, unit 0.5 min.)

Split rate: 5.0:1.0

DET: 250° C. (FID)

By suppressing the carboxylic acid content at a low level, the magnetic toner according to the present invention can exhibit good fixability and stable chargeability regardless of environment condition changes.

Incidentally, various carboxylic acids may be produced by decomposition of peroxide polymerization initiators and may include: 2-ethylhexanoic acid, neodecanoic acid, pivalic acid, isovaleric acid, succinic acid, benzoic acid, octanoic acid, stearic acid and lauric acid depending on the peroxide initiators used.

The removal of such carboxylic acid originated from peroxide polymerization initiators, particularly peroxyesters or diacyl peroxides, from the toner particles after the polymerization may be effected by various methods, inclusive of: vacuum drying or heat-drying of the toner particles, dispersion of the toner particles in water and co-distillation of the carboxylic acid together with the water, and treatment of bringing the aqueous medium containing toner particles to an alkalinity (optionally together with stirring and/or heating) and separation of the alkaline aqueous medium from the toner particle. The alkali treatment is most effective and convenient to practice, and may be performed, e.g., in the following manner.

For example, after the polymerization for toner particle production, the aqueous suspension medium is brought to an alkaline pH of 8–14, preferably 9–13, more preferably 10–12 by addition of an alkali, such as sodium carbonate or sodium hydroxide, and then heated under stirring, so that the carboxylic acid is converted into the corresponding water-soluble carboxylic acid salt, which is dissolved in the aqueous medium and removed together with the waste water, e.g., at the time of recovery of toner particles by filtration. The range of pH 10–12 is preferred for complete neutralization of the carboxylic acid and also for suppressing the hydrolysis of functional group in the binder resin (e.g., acrylate esters). It is very important that the alkaline polymerization suspension liquid, while retaining the alkaline state, is substantially separated into the toner particles and the aqueous medium. If the polymerization suspension liquid is acidified before the separation, the carboxylic acid dissolved in the aqueous medium is returned into a water-insoluble carboxylic acid, which is again precipitated on the toner particles. Thus, the removal of the carboxylic acid from the toner particles remains to be an incomplete one. The separation of the toner particles and the alkaline aqueous medium may be effected by any known methods, such as filtration and centrifugation.

The magnetic powder contained in toner particles for providing the magnetic toner of the present invention may comprise: a magnetic iron oxide, such as magnetite, maghemite or ferrite; a metal, such as iron, cobalt or nickel, or an allyl of these metal with other metals, such as aluminum, cobalt, copper, lead, magnesium, tin, zinc, antimony, beryllium, bismuth, cadmium, calcium, manganese, selenium, titanium, tungsten and vanadium; or a mixture of these. Anyway, the magnetic powder used in the present invention comprises at least magnetic iron oxide.

More specifically, the magnetic powder used in the present invention may principally comprise a magnetic iron oxide, such as triiron tetroxide or gamma-iron oxide, optionally containing a minor amount of phosphorus, cobalt, nickel, copper, magnesium, manganese, aluminum or silicon. Such magnetic iron oxides may be used singly or in combination of two or more pieces. The magnetic powder may preferably be one showing a Mohs hardness of 5–7.

The magnetic powder may comprise particles having any shapes, such as spherical, and polyhedrals inclusive of hexahedral, octahedral, tetradecahedral, etc. Such shapes of magnetic powder particles may be confirmed by observation through a SEM (scanning electron microscope). Based on such SEM observation, a shape common to the largest number-basis proportion of particles may represent the particle shape of the magnetic powder.

The magnetic powder used in the present invention may preferably exhibit magnetic properties inclusive of a saturation magnetization of 10–200 $Am^2/kg$ at a magnetic field of 795.8 kA/m, a residual magnetization of 1–100 $Am^2/kg$ and a coercive force of 1–30 kA/m.

The magnetic properties of magnetic powder referred to herein are based on values measured by using an oscillation-type magnetometer ("VSMP-1-10", made by Toei Kogyo K.K.) at 25° C. and by applying an external magnetic field of 796 kA/m.

The magnetic powder used in the toner of the present invention may comprise magnetic iron oxide which has been modified in view of magnetic properties, coloring power, chargeability and other properties and performances. For example, the magnetic powder may suitably comprise magnetite caused to contain phosphorus so as to provide improved magnetic properties, particularly a lower residual magnetization as disclosed in JP-A 8-169717 and JP-A 10-101339. Such magnetite containing phosphorus may be obtained by formation of magnetite particles from an aqueous system containing a water-soluble phosphorus compound (e.g., phosphates, such as sodium hexametaphosphate and ammonium primary phosphate orthophosphates and phosphites). The phosphorus content may preferably be 0.05–5. wt. % of the iron.

If the phosphorus content is below the above range, it is difficult to attain the phosphorus addition effect. On the other hand, if the phosphorus content exceeds the above range, the product magnetic powder may exhibit poor filterability.

It is important to use phosphorus-containing magnetic powder which has been caused to contain the phosphorus before its crystal formation. By using such a small-particle size magnetic powder having a low residual magnetization, the magnetic powder may be provided with good dispersibility and allowed to provide the magnetic toner of a small particle size of the present invention showing excellent transferability and fog-prevention and also excellent developing performance.

It is also possible to use a silicon-containing magnetic iron oxide as disclosed in JP-B 3-9045 and JP-A 61-34070. The inclusion of 5.0 wt. % or below based on iron of silicon is also effective for lowering the residual magnetization of the magnetic powder and also allows uniform surface treatment of the resultant magnetic powder. This is presumably because when a silane coupling agent is used as a surface-treating agent is used, a stable siloxane bond is formed between the silicon in the magnetic powder and the silicon in the coupling agent, thus allowing complete coverage with the treating agent of the entire surface of the magnetic powder particles.

The magnetic powder comprising silicon-containing magnetite may be obtained by formation of magnetite particles from an aqueous system containing a water-soluble silicon compound (e.g., water glass, sodium silicate, or potassium silicate) in an amount appropriate to provide a silicon content of at most 5.0 wt. % based on iron. The silicon content in excess of 50 wt. % in the magnetic powder is not desirable since the filterability of the magnetic powder becomes inferior thereby. The silicon may be added in advance of crystallization of magnetic particles. It is also possible to use a magnetic iron oxide containing both phosphorus and silicon as desired.

The magnetic powder used in the magnetic toner of the present invention may preferably have a volume-average particle size of 0.01–1.0 $\mu$m, further preferably 0.05–0.5 $\mu$m. Below 0.01 $\mu$m, the lowering in blackness becomes noticeable, so that its coloring power becomes insufficient as a colorant for providing a black toner, and the agglomeratability of the magnetic powder is increased to result in a lower dispersibility. If the volume-average particle size exceeds 1.0 $\mu$m, the coloring power is liable to be insufficient similarly as an ordinary colorant. In addition, in the case of being used as a colorant for a small-particle size toner, it becomes statistically difficult to distribute identical number of magnetic powder particles to individual toner particles, and the dispersibility is liable to be lowered.

The volume-average particle size of a magnetic powder may be measured by observation through a transmission electron microscope (SEM) of, e.g., 100 particles of a sample magnetic powder in the visual field. More specifically, a sample magnetic powder is sufficiently dispersed in room temperature-curable epoxy resin, followed by curing at 40° C. for 2 hours. Then, the cured resin product is sliced by a microtome equipped with a diamond cutter into flake samples, which are subjected to photographing through a SEM for measurement of individual particle sizes to calculate a volume-average diameter.

It is preferred that the magnetic powder used in the magnetic toner of the present invention has been surface-treated for hydrophobization. It is further preferred that the magnetic powder particles are surface-treated with a coupling agent while being dispersed in an aqueous medium.

Many proposals have been made regarding surface modification of magnetic powder used in polymerization toner production. For example JP-A 59-200254, JP-A 59-200256, JP-A 59-200257 and JP-A 59-224102 have proposed the treatment of magnetic powder with various silane coupling agents. JP-A 63-250660 has disclosed the treatment of silicon-containing magnetic particles with a silane coupling agent.

These treatments are effective to some extent for suppressing the exposure of magnetic powder at the toner particle surfaces, but are accompanied with difficulty in uniform hydrophobization of the magnetic powder surface. As a result, it has been impossible to completely obviate the coalescence of the magnetic powder particles and the occurrence of untreated magnetic powder particles, thus being insufficient to completely suppress the exposure of the magnetic powder. As an example of using hydrophobized magnetic iron oxide, JP-B 60-3181 has proposed a toner containing magnetic iron oxide treated with alkyltrialkoxysilanes. The thus-treated magnetic iron oxide is actually effective for providing a toner exhibiting improved electrophotographic performances. The surface activity of the magnetic iron oxide is inherently low and has caused coalescence of particles or ununiform hydrophobization during the treatment. As a result, the magnetic iron oxide has left a room for further improvement for application to an image forming method as contemplated in the present invention including a contact charging step, a contact transfer step or a developing-cleaning step (a cleanerless system).

Further, if a larger amount of hydrophobization agent is used or a hydrophobization agent of a higher viscosity is used, a higher hydrophobicity can be actually obtained, but the dispersibility of the treated magnetic powder is rather lowered because of increased coalescence of magnetic powder particles. A toner prepared by using such a treated magnetic powder is liable to have an ununiform triboelectric chargeability and is accordingly liable to fail in providing anti-fog property or transferability.

In this way, conventional surface-treated magnetic powders used in polymerization toners have not necessarily achieved the hydrophobicity and dispersibility in combination, so that it is difficult to stably obtain high-definition images by using the resultant polymerization toner in an image forming method including a contact charging step as contemplated in the present invention.

As mentioned above, as for magnetic powder used in the magnetic toner of the present invention, it is extremely preferred that the magnetic powder particles are surface-treated for hydrophobization by dispersing magnetic powder particles in an aqueous medium into primary particles thereof, and while maintaining the primary particle dispersion state, hydrolyzing a coupling agent in the aqueous medium to surface-coat the magnetic powder particles. According to this hydrophobization method in an aqueous medium, the magnetic powder particles are less liable to coalesce with each other than in a dry surface-treatment in a gaseous system, and the magnetic powder particles can be surface-treated while maintaining the primary particle dispersion state due to electrical repulsion between hydrophobized magnetic powder particles.

The method of surface-treatment of magnetic powder with a coupling agent while hydrolyzing the coupling agent in an aqueous medium does not require gas-generating coupling agents, such as chlorosilanes or silazanes, and allows the use of a high-viscosity coupling agent which has been difficult to use because of frequent coalescence of magnetic powder particles in a conventional gaseous phase treatment, thus exhibiting a remarkable hydrophobization effect.

As a coupling agent usable for surface-treating the magnetic powder used in the present invention, a silane coupling agent or a titanate coupling agent may be used. A silicone coupling agent is preferred, and examples thereof may be represented by the following formula (1):

$$R_mSiY_n \quad (1),$$

wherein R denotes an alkoxy group, Y denotes a hydrocarbon group, such as alkyl, vinyl, glycidoxy or methacryl, and m and n are respectively integers of 1–3 satisfying m+n–4.

Examples of the silane coupling agents represented by the formula (1) may include: vinyltrimethoxysilane, vinyltriethoxysilane, gamma-methacryloxypropyltrimethoxysilane, vinyltriacetoxysilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-hexadecyltrimethoxysilane, and n-octadecyltrimethoxysilane.

It is particularly preferred to use an alkyltrialkoxysilane coupling agent represented by the following formula (2) to treat the magnetic powder for hydrophobization in an aqueous medium:

$$C_pH_{2p+1}—Si—(OC_qH_{2q+1})_3 \quad (2),$$

wherein p is an integer of 2–20 and q is an integer of 1–3.

In the above formula (2), if p is smaller than 2, the hydrophobization treatment may become easier, but it is difficult to impart a sufficient hydrophobicity, thus making it difficult to suppress the exposure of the magnetic powder to the toner particle surfaces. On the other hand, if p is larger than 20, the hydrophobization effect is sufficient, but the coalescence of the magnetic powder particles becomes frequent, so that it becomes difficult to sufficiently disperse the treated magnetic powder particles in the toner, thus being liable to result in a toner exhibiting lower fog-prevention effect and transferability.

If q is larger than 3, the reactivity of the silane coupling agent is lowered, so that it becomes difficult to effect sufficient hydrophobization.

In the above formula (2), it is particularly preferred that p is an integer of 3–15, and q is an integer of 1 or 2.

The coupling agent may preferably be used in 0.05–20 wt. parts, more preferably 0.1–10 wt. parts, per 100 wt. parts of the magnetic powder.

Herein, the term "aqueous medium" means a medium principally comprising water. More specifically, the aqueous medium includes water alone, and water containing a small amount of surfactant, a pH adjusting agent or/and an organic solvent.

As the surfactant, it is preferred to use a nonionic surfactant, such as polyvinyl alcohol. The surfactant may preferably be added in 0.1–5 wt. parts per 100 wt. parts of water. The pH adjusting agent may include an inorganic acid, such as hydrochloric acid. The organic solvent may include methanol which may preferably be added in a proportion of at most 500 wt. % of water.

For the surface-treatment of magnetic powder with a coupling agent in an aqueous medium, appropriate amounts of magnetic powder and coupling agent may be stirred in an aqueous medium. It is preferred to effect the stirring by means of a mixer having stirring blades, e.g., a high-shearing force mixer (such as an attritor or a TK homomixer) so as to disperse the magnetic powder particles into primary particles in the aqueous medium under sufficient stirring.

The thus-surface treated magnetic powder is free from particle agglomerates and individual particles are uniformly surface-hydrophobized. Accordingly, the magnetic powder is uniformly dispersed in polymerization toner particles to provide almost spherical polymerization toner particles free from surface-exposure of the magnetic powder.

The magnetic powder may preferably be used in 10–200 wt. parts, more preferably 20–180 wt. parts, per 100 wt. parts of the binder resin. Below 10 wt. parts, the toner coloring power is insufficient and it is difficult to suppress the fog. Above 100 wt. parts, the uniform dispersion of the magnetic powder in individual toner particles becomes difficult, and the resultant magnetic toner is too strongly held by the toner-carrying member to exhibit a lower developing performance and also exhibits a lower fixability in some cases.

The magnetic powder used in the magnetic toner of the present invention may for example comprise magnetite, which may be obtained by hydrolysis of a mixture solution containing a ferrous salt and a ferrite salt in a mol ratio of 1:2, or oxidation of a ferrous salt aqueous solution at an appropriate pH under heating. In the latter case, for example, the liquid pH may be adjusted at a final stage of the oxidation, and under sufficient stirring of the liquid so as to disperse the magnetic iron oxide particles in primary particles, a coupling agent may be added thereto, followed by sufficient mixing and stirring, filtration, drying and light disintegration, to obtain hydrophobized magnetic iron oxide particles. It is also possible to recover the iron oxide particles after the oxidation, washing and filtration but without drying, and re-disperse the recovered iron oxide particles in another aqueous medium, followed by pH adjustment of the re-dispersion liquid and addition of a silane coupling agent to effect the coupling treatment. Anyway, it is important to surface-treat the iron oxide particles without drying after the oxidation.

As the ferrous salt, it is possible to use ferrous sulfate by-produced in the sulfuric acid process titanium production, ferrous sulfate by-produced in surface washing of steel sheets, or also ferrous chloride.

In production of magnetic iron oxide from an aqueous solution, a solution containing iron at a concentration of 0.5–2 ml/liter is generally used in order to avoid an excessive viscosity increase by the reaction and in view of the solubility of ferrous sulfate. A lower concentration of ferrous sulfate tends to provide finer product particles. Further, for the reaction, a larger amount of air and a lower reaction temperature tend to provide finer product particles.

By using a magnetic toner obtained from such hydrophobized magnetic powder particles having a low residual magnetization, it becomes possible to stably provide high-quality images while suppressing the abrasion of and the toner melt-sticking onto the photosensitive member.

The magnetic toner of the present invention comprises at least toner particles produced from the above-mentioned binder resin and magnetic powder, and also includes inorganic fine powder.

The inorganic fine powder is added for the purpose of improving the flowability and uniform chargeability of the toner. The inorganic fine powder may preferably have a number-average primary particle size of 4–80 nm.

In case where the inorganic fine powder has a number-average primary particle size larger than 80 nm or the inorganic fine powder is not added, the transfer-residual toner particles, when attached to the charging member, are liable to stick to the charging member, so that it becomes difficult to stably attain good uniform chargeability of the image-bearing member. Further, it becomes difficult to attain good toner flowability, and the toner particles are liable to be ununiformly charged to result in problems, such as increased fog, image density lowering and toner scattering.

In case where the inorganic fine powder has a number-average primary particle size below 4 nm, the inorganic fine powder is caused to have strong agglomeratability, so that the inorganic fine powder is liable to have a broad particle size distribution including agglomerates of which the disintegration is difficult, rather than the primary particles, thus being liable to result in image defects such as image dropout due development with the agglomerates of the inorganic fine powder and defects attributable to damages on the image-bearing member, developer-carrying member or contact charging member, by the agglomerates. In order to provide a more uniform charge distribution of toner particles, it is further preferred that the number-average primary particle size of the inorganic fine powder is in the range of 6–35 nm.

The number-average primary particle size of inorganic fine powder described herein is based on the values measured in the following manner. A developer sample is photographed in an enlarged form through a scanning electron microscope (SEM) equipped with an elementary analyzer such as an X-ray microanalyzer (XMA) to provide an ordinary SEM picture and also an XMA picture mapped with elements contained in the inorganic fine powder. Then, by comparing these pictures, the sizes of 100 or more inorganic fine powder primary particles attached onto or isolated from the toner particles are measured to provide a number-average particle size.

The inorganic fine powder used in the present invention may preferably comprise fine powder of at least one species selected from the group consisting of silica, titania and alumina.

For example, silica fine powder may be dry process silica (sometimes called fumed silica) formed by vapor phase oxidation of a silicon halide or wet process silica formed from water glass. However, dry process silica is preferred because of fewer silanol groups at the surface and inside thereof and also fewer production residues such as $Na_2O$ and $SO_3^{2-}$. The dry process silica can be in the form of complex metal oxide powder with other metal oxides for example by using another metal halide, such as aluminum chloride or titanium chloride together with silicon halide in the production process.

It is preferred that the inorganic fine powder having a number-average primary particle size of 4–80 nm is added in 0.1–3.0 wt. parts per 100 wt. parts of the toner particles. Below 0.1 wt. part, the effect is insufficient, and above 3.0 wt. parts, the fixability is liable to be lowered.

The inorganic fine powder used in the present invention may preferably have been hydrophobized. By hydrophobizing the inorganic fine powder, the lowering in chargeability of the inorganic fine powder in a high humidity environment is prevented, and the environmental stability of the triboelectric chargeability of the toner particles is improved.

If the inorganic fine powder added to the magnetic toner absorbs moisture, the chargeability of the toner particles is remarkably lowered, thus being liable to cause toner scattering.

As the hydrophobization agents for the inorganic fine powder, it is possible to use silicone varnish, various modified silicone varnish, silicone oil, various modified silicone oil, silane compounds, silane coupling agents, other organic silicon compounds and organic titanate compounds singly or in combination.

Among these, it particularly preferred that the inorganic fine powder has been treated with at least silicone oil, more preferably, has been treated with silicone oil simultaneously with or after hydrophobization treatment with a silane compound.

In such a preferred form of the treatment of the inorganic fine powder, silylation is performed in a first step to remove a hydrophilic site, such as a silanol group of silica, by a chemical bonding, and then a hydrophobic film is formed of silicone oil in a second step. As a result, it becomes possible to provide a further enhanced hydrophobicity.

The silicone oil treatment may be performed e.g., by directly blending the inorganic fine powder (optionally preliminarily treated with e.g., silane coupling agent) with silicone oil by means of a blender such as a Henschel mixer; by spraying silicone oil onto the inorganic fine powder; or by dissolving or dispersing silicone oil in an appropriate solvent and adding thereto the inorganic fine powder for blending, followed by removal of the solvent. In view of less by-production of the agglomerates, the spraying is particularly preferred.

The silicone oil may preferably have a viscosity at 25° C. of 10–200,000 $mm^2/s$, more preferably 3,000–80,000 $mm^2/s$. If the viscosity is below 10 $mm^2/s$, the silicone oil is liable to lack in stable treatability of the inorganic fine powder, so that the silicone oil coating the inorganic fine powder for the treatment is liable to be separated, transferred or deteriorated due to heat or mechanical stress, thus resulting in inferior image quality. On the other hand, if the viscosity is larger than 200 $mm^2/s$, the treatment of the inorganic fine powder with the silicone oil is liable to become difficult.

Particularly preferred species of the silicone oil used may include: dimethylsilicone oil, methylphenylsilicone oil, α-methylstyrene-modified silicone oil, chlorophenylsilicone oil, and fluorine-containing silicone oil.

The silicone oil may be used in 1–23 wt. parts, preferably 5–20 wt. parts, per 100 wt. parts of the inorganic fine powder before the treatment. Below 1 wt. part, good hydrophobicity cannot be attained, and above 23 wt. parts, difficulties, such as the occurrence of fog, are liable to be caused.

As examples of the silane compound, an organic silicon compound, such as hexamethyl-disilazane, may be used.

The inorganic fine powder having a number-average primary particle size of 4–80 nm may preferably have a specific surface area of 20–250 $m^2/g$, more preferably 40–200 $m^2/g$; as measured by the nitrogen adsorption BET method, e.g., the BET multi-point method using a specific surface area meter ("Autosorb 1", made by Yuasa Ionix K.K.).

The magnetic toner according to the present invention may preferably further include electroconductive fine powder as an external additive in addition to the inorganic fine powder. The electroconductive fine powder may preferably have a volume-average particle size which is smaller than that of the toner particles.

Within an extent of satisfying the above condition, the electroconductive fine powder may preferably have a volume-average particle size of 0.5–10 μm. If the electroconductive fine powder has too small a particle size, the content thereof in the entire toner has to be reduced in order to prevent a lowering in developing performance. If the volume-average particle size is below 0.5 μm, it become difficult to have a sufficient amount of the electroconductive fine powder be present in a charging section formed at a contact position between the charging member and the image-bearing member and proximity thereto for overcoming the charging obstruction by the transfer-residual toner attached to or mixed with the contact charging member to improve the chargeability of the image-bearing member, thus being liable to cause charging failure.

On the other hand, if the electroconductive fine powder has a volume-average particle size larger than 10 μm, the electroconductive fine powder having left the charging member is liable to interrupt or diffuse imagewise exposure light for a writing an electrostatic latent image, thereby causing latent image defects. Further, if the electroconductive fine powder has an excessively large particle size, the number of particles thereof per unit weight is reduced, and further reduced by falling from the charging member, so that a larger amount of electroconductive fine powder has to be contained in the toner so as to continually supply the electroconductive fine powder to the charging section for maintaining intimate contact via the electro-conductive fine powder between the contact charging member and the image-bearing member. However, if the content of the electroconductive fine powder is increased, the chargeability of the entire toner is liable to be lowered, particularly in a high humidity environment, thus being liable to cause image density lowering and toner scattering due to a lower developing performance.

For a similar reason, it is preferred that the electroconductive fine powder has a volume-average particle size of 0.5–5 μm, more preferably 0.8–5 μm, further preferably 1.1–5 μm and has a particle size distribution such that particles of 0.5 μm or smaller occupy at most 70% by volume and particles of 5.0 μm or larger occupy at most 5 % by number.

The electroconductive fine powder may preferably be contained in 0.2–10 wt. parts in 100 wt. parts of the magnetic toner. As the toner particles of the toner of the present invention lacks in magnetic powder exposed to the surface thereof, if the electroconductive fine powder is less than 0.2 wt. part, the developing performance of the toner is liable to be lowered. Further, in case where the toner is used in an image forming method including a developing-cleaning step, it becomes difficult to retain a sufficient amount of electroconductive fine powder in a charging section for retaining a good chargeability of the image-bearing member while overcoming the charging obstruction due to the attachment or mixing of the insulating transfer-residual toner. If the electroconductive fine powder is in excess of 10 wt.

parts, the amount of electroconductive fine powder recovered in the developing-cleaning step is excessively increased, so that the chargeability and developing performance of the toner in the developing section are liable to be lowered, thus resulting in image density lowering and toner scattering.

The electroconductive fine powder may preferably have a resistivity of $1\times10^{-1}$–$1\times10^{9}$ ohm.cm. If the electroconductive fine powder has a resistivity exceeding $1\times10^{9}$ ohm.cm, the developing performance is liable to be lowered similarly as above, and when used in an image forming method including a developing-cleaning step, the effect of promoting the uniform chargeability of the image-bearing member becomes small, even if the electroconductive fine powder is present at the contact position between the charging member and the image-bearing member or in the charging region in the vicinity thereof so as to retain an intimate contact via the electroconductive fine powder between the contact charging member and the image-bearing member.

In order to sufficiently attain the effect of promoting the chargeability of the image-bearing member owing to the electroconductive fine powder, thereby stably accomplishing good uniform chargeability of the image-bearing member, it is preferred that the electroconductive fine powder has a resistivity lower than the resistivity at the surface or at contact part with the image-bearing member of the contact charging member. It is further preferred that the electroconductive fine powder has a resistivity of at most $1\times10^{6}$ ohm.cm, so as to better effect the uniform charging of the image-bearing member by overcoming the attachment to or mixing with the contact charging member of the insulating transfer-residual toner particles, and more stably attain the effect of promoting the recovery of the transfer-residual toner particles.

The resistivity of electroconductive fine powder may be measured by the tablet method and normalized. More specifically, ca. 0.5 g of a powdery sample is placed in a cylinder having a bottom area of 2.26 $cm^2$ and sandwiched between an upper and a lower electrode under a load of 15 kg. In this state, a voltage of 100 volts is applied between the electrodes to measure a resistance value, from which a resistivity value is calculated by normalization.

It is also preferred that the electro-conductive fine powder is transparent, white or only pale-colored, so that it is not noticeable as fog even when transferred onto the transfer material. This is also preferred so as to prevent the obstruction of exposure light in the latent image-step. It is preferred that the electroconductive fine powder shows a transmittance of at least 30%, with respect to imagewise exposure light used for latent image formation, as measured in the following manner.

A sample of electroconductive fine powder is attached onto an adhesive layer of a one-side adhesive plastic film to form a mono-particle densest layer. Light flux for measurement is incident vertically to the powder layer, and light transmitted through to the backside is condensed to measure the transmitted quantity. A ratio of the transmitted light to a transmitted light quantity through an adhesive plastic film alone is measured as a net transmittance. The light quantity measurement may be performed by using a transmission-type densitometer (e.g., "310T", available from X-Rite K.K.). The transmittance value may typically be measure with respect to light having a wavelength of 740 $\mu$m identical to exposure light wavelength used in a laser beam scanner and may be represented as $T_{740}$ (%).

It is also preferred that the electro-conductive fine powder is non-magnetic. The electroconductive fine powder used in the present invention may for example comprise: carbon fine powder, such as carbon black and graphite powder; and fine powders of metals, such as copper, gold, silver, aluminum and nickel; metal oxides, such as zinc oxide, titanium oxide, tin oxide, aluminum oxide, indium oxide, silicon oxide, magnesium oxide, barium oxide, molybdenum oxide, iron oxide, and tungsten oxide; and metal compounds, such as molybdenum sulfide, cadmium sulfide, and potassium titanate; an complex oxides of these. The electroconductive fine powders may be used after adjustment of particle size and particle size distribution, as desired. Among the above, it is preferred that the electroconductive fine powder comprises at least one species of oxide selected from the group consisting of zinc oxide, tin oxide and titanium oxide.

It is also possible to use an electro-conductive fine powder comprising a metal oxide doped with an element such as antimony or aluminum, or fine particles surface-coated with an electroconductive material. Examples of these are zinc oxide particles containing aluminum, titanium oxide fine particles surface coated with antimony tin oxide, stannic oxide fine particles containing antimony, and stannic oxide fine particles.

Commercially available examples of electro-conductive titanium oxide fine powder coated with antimony-tin oxide may include: "EC-300" (Titan Kogyo K.K.); "ET-300", "HJ-1" and "HI-2" (Ishihara Sangyo K.K.) and "W-P" (Mitsubishi Material K.K.).

Commercially available examples of antimony-doped electroconductive tin oxide fine powder may include: "T-1" (Mitsubishi Material K.K.) and "SN-100P" (Ishihara Sangyo K.K.).

Commercially available examples of stannic oxide fine powder may include: "SM-S" (Nippon Kagaku Sangyo K.K.).

The volume-average particle size and particle size distribution of the electroconductive fine powder described herein are based on values measured in the following manner. A laser diffraction-type particle size distribution measurement apparatus ("Model LS-230", available from Coulter Electronics Inc.) is equipped with a liquid module, and the measurement is performed in a particle size range of 0.04–2000 $\mu$m to obtain a volume-basis particle size distribution. For the measurement, a minor amount of surfactant is added to 10 cc of pure water and 10 mg of a sample electroconductive fine powder is added thereto, followed by 10 min. of dispersion by means of an ultrasonic disperser (ultrasonic homogenizer) to obtain a sample dispersion liquid, which is subjected to a single time of measurement for 90 sec.

The particle size and particle size distribution of the electroconductive fine powder used in the present invention may for example be adjusted by setting the production method and conditions so as to produce primary particles of the electroconductive fine powder having desired particle size and its distribution. In addition, it is also possible to agglomerate smaller primary particles or pulverize larger primary particles or effect classification. It is further possible to obtain such electroconductive fine powder by attaching or fixing electroconductive fine particles onto a portion or the whole of base particles having a desired particle size and its distribution, or by using particles of desired particle size and distribution containing an electroconductive component dispersed therein. It is also possible to provide electroconductive fine powder with a desired particle size and its distribution by combining these methods.

In the case where the electroconductive fine powder is composed of agglomerate particles, the particle size of the electroconductive fine powder is determined as the particle size of the agglomerate. The electroconductive fine powder in the form of agglomerated secondary particles can be used as well as that in the form of primary particles. Regardless of its agglomerated form, the electroconductive fine powder can exhibit its desired function of charging promotion by presence in the form of the agglomerate in the charging section at the contact position between the charging member and the image-bearing member or in a region in proximity thereto.

The magnetic toner according to the present invention may preferably exhibit a heat-absorption peak (Tabs.) in a temperature range of 40–110° C., more preferably 45–90° C., on a DSC curve on temperature increase measured by using a differential scanning calorimeter. As the residual styrene monomer content is decreased in the magnetic toner of the present invention to effectively suppress the toner agglomeration, good image formation is possible even in the case of having a heat-absorption peak temperature (Tabs) in a range of 40–65° C., this effect is particularly pronounced if the magnetic toner is caused to band a low residual magnetization of below 10 $Am^2/kg$ after being magnetized at a field of 79.6 kA/m.

A toner image transferred onto a transfer material is fixed on the transfer material by application of an energy, such as heat, pressure, etc. For this purpose, a hot roller fixing device is generally used.

As described hereinafter, a toner having a volume-average particle size of at most 10 $\mu$m can provide a very high resolution image, but such fine toner particles are liable to enter gaps between fibers of paper as a typical transfer material, so that heat-supply thereto from a hot fixing roller is liable to be insufficient, thus being liable to cause low-temperature offset phenomenon.

However, if the toner is designed to exhibit a heat-absorption peak in a temperature range of 40–110° C., a high resolution and an anti-offset characteristic can be satisfied in combination as well as prevention of abrasion of the photosensitive member. If the heat-absorption peak temperature is below 40° C., the storage stability and chargeability of the toner can be problematic, and above 110° C., it becomes difficult to prevent the abrasion of the photosensitive member.

The heat-absorption peak temperature of a toner or a wax may be measured by differential thermal analysis similarly as a heat-absorption peak of a wax as described hereinafter. More specifically, the glass transition temperature may be measured by using a differential scanning calorimeter (DSC) (e.g., "DSC-7", available from Perkin-Elmer Corp.) according to ASTM D3418-8. Temperature correction of the detector may be effected based on melting points of indium and zinc, and calorie correction may be affected based on heat of fusion of indium. A sample is placed on an aluminum pan and subjected to heat at an increasing rate of 10° C./min in parallel with a blank aluminum pan as a control. The apparatus may also be used for measurement of glass transition temperature (Tg) of a binder resin, etc.

Examples of waxes usable in the magnetic toner of the present invention may include: petroleum waxes and derivatives thereof, such as paraffin wax, microcrystalline wax and petrolactum; montan wax and derivatives thereof; hydrocarbon wax by Fischer-Tropsch process and derivative thereof; polyolefin waxes as represented by polyethylene wax and derivatives thereof; and natural waxes, such as carnauba wax and candelilla wax and derivatives thereof. The derivatives may include oxides, block copolymers with vinyl monomers, and graft-modified products. Further examples may include: higher aliphatic alcohols, fatty acids, such as stearic acid and palmitic acid, and compounds of these, acid amide wax, ester wax, ketones, hardened castor oil and derivatives thereof, negative waxes and animal waxes. Anyway, it is preferred to use a wax showing a heat-absorption peak in a temperature range of 40–110° C., further preferably 45–90° C. Further, in order to provide a magnetic toner showing Tabs in a range of 40–65° C., it is possible to use a wax exhibiting Tabs in a range of 40–65° C. The use of such a wax is effective for further improving the anti-offset property.

In the magnetic toner of the present invention, the wax may preferably be contained in 0.5–50 wt. parts, per 100 wt. parts of the binder resin. Below 0.5 wt. part, the low-temperature offset preventing effect is insufficient, and above 50 wt. parts, the storability for a long period of the toner becomes inferior, and the dispersibility of other toner ingredients is impaired to result in lower flowability of the toner and lower image qualities.

The magnetic toner of the present invention can further contain a charge control agent so as to stabilize the chargeability. Known charge control agents can be used. It is preferred to use a charge control agent providing a quick charging speed and stably providing a constant charge. In the case of polymerization toner production, it is particularly preferred to use a charge control agent showing low polymerization inhibition effect and substantially no solubility in aqueous dispersion medium. Specific examples thereof may include; negative charge control agents, inclusive of: metal compounds of aromatic carboxylic acids, such as salicylic acid, alkylsalicylic acids, dialkylsalicylic acids, naphthoic acid, and dicarboxylic acids; metal salts or metal complexes of azo-dyes and azo pigments; polymeric compounds having a sulfonic acid group or carboxylic acid group in side chains; boron compounds, urea compounds, silicon compounds, and calixarenes. Positive charge control agents may include: quaternary ammonium salts, polymeric compounds having such quaternary ammonium salts in side chains, quinacridone compounds, nigrosine compounds and imidazole compounds.

The charge control agent may be included in the toner by internal addition or external addition to the toner particles. The amount of the charge control agent can vary depending on toner production process factors, such as binder resin species, other additives and dispersion methods, but may preferably be 0.001–10 wt. parts, more preferably 0.01–5 wt. parts, per 100 wt. parts of the binder resin.

However, it is not essential for the magnetic toner of the present invention to contain a charge control agent, but the toner need not necessarily contain a charge control agent by positively utilizing the triboelectrification with a toner layer thickness-regulating member and a toner-carrying member.

The magnetic toner can contain another colorant in addition to the magnetic powder. Such another colorant may be: magnetic or nonmagnetic inorganic compounds, and known dyes and pigments. More specifically, examples thereof may include, particles of ferromagnetic metals, such as cobalt and nickel; alloys of these with chromium, manganese, copper, zinc, aluminum, and rare earth elements hematite, titanium black, nigrosine dyes/pigments, carbon black, phthalocyanine. These may be used after surface-treatment similarly as the magnetic powder as mentioned above.

It is also a preferred mode to add to the magnetic toner of the present invention inorganic or organic fine particles having a shape close to a sphere and a primary particle size exceeding 30 nm (preferably $S_{BET}$ (BET specific surface area)<5 $m^2/g$), more preferably a primary particle size exceeding 50 nm (preferably $S_{BET}$<30 $m^2/g$) so as to enhance the cleaning characteristic. Preferred examples thereof may include: spherical silica particles, spherical polymethylsilsesquioxane particles, and spherical resin particles.

Within an extent of not adversely affecting the toner of the present invention, it is also possible to include other additives, inclusive of lubricant powder, such as teflon powder, zinc stearate powder, and polyvinylidene fluoride powder; abrasives, such as cerium oxide powder, silicon carbide powder, and strontium titanate powder; flowability-imparting agents, or anti-caking agents such as titanium oxide powder, and aluminum oxide powder. It is also possible to add a small amount of reverse-polarity organic and/or inorganic fine particle as a developing performance improver. Such additives may also be added after surface hydrophobization.

<2> Toner Properties

The magnetic toner of the present invention has an average circularity of at least 0.970.

A toner composed of particles having an average circularity of at least 0.970 exhibits very excellent transferability. This is presumably because the toner particles contact the photosensitive member at a small contact area so that the forces of attachment of toner particles onto the photosensitive member, such as an image force and a van der Waals force, are lowered. Accordingly, if such a toner showing a high transferability is used, it is considered that the amount of transfer-residual toner is extremely reduced, so that the amount of toner present at the contact position between the charging member and the photosensitive member is extremely reduced to prevent toner melt-sticking and suppress image defects. Further, toner particle having an average circularity (am) of at least 0.970 are substantially free from surface edges, so that the friction at the contact position between the charging member and the photosensitive member is reduced to suppress the abrasion of the photosensitive member. These effects are further promoted in an image forming method including a contact transfer step liable to cause transfer dropout.

Based on the circularity distribution, the toner may preferably exhibit a mode circularity ($a_F$) of at least 0.99. A mode circularity of at least 0.99 means that a large proportion of toner particles have a shape close to that of a true sphere, thus exhibiting more pronounced effects of suppressing the abrasion of the photosensitive member and the image defects as mentioned above.

The average circularity and mode circularity are used as quantitative measures for evaluating particle shapes and based on values measured by using a flow-type particle image analyzer ("FPIA-1000", mfd. by Toa Iyou Denshi K.K.). A circularity (ai) of each individual particle (having a circle equivalent diameter ($D_{CE}$) of at least 3.0 $\mu$m) is determined according to an equation (I) below, and the circularity value (ai) are totaled and divided by the number of total particles (m) to determine an average circularity (am) as shown in an equation (II) below:

$$\text{Circularity } \underline{a}=L_0/L, \quad \text{(I)}$$

wherein L denotes a circumferential length of a particle projection image, and $L_0$ denotes a circumferential length of a circle having an area identical to that of the particle projection image.

$$\text{Average circularity } (am) = \sum_{i=1}^{m} ai/m \quad \text{(II)}$$

Further, the mode circularity ($a_F$) is determined by allotting the measured circularity values of individual toner particles to 61 classes in the circularity range of 0.40–1.00, i.e., from 0.400–0.410, 0.410–0.420, . . . , 0.990–1.000 (for each range, the upper limit is not included) and 1.000, and taking the circularity of a class giving a highest frequency as a mode circularity ($a_F$).

Incidentally, for actual calculation of an average circularity (am), the measured circularity values of the individual particles were divided into 61 classes in the circularity range of 0.40–1.00, and a central value of circularity of each class was multiplied with the frequency of particles of the class to provide a product, which was then summed up to provide an average circularity. It has been confirmed that the thus-calculated average circularity (am) is substantially identical to an average circularity value obtained (according to Equation (II) above) as an arithmetic mean of circularity values directly measured for individual particles without the above-mentioned classification adopted for the convenience of data processing, e.g., for shortening the calculation time.

More specifically, the above-mentioned FPIA measurement is performed in the following manner. Into 10 ml of water containing ca. 0.1 mg of surfactant, ca. 5 mg of magnetic toner sample is dispersed and subjected to 5 min. of dispersion by application of ultrasonic wave (20 kHz, 50 W), to form a sample dispersion liquid containing 5,000–20,000 particles/$\mu$l. The sample dispersion liquid is subjected to the FPIA analysis for measurement of the average circularity (am) and mode circularity with respect to particles having $D_{CE} \geqq 3.0$ $\mu$m.

The average circularity (am) used herein is a measure of roundness, a circularity of 1.00 means that the magnetic toner particles have a shape of a perfect sphere, and a lower circularity represents a complex particle shape of the magnetic toner.

As another factor, the magnetic toner particles retain carbon in an amount of A and iron in an amount of B at surfaces as measured by ESCA (X-ray photoelectron spectroscopy), satisfying:

$$B/A<0.001.$$

It is preferred that the toner particles of the magnetic toner according to the present invention have a high chargeability, and therefore the toner particles are free from surface-exposed magnetic powder functioning as charge-leakage sites. Further, if toner particles accompanied with surface-exposed magnetic powder are used in an image forming method including a contact charging step, the surface abrasion of the photosensitive member is promoted by the surface-exposed magnetic powder. However, if a magnetic toner satisfying B/A<0.001, i.e., substantially free from surface-exposed magnetic powder, is used, the photosensitive member surface is substantially free from abrasion even if the toner is pressed by the charging member against the photosensitive member, whereby the abrasion of the photosensitive member and toner melt-sticking can be remarkably reduced. This effect is also pronounced in an image forming method including a contact transfer step, thus allowing production of high-definition image for a long period. A B/A ratio of below 0.0005 is further preferred for further improved image quality and durability.

In this way, as the magnetic toner particles of the present invention are substantially free from surface-exposed magnetic powder, the toner charge leakage hardly occurs, so that even if the electroconductive fine powder is mixed therewith, the lowering in chargeability is less caused, and good images of high image density can be obtained.

The magnetic toner according to the present invention has been designed to suppress the amount of magnetic powder exposed to the toner particle surfaces, thereby having a high chargeability. Such a toner is liable to cause an excessive charge of toner particles when used continuously for a long period in an extremely low humidity environment, thus being liable to cause toner agglomeration.

In contrast thereto, in the present invention, the residual styrene monoment content in the toner is extremely reduced to suppress the toner agglomeration. Such residual styrene monomer has a function of bringing out the wax content presentset inside the toner particles to the toner particle surfaces together with it when it exudes out to the toner particle surfaces, thus being liable to promote the toner agglomeration. However, if the residual styrene monomer content is reduced to below 300 ppm, the toner agglomeration promotion effective is substantially completely presented.

Further, for the purpose of suppressing the toner agglomeration, it is preferred to use a magnetic powder having low residual magnetization ($\sigma r$). From this view point, it is preferred to use a magnetic powder showing a residual magnetization of below 10 $Am^2/kg$, more preferably below 7 $Am^2/kg$, further preferably below 5 $Am^2/kg$, when measured after magnetization at a magnetic field of 79.6 kA/m.

By using such a magnetic powder having a low residual magnetization and also having electro-conductive fine powder be present in contact with toner particles, it becomes possible to further effectively suppress the toner agglomeration, so that it is possible to stably provide good images for a long period of continuous printing in a low humidity environment.

Further, because of a very high circularity, the magnetic toner can form thin ears in the developing section and individual toner particles provided with a uniform charge to provide good images with very little fog.

The iron/carbon content ratio (B/A) at the toner particle surfaces described herein are based on values measured through surface composition analysis by ESCA (X-ray photoelectron spectroscopy) according to the following conditions.

Apparatus: X-ray photoelectrospectroscope Model "1606S" (made by PHI Co.)

Measurement conditions: X-ray source MgK$\alpha$ (400 W) Spectrum region in a diameter of 800 $\mu$m.

From the measured peak intensities of respective elements, the surface atomic concentrations are calculated based on relative sensitivity factors provided from PHI Co. For the measurement, a sample toner is washed with a solvent, such as isopropyl alcohol, under application of ultrasonic wave, to remove the inorganic fine powder attached to the magnetic toner particle surfaces, and then the magnetic toner particles are recorded and dried for ESCA measurement.

Incidentally, a special magnetic toner designed to confine magnetic powder at a specifically inner part of toner particles has been disclosed in JP-A 7-209904. However, JP-A 7-209904 fails to disclose a circularity, a residual styrene monomer content and suitable magnetic properties of the magnetic powder used, so that it is unclear as to what effects are attained when the toner is used in a manner as intended in the present invention.

In summary, JP-A 7-209904 disclose a toner having a magnetic powder-free layer of a certain thickness coating magnetic core particles containing magnetic powder. Accordingly, in the case of a small-particle size toner having a volume-average particle size of at most 10 $\mu$m, for example, it is considered difficult to include a sufficient amount of magnetic powder. In this typical toner, larger toner particles and smaller toner particles have different proportions of magnetic powder-free region and different contents of magnetic powder. Accordingly, the developing performance and transferability can be different depending on particle sizes. Accordingly such a magnetic toner is liable to exhibit a selective development characteristic depending on particle sizes. More specifically, if such a magnetic toner is used in a long period of continuous printing, toner particles containing a larger amount of magnetic powder and thus less used for development are liable to remain, thus causing lowering in image density and image quality and further inferior fixability.

As is understood from the above description, a preferred dispersion state of magnetic powder in toner particles in such that magnetic powder is dispersed and evenly present in the entirety of toner particles without causing agglomeration. This is another essential feature of the magnetic toner of the present invention. More specifically, based on an observation of a toner particle section through a transmission electron microscope (TEM), at least 50% by number of toner particles are required to satisfy a relationship of $D/C \leqq 0.02$, wherein C represents a volume-average particle size of the toner, and D represents a minimum distance between a toner particle surface and individual magnetic powder particles on a toner particle sectional picture taken through a TEM.

It is further preferred that at least 65% by number, more preferably at least 75% by number, of toner particles satisfy the relationship of $D/C \leqq 0.02$.

In case where less than 50% by number of toner particles satisfy the relationship of $D/C \leqq 0.02$, more than a half of toner particles contain no magnetic powder at all within a shell region outside a boundary defined by $D/C=0.02$. If such a toner particle is assumed to have a spherical shape, the magnetic powder-free shell region occupies at least ca 7.8% of the whole particle volume. Moreover, in such a particle, the magnetic powder is not actually present aligning on the boundary of $D/C=0.02$ so that (magnetic powder is not substantially present) in a superficial portion of ca. 10%. Such a magnetic toner having a magnetic powder-free shell region is liable to suffer from various difficulties as mentioned above.

For measurement of D/C ratio by observation through a TEM, sample toner particles are sufficiently dispersed in a room temperature-curable epoxy resin, and the epoxy resin is cured for 2 days in an environment of 40° C. to form a cured product, which is then sliced, as it is or after freezing, into thin flake samples by a microtome equipped with a diamond cutter.

The D/C ratio measurement is more specifically performed as follows.

From sectional picture samples photographed through a TEM, particles having a particle size falling within a range of $D1 \pm 10\%$ (wherein D1 is a number-average particle size of toner particles measured by using a Coulter counter as described hereinafter) are selected for determination of D/C ratios. Thus, for each particle thus selected, a minimum distance between the particle surface and magnetic powder particles contained therein (D) is measured to calculate a D/C ratio (relative to the volume-average particle size represented by C) and calculate the percentage by number of toner particles satisfying D/C≦0.02 rom the following equation (III):

Percentage (%) of toner particles satisfying $D/C \leqq 0.02$={[number of toner particles satisfying $D/C \leqq 0.02$ among the selected toner particles on pictures]/[the number of selected toner particles (i.e., particles having a circle equivalent diameter) falling in a range of $D1 \pm 10\%$ ($D1$: number-average particle size) on the pictures]}×100 (III)

The percentage values (of D/C≦0.02) described herein are based on pictures at a magnification of 10,000 photographed through a transmission electron microscope ("H-600", made by Hitachi K.K.) at an acceleration voltage of 100 kV.

In the present invention, in order to provide at least 50% by number of magnetic toner particles satisfying D/C≦0.02, it is effective to reduce the proportion of magnetic powder particles of 0.03–0.1 μm and 0.3μ or larger, select the surface-treating agent for the magnetic powder and control the uniformity of the surface treatment.

Further, JP-A 7-229904 has proposed a special structure of toner per se but does not disclose specifically how to use the toner. In contrast thereto, we have discovered it effective to use the magnetic toner of the present invention for image formation to achieve a remarkable improvement in durability of the photosensitive member.

In the image forming method of the present invention, it is preferred to use a magnetic toner having a volume-average particle size of 3–10 μm, more preferably 4–8 μm, for faithful development of more minute latent image dots to provide a higher image quality. A toner having a volume-average particle size of below 3 μm shows a lower transferability and is thus liable to result in an increased amount of transfer-residual toner, so that it becomes difficult to suppress the abrasion of and the toner melt-sticking onto the photosensitive member in the contact charging step. Further, as the surface of the entire toner is increased, the toner is caused to have a lower flowability and powder mixability, and the electroconductive fine powder is liable to move together with the toner particles in the transfer step, so that the supply of the electroconductive fine powder to the charging section is liable to be insufficient. As a result, the charging obstruction due to the transfer-residual toner is relatively enhanced, thus resulting in increased fog and image irregularities in addition to the abrasion and toner sticking.

If a toner has a volume-average particle size in excess of 10 μm, the resultant character or line images are liable to be accompanied with scattering, so that it is difficult to obtain a high resolution. The charge of toner particles is liable to be remarkably lowered due to relatively increased electroconductive fine powder. Further, as the proportion of electroconductive fine powder recovered in the developing-cleaning step is increased, even a slight localization of the electroconductive fine powder in the developing step can cause a remarkable lowering in image quality, such as a lower image density. For a higher resolution apparatus, a toner having a volume-average particle size larger than 8 μm can result in an inferior dot reproducibility. For providing a stable chargeability and developing performance, it is further preferred that the toner has a volume-average particle size of 4–8 μm.

The magnetic toner of the present invention may preferably have a variation coefficient of number-basis distribution Kn as define by the following formula (IV) of at most 35%:

$$Kn=(S/D1)\times 100 \quad \text{(IV)},$$

wherein S represents a standard deviation of number-basis distribution, and D1 represents a number-average particle size, respectively of toner particles.

If the variation coefficient Kn exceeds 35%, the toner is liable to cause melt-sticking onto the photosensitive member surface and other layer thickness-regulating member to result in corresponding image defects.

The number-basis and volume-basis particle size distributions and average particle sizes may be measured by using, e.g., Coulter counter Model TA-II or Coulter Multicizer (respectively available from Coulter Electronics, Inc.). Herein, these values are determined based on values measured by using Coulter Multicizer connected to an interface (made by Nikkaki K.K.) and a personal computer ("PC9801", made by NEC K.K.) for providing a number-basis distribution and a volume-basis distribution in the following manner. A 1%-aqueous solution is prepared as an electrolytic solution by sing a reagent-grade sodium chloride (it is also possible to use ISOTON R-II (available from Coulter Scientific Japan K.K.)). For the measurement, 0.1 to 5 ml of a surfactant, preferably a solution of an alkylbenzenesulfonic acid salt, is added a a dispersant into 100 to 150 ml of the electrolytic solution, and 2–20 mg of a sample toner is added thereto. The resultant dispersion of the sample in the electrolytic solution is subjected to a dispersion treatment for ca. 1–3 minutes by means of an ultrasonic disperser, and then subjected to measurement of particle size distribution in the range of 2.00–40.30 μm divided into 13 channels by using the above-mentioned Coulter counter with a 100 μm-aperture to obtain a volume-basis distribution and a number-basis distribution. From the volume-basis distribution, a weight-average particle size (D4) is calculated by using a central value as a representative value channel. From the number-basis distribution, a number-average particle size (D1) and a number-basis variation coefficient (S1) is calculated.

The particle size range of 2.00–40.30 μm is divided into 13 channels of 2.00–2.52 μm; 2.52–3.17 μm; 3.17–4.00 μm; 4.00–5.04 μm; 5.04–6.35 μm; 6.35–8.00 μm; 8.00–10.08 μm; 10.08–12.70 μm; 12.70–16.00 μm; 16.00–20.20 μm; 20.20–25.40 μm; 25.40–32.00 μm and 32.00–40.30 μm (each channel not including the upper limit).

The magnetic toner of the present invention has a magnetization of 10–50 $Am^2/kg$ (emu/g) as measured at a magnetic field of 79.6 kA/m (1000 oersted). The magnetic toner is held within a developing device without causing toner leakage by disposing a magnetic force generating means in the developing device. The conveyance and stirring of the magnetic toner is also effected under a magnetic force. By disposing a magnetic force generating means that the magnetic force acting on the toner-carrying member, the recover of transfer residual toner is further promoted and toner scattering is prevented by forming ears of magnetic toner on the toner-carrying member. The magnetic toner may be provided with the above-mentioned level of magnetization by adjusting the amount of magnetic powder added to the toner. The magnetization values described herein are based on values measured by using an oscillation-type magnetometer ("VSMP-1-10", made by Toei Kogyo K.K.) under an external field of 79.6 kA/m at room temperature (25° C.).

If the toner has a magnetization of below 10 $Am^2/kg$ at a magnetic field of 79.6 kA/m, it becomes difficult to convey the toner on the toner-carrying member, and toner ear formation on the toner-carrying member becomes unstable, thus failing to provide uniform charge to the toner. As a result, image defects, such as fog, image density irregularity and recovery failure of transfer-residual toner are liable to be caused. If the magnetization exceeds 50 $Am^2/kg$, the toner particles are liable to have an increased magnetic agglomeratability, to result in remarkably lower flowability and transferability. As a result, the transfer-residual toner is increased, and the supply of the electroconductive fine powder to the charging section is liable to be insufficient because the electroconductive fine powder is moved together with toner particles in the transfer step. Thus, the chargeability of the photosensitive member is also lowered to result in increased fog an image soiling.

It is preferred that the magnetic toner of the present invention also shows a residual magnetization of below 10 $Am^2/kg$ (emu/g) at a magnetic field of 79.6 kA/m. Herein, a residual magnetization at a magnetic field of 79.6 kA/m means a residual magnetization of a magnetic toner measured at a magnetic field of 0 kA/m after magnetizing the magnetic toner at a magnetic field of 79.6 kA/m. The residual magnetization values described herein are based on values also measured by using the oscillating-type magnetometer (e.g., "VSMP-1-10", made by Toei Kogyo K.K.).

If the magnetic toner has a residual magnetization exceeding 10 $Am^2/kg$, the toner ears on the toner-carrying member are liable to be too long, so the ears are longer than thin line latent image widths to protrude out of the latent image or be scattered, thereby providing inferior image qualities. Further, the toner coating layer thickness on the toner-carrying member is liable to be excessively large, so that it becomes difficult to uniformly charge the individual toner particles, thus causing lower image density and increased fog. Further, in the case of printing on a large number of sheets, toner particle having a large residual magnetization are liable to cause magnetic agglomeration, so that the toner receives an excessive pressure between the toner-carrying member and the toner layer thickness-regulating member, whereby the inorganic fine powder on the toner surface is liable to be embedded in the toner particles or soil the toner-carrying member and the toner layer thickness-regulating member. As a result, the uniform layer formation or the uniform charging can be obstructed. The residual magnetization of the magnetic toner may preferably be below 7 $Am^2/kg$, more preferably below 5 $Am^2kg$.

Further, the toner deterioration and soiling of the related members are particularly pronounced when the residual styrene monomer content in the magnetic toner exceeds 300 ppm and some problems can be caused even when the residual magnetization is below 10 $Am^2/kg$. Particularly, in the case of printing in a high-temperature environment, as the thermal and mechanical properties of the toner surface and lowered due to the residual styrene monomer, the above-mentioned embedding and soiling of the members with the inorganic fine powder become pronounced. Further, in a high temperature environment, a toner containing a substantial amount of residual styrene monomer is liable to exhibit a slower charging speed, thus failing to have a sufficient charge, so that the toner jumping from the toner-carrying member to the image-bearing member can be obstructed even if the residual magnetization is low, thus making the above-mentioned difficulties more pronounced. Accordingly, it is essential for the magnetic toner of the present invention to have a residual styrene monomer content of below 300 ppm as well as a residual magnetization of below 10 $Am^2/kg$.

The above-mentioned range of low residual magnetization of the toner may be achieved by adjusting the content of the magnetic powder, by using a magnetic powder having a low residual magnetization (e.g., spherical magnetite), or by using a magnetic powder having a low residual magnetization by containing phosphorus or/and silicon. Incidentally, the phosphorus (element) content and silicon (element) content relative to the iron (element) content in a toner may be measured according to the ICP (inductively coupled plasma) spectroscopy in the following manner.

In case of a toner containing an external additive, such as silica, toner particles are washed with an NaOH aqueous solution and the washed toner particles are recovered by filtration. The recovered toner particles are washed with water and then treated with hydrochloric acid, followed by filtration to recover a filtrate (filtrate A). Thereafter, the filtration residue is treated with a mixture aqueous solution of hydrochloric acid and hydrofluoric acid, followed by filtration to recover a filtrate (filtrate B). The filtrates A and B are mixed, and the iron, phosphorus and silicon contents in the mixture liquid are measured by the ICP spectroscopy to calculate the phosphorus content and silicon content relative to the iron content.

<3> Process for Production of a Magnetic Toner According to the Present Invention The process for producing a magnetic toner according to the present invention is a process for producing the above-mentioned magnetic toner through suspension polymerization and is characterized by effecting polymerization in the presence of a peroxide polymerization initiator.

The magnetic toner according to the present invention can also be produced through the pulverization process, but toner particles produced by the pulverization are generally caused to have indefinite shapes. Accordingly, in order to obtain a circularity of at least 0.970 as an essential requirement of the magnetic toner of the present invention, the toner particle have to be subjected to some special mechanical or thermal treatment. Further, according to the pulverization process, magnetic powder is inevitably exposed to the surface of the resultant toner particles, so that it is difficult to obtain a ratio (B/A) of below 0.001 between the iron content (A) and the carbon content (A) at the toner particle surfaces as measured by the X-ray photoelectron spectroscopy, thus making it difficult to solve the problem of abrasion of the photosensitive member. For overcoming the above-mentioned problems in production, the magnetic toner according to the present invention may preferably be produced through a polymerization process, particularly a suspension polymerization process.

The suspension polymerization process for producing a magnetic toner according to the present invention is a process of obtaining a monomeric mixture by uniformly dissolving or dispersing a monomer and magnetic powder (and, optionally, other additives, such as wax, a colorant, a crosslinking agent and charge control agent), dispersing the monomeric mixture in an aqueous medium (e.g., water) containing a dispersion stabilizer by means of an appropriate stirrer, and subjecting the dispersed monomeric mixture to suspension polymerization in the presence of a polymerization initiator to obtain toner particles of a desirable particle size. This is suitably effected in the present invention.

More specifically, the process for producing a magnetic toner as mentioned above according to the present invention includes a suspension polymerization step of polymerizing a monomeric mixture containing at least a monomer including a styrene monomer and magnetic powder in an aqueous medium by using a peroxide polymerization initiator.

The magnetic polymerization toner polymerized through the suspension polymerization process is caused to comprise individual toner particles having a uniformly spherical shape, so that it is easy to obtain a toner having a circularity of at least 0.970 as an essential physical requirement of the present invention and also a mode circularity of at least 0.99 as a preferred property, and further such a toner has a relatively uniform chargeability distribution, thus exhibiting a high transferability.

However, by using a monomeric mixture containing ordinary magnetic powder at the time of suspension polymerization, it is difficult to suppress the exposure of the magnetic powder to the resultant toner particle surface, the resultant toner particles are liable to have remarkably lower flowability and chargeability, and also it is difficult to obtain a toner having a circularity of at least 0.970 because of strong interaction between the magnetic powder and water. This is firstly because magnetic powder particles are generally hydrophilic, thus being liable to be localized at the toner particle surfaces, and secondly because at the time of suspension of the monomeric mixture in an aqueous medium or at the time of stirring the suspension liquid during the polymerization, the magnetic powder is moved at random within the suspended liquid droplets and the suspended liquid droplet surfaces comprising the monomer are pulled by the randomly moving magnetic powder, thereby distorting the liquid droplets from spheres. In order to solve such problems, it is preferred to use magnetic powder particles having entirely hydrophobized surfaces as mentioned above.

By using such a magnetic powder completely surface-treated with a coupling agent, it becomes possible to obtain a magnetic toner which has a circularity of at least 0.970, further a mode circularity of 0.99 or higher and also a ratio (B/A) of below 0.001 between the iron content (B) and the carbon content (A) at the toner particle surfaces as measured by the X-ray photoelectron spectroscopy. By using a toner in an image forming method including a contact charging step, the abrasion and toner melt-sticking onto the photosensitive member can be better suppressed to stabilize high-quality image formation even in a low humidity environment. The high-quality image forming performance and stable continuous image forming performance can be further remarkably improved at a B/A ratio of below 0.0005.

The process for producing a polymerization toner through the suspension polymerization process will now be further described. In the polymerization toner production process, toner particles are directly obtained by polymerizing the above-mentioned monomeric mixture.

In the toner particle production, it is possible to add a resin into the above-mentioned monomeric mixture. For example, when it is desired to introduce into the toner a monomer component having a hydrophilic functional group, such as amino, carboxyl, hydroxyl, sulfonic acid or nitrile, which is liable to be emulsified in the form of a monomer in an aqueous medium, such a monomer may be converted into a random copolymer, a block copolymer or a graft copolymer with a vinyl compound, such as styrene or ethylene; a polycondensate, such as polyester or a polyamide or a polyaddition-type polymer, such as a polyether or a polyimide, to be introduced into the monomeric mixture. If such a functional group-containing polymer is caused to be co-present in toner particles, the above-mentioned wax component can be more effectively enclosed at an inner part of the toner particles, thus providing a toner with improved anti-offset property, anti-blocking property, and low-temperature fixability. Such a functional group-containing polymer, when used, may preferably have a weight-average molecular weight of at least 5000. If the molecular weight is below 5000, particularly below 4000, as such a polar polymer is liable to be concentrated at the toner particle surfaces, the developing performance and anti-blocking property of the resultant toner can be adversely affected. As such a polar polymer, a polyester-type resin is particularly preferred.

Further, for the purpose of improving the dispersibility of ingredients and the fixability and u,; image forming performance of the resultant toner, it is possible to add a resin other than the above in the monomeric mixture. Examples of such another resin may include: homopolymers of styrene and its substituted derivatives, such as polystyrene and polyvinyltoluene; styrene copolymers, such as styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleic acid ester copolymers; polymethyl methacrylate, polybutyl methacrylate, polyvinyl acetate, polyethylene, polypropylene, polyvinyl butyral, silicone resin, polyester resin, polyamide resin, epoxy resin, polyacrylic acid resin, rosin, modified rosin, terpene resin, phenolic resin, aliphatic or alicyclic hydrocarbon resins, and aromatic petroleum resin. These resins may be used singly or in combination of two or more species.

Such a resin may preferably be added in 1–20 wt. parts per 100 wt. parts of the monomer. Below 1 wt. part, the addition effect thereof is scarce, and above 20 wt. parts, the designing of various properties of the resultant polymerization toner becomes difficult.

Further, if a polymer having a molecular weight which is different from that of the polymer obtained by the polymerization is dissolved in the monomer for polymerization, it is possible to obtain a toner having a broad molecular weight distribution and thus showing a high anti-offset property.

In the polymerization process for producing a magnetic toner according to the present invention, it is possible to incorporate a crosslinking agent, e.g., in 0.001–15 wt. parts per 100 wt. parts of the monomer.

The crosslinking agent may for example be a compound having two or more polymerizable double bonds. Examples thereof may include: aromatic divinyl compounds, such as divinylbenzene, and divinylnaphthalene; carboxylate esters having two double bonds, such as ethylene glycol diacrylate, ethylene glycol dimethacrylate, and 1,3-butane diol dimethacrylate; divinyl compounds, such as divinylaniline, divinyl ether, divinyl sulfide and divinyl sulfone; and compounds having three or more vinyl groups. These may be used singly or in mixture.

In order to produce the magnetic toner through a suspension polymerization process, the above-mentioned monomeric mixture, i.e., a mixture of a polymerizable monomer and magnetic powder, and other toner components a wax, plasticizer, a charge control agent, a crosslinking agent, and a colorant, as desired; further optional ingredients, such as an organic solvent polymer, an additive polymer, and dispersing agent, subjected to uniform dissolution or dispersion by a dispersing machine, such as a homogenizer, a ball mill, a colloid mill or an ultrasonic dispersing machine, may be suspended in an aqueous medium. At this time, it is preferred to use a high-speed dispersing machine, such as a high-speed stirrer or an ultrasonic dispersing machine to form droplets of the monomeric mixture in desired size at a stroke in order to provide toner particles of a narrower particle size distribution.

In order to polymerize the droplets of the monomeric mixture according to the process of the present invention, it is necessary to use a peroxide polymerization initiator. The peroxide polymerization initiator may be added to the polymerization system by adding it to the monomeric mixture together with the other ingredient for providing the monomeric mixture or just before dispersing the monomeric mixture in the aqueous medium. Alternatively, it is also possible to add such a peroxide polymerization initiator in solution within a polymerizable monomer or another solvent into the polymerization system just after the formation of the droplets of the monomeric mixture and before the initiation of the polymerization. After the formation of the droplets of the monomeric mixture, the system may be stirred by an ordinary stirrer at an appropriate degree for maintaining droplet state and preventing the floating or sedimentation of the droplets.

Into the suspension polymerization system, a dispersion stabilizer may be added. As the dispersion stabilizer, it is possible to use a known surfactant or organic or inorganic dispersion agent. Among these, an inorganic dispersing agent may preferably be used because it is less liable to result in excessively small particles which can cause some image defects, its dispersion function is less liable to be impaired even at a temperature change because its stabilizing function principally relies on its steric hindrance, and also it can be readily removed by washing to be less liable to adversely affect the resultant toner performance. Examples of such an inorganic dispersing agent may include: polyvalent metal phosphates, such as calcium phosphate, magnesium phosphate, aluminum phosphate, and zinc phosphate; carbonates, such as calcium carbonate and magnesium carbonate; inorganic salts, such as calcium metasilicate, calcium sulfate, and barium sulfate; and inorganic oxides, such as calcium hydroxide, magnesium hydroxide, aluminum hydroxide, silica bentonite, and alumina.

Such an inorganic dispersing agent may desirably be used singly in an amount of 0.2–20 wt. parts per 100 wt. parts of the polymerizable monomeric mixture, but it is also possible to use 0.001–0.1 wt. part of a surfactant in combination.

Examples of such a surfactant may include: sodium dodecylbenzenesulfate, sodium tetradecylsulfate, sodium pentadecylsulfate, sodium octylsulfate, sodium oleate, sodium laurate, sodium stearate, and potassium stearate.

An inorganic agent as mentioned above may be used as it is but may be produced in situ in the aqueous medium for suspension polymerization in order to provide toner particles of a narrower particle size distribution. For example, in the case of calcium phosphate, a sodium phosphate aqueous solution and a calcium phosphate aqueous solution may be blended under high-speed stirring to form water-insoluble calcium phosphate, which allows the dispersion of a monomeric mixture into droplets of a more uniform size. At this time, water-soluble sodium chloride is by-produced, but the presence of such a water-soluble salt is effective for suppressing the dissolution of a polymerizable monomer into the aqueous medium, thus conveniently suppressing the formation of ultrafine toner particles owing to emulsion polymerization.

In the case of using a dispersing agent, it is desired to remove the dispersing agent after the formation of toner particles, since such a dispersing agent remaining on the toner particle surfaces is liable to adversely affect the chargeability, particularly the environmental stability thereof.

In the case of using calcium phosphate as a dispersing agent, for example, the calcium phosphate may be almost completely removed by adding an acid to the suspension liquid after the polymerization while utilizing a solubility of the compound in acidic water and repeating the filtration and washing with water of the toner particles. For the dissolution of calcium phosphate, the lowering of pH of the aqueous medium containing the suspended toner particles down to below 4, preferably below 2, may achieve the removal of calcium phosphate in a short time.

As mentioned above, in the case of using calcium phthalate as a dispersion stabilizer for the polymerization, it is preferred to include a step of contacting the toner particle, to which the dispersion stabilizer is attached, with water of below pH 4 in order to remove the stabilizer by dissolution, whereas it is further preferred to place a step of substantially separating an aqueous medium which has been made alkaline to remove a carboxylic acid originated from the peroxide polymerization initiator from the toner particles.

The "aqueous medium" used in the suspension polymerization step for production of toner particle in the process of the present invention is a medium principally consisting of water. More specifically, the aqueous medium may be water per se, water containing a small amount of a surfactant, water containing a pH adjusting agent, or water containing a small amount of organic solvent, or a mixture of these.

When the above-mentioned monomeric mixture is dispersed into droplets and polymerized, it is preferred that the monomeric mixture and the aqueous medium are mixed in a weight ratio of 20:80–60:40 so as to provide a narrow particle size distribution. A ratio of 30:70–50:50 is particularly preferred in order to provide toner particles with good dispersion of magnetic powder therein and with a very narrow particle size distribution characterized by a small variation coefficient.

The temperature for the suspension polymerization may be set to at least 40° C., generally in a range of 50–120° C. The polymerization in this temperature range is preferred because the wax is precipitated by phase separation to be enclosed more completely.

The polymerizable toner particles after the present invention may be recovered by filtration, washing and drying, and then blended with the inorganic fine powder in a known manner so as to attach the inorganic fine powder on the toner particles.

More specifically, as mentioned above, the suspension liquid containing the polymerizate toner particles after the polymerization is adjusted to an alkalinity (preferably pH 10–12), and then the polymerizate toner particles are substantially separated from the aqueous medium, e.g., by filtration. As a result, a carboxylic acid originated from the peroxide polymerization initiator may be effectively removed from the toner particles.

After the step for separation of the by-produced carboxylic acid, the polymerizate toner particles are caused to contact an acidic aqueous medium of preferably below pH 4, so as to effectively remove a hardly water-soluble metal salt, such as calcium phosphate, used as the dispersion stabilizer.

It is also preferred mode of modification to subject the recovered polymerizate toner particles to a classification step for removal of a coarse and a fine powder fraction.

<4> Image Forming Method and Image Forming Apparatus According to the Present Invention The image forming method according to the present invention includes a repetition of image forming cycles each including: a charging step of charging an image-bearing member by a charging member supplied with a voltage; an electrostatic latent image forming step of forming an electrostatic latent image on the charged image-bearing member; a developing step of transferring a toner carried on a toner-carrying member onto the electrostatic latent image formed on the image-bearing member to form a toner image on the image-bearing member; and a transfer step of electrostatically transferring the toner image formed on the image-bearing member onto a transfer material; wherein the above-mentioned magnetic toner according to the present invention is used as the toner.

The charging step may preferably be effected according to a contact charging mode wherein the charging member is abutted against a photosensitive member as the image-bearing member so as to form a contact nip and is supplied with a voltage to charge the photosensitive member.

The image forming apparatus according to the present invention includes: an image-bearing member for carrying an electrostatic latent image thereon; a charging means including a charging member supplied with a voltage for charging the image-bearing member; a latent image forming means for forming an electrostatic latent image on the image-bearing member; a developing means including a toner-carrying member for transferring a toner carried on the toner-carrying member onto the electrostatic latent image to form a toner image on the image-bearing member; and a transfer means for electrostatically transferring the toner image on the image-bearing member onto a transfer material, wherein the above-mentioned magnetic toner according the present invention is used as the toner.

The image forming method and the image forming apparatus according to the present invention can further include other steps and means, respectively, known in the art.

Next, some embodiments of the image forming method and apparatus of the present invention will be described in further detail while referring to drawing, to which the present invention should not be construed to be restricted.

Referring to FIG. 1, surrounding a photosensitive member 100 as an image-bearing member, a charging roller 117 (contact charging member), a developing device 140 (developing means), a transfer roller 114 (transfer means), a cleaner 116, and paper supply rollers 124. are disposed. The photosensitive member 100 is charged to −700 volts by the charging roller 117 supplied with an AC voltage of peak-to-peak 2.0 kV superposed with DC −200 volts and is exposed to imagewise laser light 123 from a laser beam scanner 121 to form an electrostatic latent image thereon, which is then developed with a mono-component magnetic toner by the developing device 140 to form a toner image. The toner image on the photosensitive member 100 is then transferred onto a transfer(-receiving) material P by means of the transfer roller 114 abutted against the photosensitive member 100 via the transfer material P. The transfer material P carrying the toner image is then conveyed by a conveyer belt 125, etc., to a fixing device 126, where the toner image is fixed onto the transfer material P. A portion of the toner P remaining on the photosensitive member 100 is removed by the cleaner 116 (cleaning means).

Figure 2:
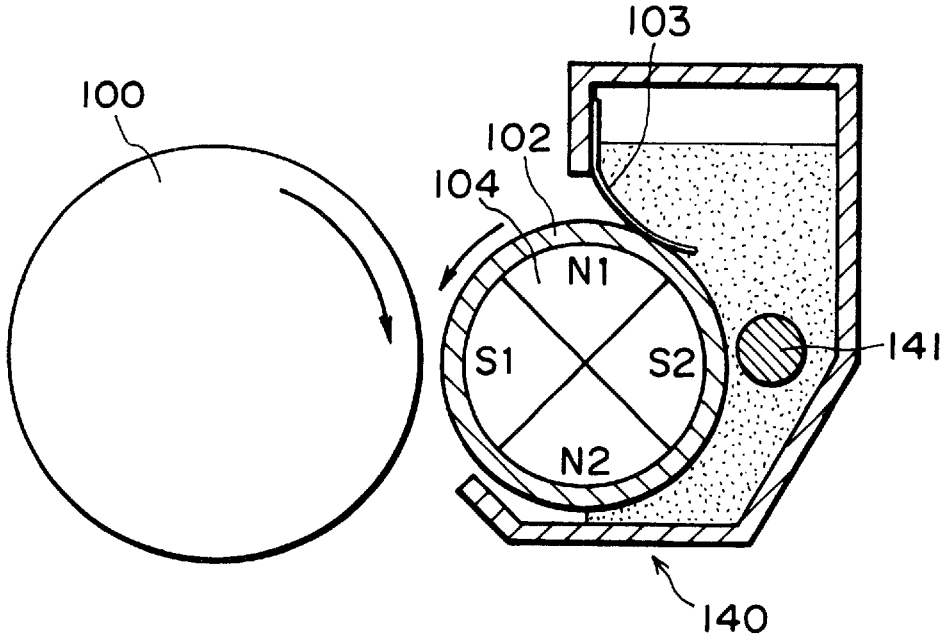
FIG. 2 illustrates an organization of a mono-component-type developing device used in the image forming apparatus of the invention.

As shown in more detail in FIG. 2, the developing device 140 includes a cylindrical toner-carrying member (hereinafter called a "developing sleeve") 102 formed of a non-magnetic metal, such a aluminum or stainless steel, and disposed in proximity to the photosensitive member 100, and a toner vessel containing the toner. The gap between the photosensitive member 100 and the developing sleeve 102 is set at ca. 300 $\mu$m by a sleeve/photosensitive member gap-retaining member (not shown), etc. The gap can be varied as desired. Within the developing sleeve 102, a magnet roller 104 is disposed fixedly and concentrically with the developing sleeve 102, while allowing the rotation of the developing sleeve 102. The magnet roller 104 is provided with a plurality of magnetic poles as shown, including a pole S1 associated with developing, a pole N1 associated with regulation of a toner coating amount, a pole S2 associated with toner take-in and conveyance, and a pole N2 associated with prevention of toner blowing-out. Within the toner reservoir, a stirring member 141 is disposed to stir the toner therein.

The developing device 140 is further equipped with an elastic blade 103 as a toner layer thickness-regulating member for regulating the amount of toner conveyed while being carried on the developing sleeve 2, by adjusting an abutting pressure at which the elastic blade 103 is abutted against the photosensitive member 102. In the developing region, a developing bias voltage comprising a DC voltage and/or an AC voltage is applied between the photosensitive member and the developing sleeve 102, so that the toner on the developing sleeve 102 is caused to jump onto the photosensitive member 100 corresponding to an electrostatic latent image formed thereon.

As preferred conditions for driving a charging roller 117 as shown in FIG. 1, the roller may be abutted at a pressure of 4.9–490 N/m (5–500 g/cm) and supplied with a DC voltage alone or in superposition with an AC voltage. The DC/AC-superposed voltage, for example, may preferably comprise an AC voltage of 0.5–5 kV (Vpp) and a frequency of 50 Hz to 5 kHz, and a DC voltage of ±0.2–±5 kV.

The charging means used in the charging step of the image forming method of the present invention may include an electroconductive contact charging member (or contact charger) such as a charging roller (as shown), or a fur brush charger, a magnetic brush charger or a blade charger (charging blade), which is caused to contact a photosensitive member (a member-to-be-charged, an image-bearing member) and is supplied with a prescribed voltage to charge the photosensitive member surface to a prescribed potential of a prescribed polarity. The charging R means using such a contact charging member is advantageous in that it does not require a high voltage but can suppress the occurrence of ozone.

The charging roller or charging blade as a contact charging member may preferably comprise an electroconductive rubber, which may be surface-coated with a release film comprising, e.g., nylon resin, PVdF (polyvinylidene fluoride), PVdC (polyvinylidene chloride) or fluorine-containing acrylic resin, so as to alleviate the attachment of transfer-residual toner.

The charging bias voltage applied to the contact charging member may be a DC voltage alone for exhibiting a good charging performance or also a superposition of a DC voltage and an AC voltage (alternating voltage) as shown in FIG. 1.

The AC voltage may preferably have a peak voltage of blow 2×Vth (Vth: discharge initiation voltage at the time of DC voltage application). If this condition is not satisfied, the potential on the image-bearing member is liable to be unstable. The AC voltage applied in superposition with a DC voltage may more preferably have a peak voltage below Vth so as to charge the image-bearing member without being substantially accompanied with a discharge phenomenon.

The AC voltage may have an appropriate voltage, such as a sine wave, a rectangular wave, a triangular wave, etc. Further, the AC voltage may comprise a pulse wave formed by periodically turning on and off a DC voltage supply. Thus, the AC voltage may have periodically changing voltages.

The image forming method may preferably include a developing-cleaning step or be operated according to a cleanerless mode, wherein a portion of the toner remaining on the photosensitive member after the transfer step is recovered in the developing, etc.

It is further preferred in such a developing-cleaning or cleanerless image forming method, the developing step is a step for developing an electrostatic latent image on an image-bearing member with a toner, the charging step is a step for charging the image-bearing member by applying a voltage to a charging member disposed in contact with the image-bearing member so as to form a contact nip, wherein electroconductive fine powder is present at at least the contact nip between the charging member and the image-bearing member and/or a proximity thereto. It is preferred that the electroconductive fine powder is contained in the magnetic toner so as to be attached onto the image-bearing member in the developing and allowed to remain on the image-bearing member without being substantially transferred in the transfer step to reach and be present at the contact position between the charging member and the image-bearing member.

Now, the behavior of toner particles and electroconductive fine powder added thereto in such a developing-cleaning image forming method will be described.

The electroconductive fine powder in the magnetic toner is transferred in an appropriate amount together with the toner particles from the toner-carrying member to the image-bearing member at the time of developing the electrostatic latent image formed on the image-bearing member.

The resultant toner image formed on the image-bearing member is transferred onto a transfer(-receiving) material, such as paper, in the transfer step. At this time, a portion of the electro-conductive fine powder on the image-bearing member is attached to the transfer material, but the remainder thereof is retained by attachment and remains on the image-bearing member. In the case of transfer effected by application of a transfer bias voltage of a polarity which is opposite to the charged polarity of the toner particles, the toner particles are readily transferred onto the transfer material side but the electroconductive fine powder on the image-bearing member is not readily transferred to the transfer material because of its electroconductivity. As a result, while a (minor) portion of the electroconductive fine powder is attached to the transfer material, the remainder thereof remains by attachment onto the image-bearing member.

In the image forming method not using a cleaner, a portion of toner particles (transfer-residual toner) and the electroconductive fine powder remaining on the image-bearing member after the transfer step are brought to a charging section along with movement of an image-bearing surface of the image-bearing member, so that the electroconductive fine powder is attached to or commingled into the contact charging member. As a result, the contact charging of the image-bearing member is effected in the state where the electroconductive fine powder is co-present at the contact part between the image-bearing member and the contact charging member.

As the electroconductive fine powder is positively brought to the charging section, the contact resistance level of the contact charging member is kept at a low level though a small amount of transfer-residual toner particles can also be attached or commingled into the contact charging member, whereby the image-bearing member can be effectively charged by the contact charging member. The transfer-residual toner attached to and mixed with the contact charging member is uniformly charged to a polarity identical to that of the charging bias voltage due to the charging bias voltage applied from the charging member to the image-bearing member and then gradually discharged from the contact charging member to the image-bearing member to reach the developing section and be recovered there.

Further, as the electroconductive fine powder is supplied in a form of being contained in the toner, the electroconductive fine powder is transferred onto the image-bearing member surface at the developing section and moved via the transfer section to be successively supplied to the charging section on each repetition of image forming cycle, so that the lowering in charging performance is prevented even if the electroconductive fine powder is reduced by falling or deteriorated at the charging section, thus stably retaining a good charging performance.

As a problem to be further solved in such an image forming method, when the electroconductive fine powder is contained in the toner in such an amount necessary to overcome the charging obstruction caused by the attachment and mixing of the insulating transfer-residual toner at the contact charging member by positively causing the electroconductive fine powder to be present at the contact position between the image-bearing member and the contact charging member, it possibly becomes difficult to maintain good image qualities due to image density lowering or increased fog when the toner is used continually down to a small amount in the toner cartridge.

Even in a conventional image forming apparatus including a conventional cleaning mechanism, when electroconductive fine powder is contained in a toner and the toner is used down to a small amount in the toner cartridge, image defects, such as image density lowering and increased fog, have been liable to occur due to a change in content of the electro-conductive fine powder caused by preferential consumption or preferential remaining of the electro-conductive fine powder at the developing step. Accordingly, it has been taken as a measure to firmly attach the electroconductive fine powder onto the toner particles so as to alleviate the preferential consumption or localization of the electroconductive fine powder, thereby preventing the lowering in image qualities, such as image density lowering and increased fog.

Compared with such a conventional image forming method, in the case of using a toner containing electroconductive fine powder in the developing-cleaning image forming method, the change in content of the electroconductive fine powder has a larger influence on the image qualities.

In such a cleaner-less-image forming method, the transfer-residual toner and the electroconductive fine powder after the transfer step are attached or mixed with the contact charging member. At this time, the proportion of the electroconductive fine powder attached or mixed with the contact charging member relative to that of the transfer-residual toner is substantially larger than in the original toner due to the difference in transferability between the electroconductive fine powder and the toner particles.

The electroconductive fine powder attached or mixed with the contact charging member in this state is gradually discharged from the contact charging member onto the image-bearing member together with the transfer-residual toner to reach the developing section, where the electroconductive fine powder and the transfer residual toner are recovered. Thus, as a result of the developing-cleaning operation, the toner having a remarkably larger content of electro-conductive fine powder is recovered, so that the change in electroconductive fine powder content is remarkably accelerated, thus being liable to cause lower image qualities, such as a lower image density.

If the above difficulties are tried to be solved by firmly attaching the electroconductive fine powder onto the toner particles as in a conventional image forming apparatus including a cleaning mechanism, the electroconductive fine powder moves together with toner particles also in the transfer step, thus failing to achieve ample supply of the electroconductive fine powder to the charging section for overcoming the charging obstruction due to the attachment or mixing with the contact charging member of the insulating transfer-residual toner.

Thus, the application of a toner containing electroconductive fine powder to a developing-cleaning image forming method using a contact charging member is accompanied with difficulties as mentioned above. The above-difficulties are solved in the present invention by using the spherical magnetic toner having specific properties as defined above, thereby realizing a cleanerless image forming method using a contact charging member, while maintaining a good chargeability and alleviating the localization of the electroconductive fine powder to suppress the lowering in image qualities, such as image density lowering, to a level of practically no problem.

Anyway, it is important to control the amount of electroconductive fine powder present at the contact position between the image-bearing member and the contact charging member at an appropriate level. If the amount is too small, the lubricating effect of the electroconductive fine powder cannot be sufficiently attained but results in a large friction between the image-bearing member and the contact charging member, so that it becomes difficult to drive the contact charging member in rotation with a speed difference relative to the image-bearing member. As a result, the drive torque increases, and if the contact charging member is forcibly driven, the surfaces of the contact charging member and the image-bearing member are liable to be abraded. Further, as the effect of increasing the contact opportunity owing to the electroconductive fine powder is not attained, it becomes difficult to attain a sufficient chargeability of the image bearing member. On the other hand, if the electroconductive fine powder is present in an excessively large amount, the falling of the electro-conductive fine powder from the contact charging member is increased, thus being liable to cause adverse effects, such as obstruction of latent image formation as by interception of imagewise exposure light.

In view of the above, the amount of the electroconductive fine powder at the contact position between the image-bearing member and the contact charging member is preferably $1\times10^3$–$5\times10^5$ particles/mm$^2$, more preferably $1\times10^4$–$5\times10^5$ particles/mm$^2$. Below $1\times10^3$ particles/mm$^2$, it becomes difficult to attain sufficient lubrication effect and opportunity of contact, thus being liable to result in a lower chargeability. Below $1\times10^4$ particles/mm$^2$, some lowering in chargeability can occur in case of an increased amount of transfer residual toner.

The appropriate range of amount of the electroconductive fine powder on the image-bearing member in the charging step, is also determined depending on a density of the electroconductive fine powder affecting the uniform charging on the image-bearing member.

It is needless to say that the image-bearing member has to be charged more uniformly than at least a recording resolution. However, in view of a human eye's visual characteristic, at spatial frequencies exceeding 10 cycles/mm, the number of discriminatable gradation levels approaches infinitely to 1, that is, the discrimination of density irregularity becomes impossible. As a positive utilization of this characteristic, in the case of attachment of the electroconductive fine powder on the image-bearing member, it is effective to dispose the electro-conductive fine powder at a density of at least 10 cycles/mm and effect the direct injection charging. Even if charging failure is caused at sites with no electroconductive fine powder, an image density irregularity caused thereby occurs at a spatial frequency exceeding the human visual sensitivity, so that no practical problem is encountered on the resultant images.

As to whether a charging failure is recognized as density irregularity in the resultant images, when the application density of the electro-conductive fine powder is changed, only a small amount (e.g., 10 particles/mm$^2$) of electroconductive fine powder can exhibit a recognized effect of suppressing density irregularity, but this is insufficient from a viewpoint as to whether the density irregularity is tolerable to human eyes. However, an application amount of $10^2$ particles/mm$^2$ results in a remarkably preferable effect by objective evaluation of the image. Further, an application density of $10^3$ particles/mm$^2$ or higher results in no image problem at all attributable to the charging failure.

In the charging step based on the direct injection charging mechanism as basically different from the one based on the discharge charging mechanism, the charging is effected through a positive contact between the contact charging member and the image-bearing member, but even if the electro-conductive fine powder is applied in an excessively large density, there always remain sites of no contact. This however results in practically no problem by applying the electroconductive fine powder while positively utilizing the above-mentioned visual characteristic of human eyes.

However, the application of the direct injection charging scheme for uniform charging of the image-bearing member in a developing-cleaning image forming method causes a lowering in charging performance due to attachment and mixing with the charging member of the transfer residual toner. For suppressing the attachment and mixing with the charging member of the transfer residual toner and overcoming the charging obstruction thereby to well effect the direct injection charging, it is preferred that the electroconductive fine powder is present at a density of $1\times10^4$ particles/mm$^2$ or higher at the contact position between the image-bearing member and the contact charging member.

The upper limit of the amount of the electroconductive fine powder present on the image-bearing member is determined by the formation of a densest mono-particle layer of the electroconductive fine powder. In excess of the amount, the effect of the electroconductive fine powder is not increased, but an excessive amount of the electroconductive fine powder is liable to be present on the image-bearing member after the charging step, thus being liable to cause difficulties, such as interruption or scattering of imagewise exposure light. Thus, a preferable upper amount of the electroconductive fine powder may be determined as an amount giving a densest mono-particle layer of the electroconductive fine powder on the image-bearing member while it may depend on the particle size of the electroconductive fine powder and the retentivity of the electroconductive fine powder by the contact charging member.

More specifically, if the electroconductive fine powder is present on the image-bearing member at a density in excess of $5\times10^5$ particles/mm$^2$ while it depends on the particle size of the electroconductive fine powder, the amount of the electroconductive fine powder falling off the image-bearing member is increased to soil the interior of the image forming apparatus, and the exposure light quantity is liable to be insufficient regardless of the light trans-missivity of the electroconductive fine powder. If the amount is suppressed to be $5\times10^5$) particles/mm$^2$ or below, the amount of falling particles soiling the apparatus is suppressed and the exposure light obstruction can be alleviated. As an experimental result, the amount of the electroconductive fine powder in the above-mentioned range at the contact part between the image-bearing member and the contact charging member resulted in amounts of electro-conductive fine powder falling on the image-bearing member (i.e., the amount of electroconductive fine powder on the image-bearing member in the latent image forming step) in the range of $10^2$–$10^5$ particles/mm$^2$. Also in view of adverse effect for latent image formation, a preferred range of the electroconductive fine powder at the contact part between the charging member and the image-bearing member is $1\times10^4$–$5\times10^5$/mm$^2$.

The amounts of the electroconductive fine powder at the charging contact part and on the image-bearing member in the latent image forming step described herein are based on values measured in the following manner. Regarding the amount of the electroconductive fine powder at the contact part, it is desirable to directly measure the value at the contacting surfaces on the contact charging member and the image-bearing member. However, in the case of opposite surface moving directions of the contact charging member and the image-bearing member, most particles present on the image-bearing member prior to the contact with the contact charging member are peeled off by the charging member contacting the image-bearing member while moving in the reverse direction, so that the amount of the electroconductive fine powder present on the contact charging member just before reaching the contact part is taken herein as the amount of electroconductive fine powder at the contact part.

More specifically, in the state of no charging bias voltage application, the rotation of the image-bearing member and the elastic conductive roller is stopped, and the surfaces of the image-bearing member and the elastic conductive roller are photographed by a video microscope ("OVM 1000N", made by Olympus K.K.) and a digital still recorder ("SR-310", made by Deltis K.K.). For the photographing, the elastic conductive roller is abutted against a slide glass under an identical condition as against the image-bearing member, and the contact surface is photographed at 10 parts or more through the slide glass and an objective lens having a magnification of 1000 of the video microscope. The digital images thus obtained are processed into binary data with a certain threshold for regional separation of individual particles, and the number of regions retaining particle fractions are counted by an appropriate image processing software. Also the electroconductive fine powder on the image-bearing member is similarly photographed through the video microscope and the amount thereof is counted through similar processing.

The amounts of electroconductive fine powder on the image-bearing member at a point of after transfer and before charging and a point of after charging and before developing are counted in similar manners as above through photographing and image processing.

In the image forming method according to the present invention, it is preferred that the contact charging member has some kind of elasticity for the purpose of forming a contact nip (contact position) between the contact charging member and the image-bearing member, and also is electroconductive so as to charge the image-bearing member while being supplied with a voltage. As a result, the contact charging member may preferably assume a form of, e.g., an electroconductive elastic roller member, a magnetic brush contact charging member having a magnetic brush member comprising a magnetically constrained mass of magnetic particles and disposed to contact the photosensitive member, or a brush charging member comprising a brush of electroconductive fiber.

The elastic conductive roller member usable as a contact charging member may preferably have an Asker C hardness of 20–50 deg., because too low a hardness results in a lower contact with the image-bearing member because of an unstable shape and abrasion or damage of the surface layer due to the electroconductive fine powder present at the contact part between the charging member and the image-bearing member, thus being difficult to provide a stable chargeability of the image-bearing member. On the other hand, too high a hardness makes it difficult to ensure a contact part with the image-bearing member and results in a poor microscopic contact with the image-bearing member surface, thus making it difficult to attain a stable chargeability of the image-bearing member. From these viewpoints, it is further preferred that the elastic conductive roller has an Asker C hardness of 25–50 deg. The values of Asker C hardness described herein are based on values measured by using a spring-type hardness meter ("Asker C", made by Kobunshi Keiki K.K.) according to JIS K6301 under a load of 9.8 N in the form of a roller.

In addition to the elasticity for attaining a sufficient contact with the image-bearing member, it is important for the elastic conductive roller to function as an electrode having a sufficiently low resistance for charging the moving image-bearing member. On the other hand, in case where the image-bearing member has a surface defect, such as a pinhole, it is necessary to prevent the leakage of voltage. In the case of an image-bearing member such as an electrophotographic photosensitive member, in order to have sufficient charging performance and leakage resistance, the elastic conductive roller may preferably have a resistivity of $10^3$–$10^8$ ohm.cm, more preferably $10^4$–$10^7$ ohm.cm. The resistivity values of an elastic conductive roller described herein are based on values measured by pressing the roller against a 30 mm-dia. cylindrical aluminum drum under an abutting pressure of 49 N/m and applying 100 volts between the core metal of the roller and the aluminum drum.

Such an elastic conductive roller may be prepared by forming a medium resistivity layer of rubber or foam material on a core metal. The medium resistivity layer may be formed in a roller shape on the core metal from an appropriate composition comprising a resin (of, e.g., urethane), conductor particles (of, e.g., carbon black), a vulvanizer and a foaming agent. Thereafter, a post-treatment, such as cutting or surface polishing, for shape adjustment may be performed to provide an elastic conductive roller. The elastic conductive roller may preferably have a surface provided with minute cells or unevennesses so as to stably retain the electroconductive fine powder.

The cells may preferably have concavities providing an average cell diameter corresponding to spheres of 5–300 $\mu$m and also a void percentage at the surface of 15–90%.

If the average cell diameter is below 5 μm, the supply of the electroconductive fine powder is liable to be short, and above 300 μm, the electroconductive fine powder supply is liable to be excessive, both resulting in an ununiform charged potential on the image-bearing member. Further, if the void percentage is below 15%, the electro-conductive fine powder supply is liable to be short, and above 90%, the supply is liable to be excessive, both resulting in ununiform charged potential on the image-bearing member.

The elastic conductive roller may be formed of other materials. A conductive elastic material may be provided by dispersing a conducive substance, such as carbon black or a metal oxide, for resistivity adjustment in an elastomer, such as ethylene-propylene-diene rubber (EPDM), urethane rubber, butadiene-acrylonitrile rubber (NBR), silicone rubber or isoprene rubber. It is also possible to use a foam product of such an elastic conductive material. It is also possible to effect a resistivity adjustment by using an ionically conductive material alone or together with a conductor substance as described above.

The core metal for of the charging roller may comprise, e.g., aluminum or stainless steel.

The elastic conductive roller is disposed under a prescribed pressure against the image-bearing member while resisting the elasticity thereof to provide a charging contact part (or portion) between the elastic conductive roller and the image-bearing member. The width of the contact part is not particularly restricted but may preferably be at least 1 mm, more preferably at least 2 mm, so as to stably provide an intimate contact between the elastic conductive roller and the image-bearing member.

The charging member used in the charging step of the present invention may also be in the form of a brush comprising conductive fiber so as to be supplied with a voltage to charge the image-bearing member. The charging brush may comprise ordinary fibrous material containing a conductor dispersed therein for resistivity adjustment. For example, it is possible to use fiber of nylon, acrylic resin, rayon, polycarbonate or polyester. Examples of the conductor may include fine powder of electroconductive metals, such as nickel, iron, aluminum, gold and silver; electroconductive metal oxides, such as iron oxide, zinc oxide, tin oxide, antimony oxide and titanium oxide; and carbon black. Such conductors can have been surface-treated for hydrophobization or resistivity adjustment, as desired. These conductors may appropriately be selected in view of dispersibility with the fiber material and productivity.

The charging brush as a contact charging member may include a fixed-type one and a rotatable roll-form one. A roll-form charging brush may be formed by winding a tape to which conductive fiber pile is planted about a core metal in a spiral form. The conductive fiber may have a thickness of 1–20 denier (fiber diameter of ca. 10–500 μm) and a brush fiber length of 1–15 mm arranged in a density of $10^4$–$3\times10^5$ fibers per inch ($1.5\times10^7$–$4.5\times10^8$ fibers per $m^2$).

The charging brush may preferably have as high a density as possible. It is also preferred to use a thread or fiber composed of several to several hundred fine filaments, e.g., threads of 300 denier/50 filaments, etc., each thread composed of a bundle of 50 filaments of 300 denier. In the present invention, however, the charging points in the direct injection charging are principally determined by the density of electroconductive fine powder present at the contact part and in its vicinity between the charging member and the image-bearing member, so that the latitude of selection of charging member materials has been broadened.

Similarly as the elastic conductive roller, the charging brush may preferably have a resistivity of $10^3$–$10^8$ ohm.cm, more preferably $10^4$–$10^7$ ohm.cm so as a to provide sufficient chargeability and leakage resistance of the image-bearing member.

Commercially available examples of the charging brush materials may include: electro-conductive rayon fiber "REC-B", "REC-C", "REC-M1" and "REC-M10" (available from Unitika K.K.), "SA-7" (Toray K.K.), "THUNDERRON" (Nippon Sanmo K.K.), "BELTRON" (Kanebo K.K.), "KURACARBO" (carbon-dispersed rayon, Kuraray K.K.) and "ROABAL" (Mitsubishi Rayon K.K.), "REC-B", "REC-C", "REC-M1" and "REC-M10" are particularly preferred in view of environmental stability.

The contact charging member may preferably have a flexibility so as to increase the opportunity of the electroconductive fine powder contacting the image-bearing member at the contact part between the contact charging member and the image-bearing member, thereby improving the direct injection charging performance. By having the contact charging member intimately contact the image-bearing member via the electroconductive fine powder and having the electroconductive fine powder densely rub the image bearing member surface, the image-bearing member can be charged not based on the discharge phenomenon but predominantly based on the stable and safe direct injection charging mechanism via the electroconductive fine powder. As a result, it becomes possible to attain a high charging efficiency not achieved by the conventional roller charging based on the discharge charging mechanism, and provide a potential almost equal to the voltage applied to the contact charging member to the image-bearing member.

It is preferred to provide a relative surface speed difference between the contact charging member and the image-bearing member. As a result, the opportunity of the electroconductive fine powder contacting the image-bearing member at the contact part between the contact charging member and the image-bearing member is remarkably increased, thereby further promoting the direct injection charging to the image-bearing member via the electroconductive fine powder.

As the electroconductive fine power is present at the contact position between the contact charging member and the image-bearing member, the electroconductive fine powder exhibits a lubricating effect (i.e., friction-reducing effect), so that it becomes possible to provide such a relative surface speed difference between the contact charging member and the image-bearing member without causing a remarkable increase in torque acting between these members or a remarkable abrasion of these members.

It is preferred that the charging member and the image-bearing member are moved in mutually opposite directions at the contact part. This is preferred in order to enhance the effect of temporarily damming and leveling the transfer-residual toner particles on the image-bearing member brought to the contact charging member. This is for example accomplished by driving the contact charging member in rotation in a direction and also driving the image-bearing member in rotation so as to move the surfaces of these members in mutually opposite directions. As a result, the transfer-residual toner particles on the image-bearing member are once released from the image-bearing member to advantageously effect the direct injection charging and suppress the obstruction of the latent image formation.

It is possible to provide a relative surface speed difference by moving the charging member and the image-bearing member in the same direction. However, as the charging performance in the direct injection charging depends on a moving speed ratio between the image-bearing member and the contact charging member, a larger moving speed is required in the same direction movement in order to obtain an identical relative movement speed difference than in the opposite direction movement. This is disadvantageous. Further, the opposite direction movement is more advantageous also in order to attain the effect of leveling the transfer-residual toner particle pattern on the image-bearing member.

Such a relative surface speed difference may be provided by rotating the contact charging member and the image-bearing member with a certain peripheral speed ratio as determined by the following formula (V):

$$\text{Peripheral speed ratio } (\%) = [(\text{peripheral speed of the charging member})/(\text{peripheral speed of the image-bearing member})] \times 100 \quad \text{(V)}$$

It is also possible to use a relative (movement) speed ratio as determined by the following formula (VI):

$$\text{Relative speed ratio } (\%) = |[(Vc - Vp)/Vp] \times 100| \quad \text{(VI)},$$

wherein Vp denotes a moving speed of the image-bearing member, Vc denotes a moving speed of the charging member of which the sign is taken positive when the charging member surface moves in the same direction as the image-bearing member surface at the contact position.

The relative (movement) speed ratio is generally in the range of 10–500%.

Also from the viewpoints of temporarily recovering the transfer-residual toner on the image-bearing member and carrying the electroconductive fine powder to advantageously effect the direct injection charging, it is preferred to use a flexible charging member, such as a conductive elastic charging roller or a rotatable charging brush roller, as mentioned above as a contact charting member.

In the present invention, the image-bearing member may preferably have a surfacemost layer exhibiting a volume resistivity of $1\times10^{9}$–$1\times10^{14}$ ohm.cm, more preferably $1\times10^{10}$–$1\times10^{14}$ ohm.cm so as to provide a good chargeability of the image-bearing member. In the charging scheme based on direct charge injection, better charge transfer can be effected by lowering the resistivity of the member-to-be-charged. For this purpose, it is preferred that the surfacemost layer has a volume-resistivity of at most $1\times10^{14}$ ohm.cm. On the other hand, for the image-bearing member to retain an electrostatic image for a certain period, it is preferred that the surfacemost layer has a volume resistivity of at least $1\times10^{9}$ ohm.cm.

It is further preferred that the image-bearing member is an electrophotographic photosensitive member and the photosensitive member has a surfacemost layer exhibiting a volume resistivity of $1\times10^{9}$–$1\times10^{14}$ ohm.cm so the image-bearing member can be provided with a sufficient chargeability even in an apparatus operated at a high process speed.

It is also preferred that the image-bearing member is a photosensitive drum or a photosensitive belt comprising a layer of photoconductive insulating material, such as amorphous selenium, CdS, $Zn_2O$, amorphous silicon or an organic photoconductor. It is particularly preferred to use a photosensitive member having an amorphous silicon photosensitive layer or an organic photosensitive layer.

In the present invention, the photosensitive member surface may preferably have a releasability as represented by a contact angle with water of at least 85 deg. Such a photosensitive member surface may be provided by a surface layer principally comprising a polymeric binder and being provided with a releasability. For example, a surface layer principally comprising a resin may be formed on an inorganic photosensitive member of, e.g., selenium or amorphous silicon; a surface layer comprising a charge-transporting substance and a resin may be formed as a charge transport layer of a function-separation-type photosensitive member; or a surface layer showing a releasability may be further disposed on such a charge-transport layer. More specifically, the image-bearing member surface may be provided with an increased releasability, e.g., in the following manner:

(1) The surfacemost layer is formed from a resin having a low surface energy.

(2) An additive showing water-repellency or lipophilicity is added to the surfacemost layer.

(3) A material having high releasability in a powdery form is dispersed in the surfacemost layer. For (1), a resin having a fluorine-containing resin or a silicone group may be used. For (2), a surfactant may be used as the additive. For (3), it may be possible to use a material, a fluorine-containing compound inclusive of polytetrafluoroethylene, polyvinylidene fluoride or fluorinated carbon, silicone resin or polyolefin resin.

According to these measures, it is possible to provide an image-bearing member surface exhibiting a contact angle with water of at least 85 deg. so as to further improve the toner transferability and the durability of the photosensitive member. Among the above, it is particularly preferred to use a fluorine-containing resin, such as polytetrafluoroethylene or polyvinylidene fluoride, particularly as a material dispersed in the surfacemost layer according to the above-mentioned measure (3). In this case, a larger contact angle with water can be provided by increasing the amount of the releasable resin powder.

The contact angle may be measured by using a contact angle meter as an angle of a free surface of a water droplet placed on a sample surface formed at an edge of the water droplet (as an angle included in the water droplet) against the sample surface at room temperature (ca. 21–25° C.).

Such a surfacemost layer containing lubricating or releasing powder may be provided as an additional layer on the surface of a photosensitive member or by incorporating such lubricant powder into a surfacemost resinous layer of an organic photosensitive member. The releasing or lubricating powder may be added to a surfacemost layer of the image-bearing member in a proportion of 1–60 wt. %, more preferably 2–50 wt. %. Below 1 wt. %, the effects of improving the toner transferability and the durability of the photosensitive member may be insufficient. In excess of 60 wt. %, the surfacemost layer may have a lower film strength, and the incident light quantity to the photosensitive member can be lowered.

In the present invention, it is preferred to adopt a contact charging method wherein a charging member as a charging means is abutted against a photosensitive member as an image-bearing member so as to form a contact nip with the photosensitive member and is supplied with a voltage to charge the photosensitive member. As the contact charging method exerts a larger load onto the photosensitive member than the corona discharge charging method wherein the charging means does not contact the photosensitive member, the photosensitive member may preferably be modified to have an organization as follows.

The organic photosensitive layer may be a single photosensitive layer containing a charge-generating substance and a charge-transporting substance, or a function separation-type laminate photosensitive layer including a charge transport layer and a charge generation layer. A laminate photosensitive layer comprising a charge generation layer and a charge transport layer laminated in this order on an electroconductive support is a preferred example.

A preferred organization of photosensitive member as an image-bearing member is described below. The electroconductive substrate may comprise: a metal, such as aluminum or stainless steel; a plastic material coated with a layer of aluminum alloy or indium tin oxide; paper or plastic material impregnated with electroconductive particles; or a plastic material comprising an electroconductive polymer, in the form of a cylinder, a film or a sheet.

Such an electroconductive support may be coated with an undercoating layer for the purpose of, e.g., improved adhesion of a photosensitive layer thereon, improved coatability, protection of the substrate, coating of defects of the substrate, improved charge injection from the substrate, or protection of the photosensitive layer from electrical breakage. The undercoating layer may be formed of a material such as polyvinyl alcohol, poly-N-vinylimidazole, polyethylene oxide, ethyl cellulose, methyl cellulose, nitro cellulose, ethylene-acrylic acid copolymer, polyvinyl butyral, phanolic resin, casein, polyamide, copolymer nylon, glue, gelatin, polyurethane or aluminum oxide. The undercoating layer may have a thickness of ordinarily 0.1–10 $\mu$m, more preferably 0.1–3 $\mu$m.

A charge generation layer may be formed by applying a paint formed by dispersing a charge-generating substance, such as azo pigment, phthalocyanine pigment, indigo pigment, perylene pigment, polycyclic quinone, squalylium dye, pyrylium salt, thiopyrylium salt, triphenylmethane dye, or an inorganic substance such as selenium or amorphous silicon, or by vapor deposition of such a charge-generating substance. Among these, a phthalocyanine pigment is particularly preferred in order to provide a photosensitive member with a photosensitivity adapted to the present invention. Examples of the binder resin may include: polycarbonate resin, polyester resin, polyvinyl butyral resin, polystyrene resin, acrylic resin, methacrylic resin, phenolic resin, silicone resin, epoxy resin or vinyl acetate resin. The binder resin may occupy at most 80 wt. %, preferably 0–40 wt. %, of the charge generation layer. The charge generation layer may preferably have a thickness of at most 5 $\mu$m, particularly 0.05–2 $\mu$m.

The charge transport layer has a function of receiving charge carriers from the charge generation layer and transporting the carriers under an electric field. The charge transport layer may be formed by dissolving or dispersing a charge-transporting substance in a solvent, optionally together with a binder resin, and applying the resulting coating liquid. The thickness may generally be in the range of 5–40 $\mu$m. Examples of the charge-transporting substance may include: polycyclic aromatic compounds including structures of biphenylene, anthracene, peryrene and anthracene; nitrogen-containing cyclic compounds, such as indole, carbazole, oxadiazole and pyrazolile; hydrazone compounds; styryl compounds; polymers having a group derived from the foregoing aromatic compounds in their main chains or side chains; selenium; selenium-tellurium; amorphous silicon. Examples of the binder dispersing or dissolved together with such charge-transporting substances may include: polycarbonate resin, polyester resin, polymethacrylate resin, polystyrene resin, acrylic resin, polyamide resin; and organic photo-conductive polymers, such as poly-N-vinylcarbazole and polyvinylanthracene.

A protective layer may be disposed as a surface layer, comprising, e.g., a resin, such as polyester, polycarbonate, acrylic resin, epoxy resin, or phenolic resin, or a cured product of such a resin with a curing agent. These resins may be used singly or in combination of two or more species.

Such a protective layer may preferably contain electroconductive fine particles dispersed therein. The electroconductive fine particles may comprise a metal or a metal oxide. Preferred examples thereof may include: fine particles of zinc oxide, titanium oxide, tin oxide, antimony oxide, indium oxide, bismuth oxide, tin oxide-coated titanium oxide, tin-coated indium oxide, and antimony-coated tin oxide or zirconium oxide. These materials may be used singly or in combination of two or more species.

In the case where the electroconductive particles and/or lubricating particles are dispersed in the protective layer, it is necessary that the dispersed particles have a particle size smaller than the exposure light wavelength incident to the protective layer so as to avoid the scattering of incident light by the dispersed particles. Accordingly, the electroconductive and/or lubricating particles may preferably have a particle size of at most 0.5 $\mu$m. These particles may preferably be contained in 2–90 wt. %, more preferably 5–70 wt. %, of the total weight of the surfacemost layer. Below 2 wt. %, it becomes difficult to obtain a desired resistivity. In excess of 90 wt. %, the charge injection layer is caused to have a lower film strength and thus is liable to be easily abraded to provide a shorter life. Further, the resistivity is liable to be excessively low, so that image defect is liable to occur due to flow of latent image potential.

The protective layer may preferably have a thickness of 0.1–10 $\mu$m, more preferably 1–7 $\mu$m.

The above-mentioned resin layers may be formed directly or indirectly on the electroconductive support, e.g., by vapor deposition or coating. More specifically, the coating may be effected by methods, such as bar coating, knife coating, roller coating, attritor coating, spray coating, dipping, electrostatic coating or powder coating. Among these, wet coating (or application) methods may be performed for each layer by dispersing or dissolving the ingredients in an appropriate organic solvent, etc., and applying the resultant dispersion or solution by a wet coating method as mentioned above, followed by removal by evaporation, etc. In the case of using a reaction-curable binder resin, the corresponding dispersion or solution after the coating may be subjected to curing of the resin by exposure to heat or light, optionally followed by removal of the solvent by evaporation, etc.

Examples of the organic solvent used for the above purpose may include: ethanol, toluene and methyl ethyl ketone.

By a surface resistivity adjustment of the photosensitive member, it is possible to further stably effect the uniform charging of the image-bearing member.

Accordingly, it is also preferred to dispose a charge injection layer on the surface of an electrophotographic photosensitive member. The charge injection layer may preferably comprise a resin with electroconductive fine particles dispersed therein.

Such a charge injection layer may for example be provided in any of the following forms.

(i) A charge injection layer is disposed on an inorganic photosensitive layer of, e.g., selenium or amorphous silicon, or a single organic photosensitive layer. (ii) A charge transport layer as a surface by comprising a charge-transporting substance and a resin in the function-separation-type organic photosensitive member is also caused to have the function of a charge injection layer. For example, a charge transport layer is formed from a resin, a charge-transporting substance and electroconductive particles dispersed therein, or a charge transport layer is also provided with a function of a charge injection layer by selection of the charge-transporting substance or the state of presence of the charge-transporting substance. (iii) A function separation-type organic photosensitive member is provided with a charge injection layer as a surfacemost layer. In any of the above forms, it is important that the surfacemost layer has a volume-resistivity in a preferred range as describe below. It is also possible to disperse the above-mentioned lubricating particles in the charge-injection layer.

The charge injection layer may for example be formed as an inorganic material layer, such as a metal deposition film, or an electroconductive powder-disposed resin layer comprising electroconductive fine particles dispersed in a binder resin. The deposition film is formed by vapor deposition. The electro-conductive powder-dispersed resin layer may be formed by appropriate coating methods, such as dipping, spray coating, roller coating or beam coating. Such a charge injection layer may also be formed from a mixture or a copolymer of an insulating binder resin and a photoconductive resin having an ionic conductivity, or a photoconductive resin having a medium resistivity as mentioned above.

It is particularly preferred to provide the image-bearing member with a resin layer containing at least electroconductive fine particles of metal oxide (metal oxide conductor particles) dispersed therein as a surfacemost charge injection layer. By disposing such a charge injection layer as a surfacemost layer on an electrophotographic photosensitive member, the photosensitive member is caused to have a lower surface resistivity allowing charge transfer at a better efficiency, and function as a result of lower surface resistivity, it is possible to suppress the blurring or flowing of a latent image caused by diffusion of latent image charge while the image-bearing member retains a latent image thereon.

In the oxide conductor particle-dispersed resin layer, it is necessary that the oxide conductor particles have a particle size smaller than the exposure light wavelength incident thereto so as to avoid the scattering of incident light by the dispersed particles. Accordingly, the oxide conductor particles may preferably have a particle size of at most 0.5 $\mu$m. The oxide conductor particles may preferably be contained in 2–90 wt. %, more preferably 5–70 wt. %, of the total weight of the surfacemost layer. Below the above range, it becomes difficult to obtain a desired resistivity. In excess of the above range, the charge injection layer is caused to have a lower film strength and thus is liable to be easily abraded to provide a shorter life. Further, the resistivity is liable to be excessively low, so that image defect is liable to occur due to flow of latent image potential. The charge injection layer may preferably have a thickness of 0.1–10 $\mu$m, more preferably at most 5 $\mu$m so as to retain a sharpness of latent image contour. In view of the durability, a thickness of at least 1 $\mu$m is preferred.

The charge injection layer can comprise a binder resin identical to that of a lower layer (e.g., charge transport layer). In this case, however, the lower layer can be disturbed during the formation by application of the charge injection layer, so that the application method should be selected so as not to cause the difficulty.

Figure 8:
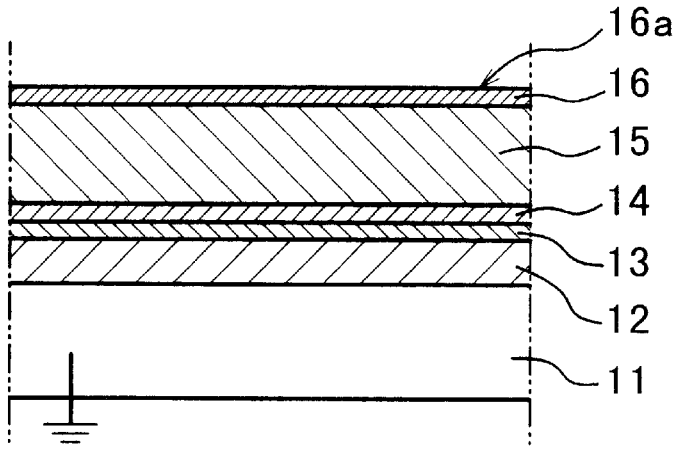

FIG. 8 is a schematic sectional view of a photosensitive member provided with a charge injection layer. More specifically, the photosensitive member includes an ordinary organic photosensitive drum structure comprising an electroconductive substrate (aluminum drum substrate) 11, and an electroconductive layer 12, a positive charge injection prevention layer 13, a charge generation 14 and a charge transport layer 15 disposed successively by coating on the electroconductive substrate 1, and further includes a charge generation layer 16 formed by coating thereon for improving the chargeability by charge injection. The charge injection layer 16 may contain electro-conductive particles.

It is important for the charge injection layer 16 formed as the surfacemost layer of the image-bearing member to have a volume resistivity in the range of $1\times10^{9}$–$1\times10^{14}$ ohm.cm. A similar effect can be obtained without such a charge injection layer 16 if the charge transport layer 15 forming the surfacemost layer has a volume resistivity in the above-described range. For example, an amorphous silicon photosensitive member having a surface layer volume resistivity of ca. $10^{13}$ ohm.cm exhibits good chargeability by charge injection.

The volume resistivity value of the surfacemost layer of the image-bearing member described herein are based on values measured in the following manner. A layer of a composition identical to that of the surfacemost layer is formed on a gold layer vapor-deposited on a polyethylene terephthalate (PET) film, and the volume resistivity of the layer is measured by a volume resistivity meter ("4140B pA", available from Hewlett-Packard Co.) by applying 100 volts across the film in an environment of 23° C. and 65% RH.

In the present invention, the image-bearing member surface may preferably have a releasability as represented by a contact angle with water of at least 85 deg., more preferably at least 90 deg, which may be accomplished in a manner similarly as described above.

Now, a contact transfer step preferably adopted in the image forming method of the present invention will now be described.

The transfer step of the present invention can be a step of once transferring the toner image formed in the developing step to an intermediate transfer member and then re-transferring the toner image onto a recording medium, such as paper. Thus, the transfer(-receiving) material receiving the transfer of the toner image from the image-bearing member can be an intermediate transfer member, such as a transfer drum.

In the present invention, it is preferred to adopt a contact transfer step wherein a toner image on the image-bearing member is transferred onto a transfer(-receiving) material while abutting a transfer(-promoting) member against the image-bearing member via the transfer material, and the abutting pressure of the transfer member may preferably be a linear pressure of at least 2.9 N/m (3 g/cm), more preferably at least 19.6 N/m (20 g/cm). If the abutting pressure is below 2.9 N/m, difficulties, such as deviation in conveyance of the transfer material and transfer failure, are liable to occur.

Figure 4:
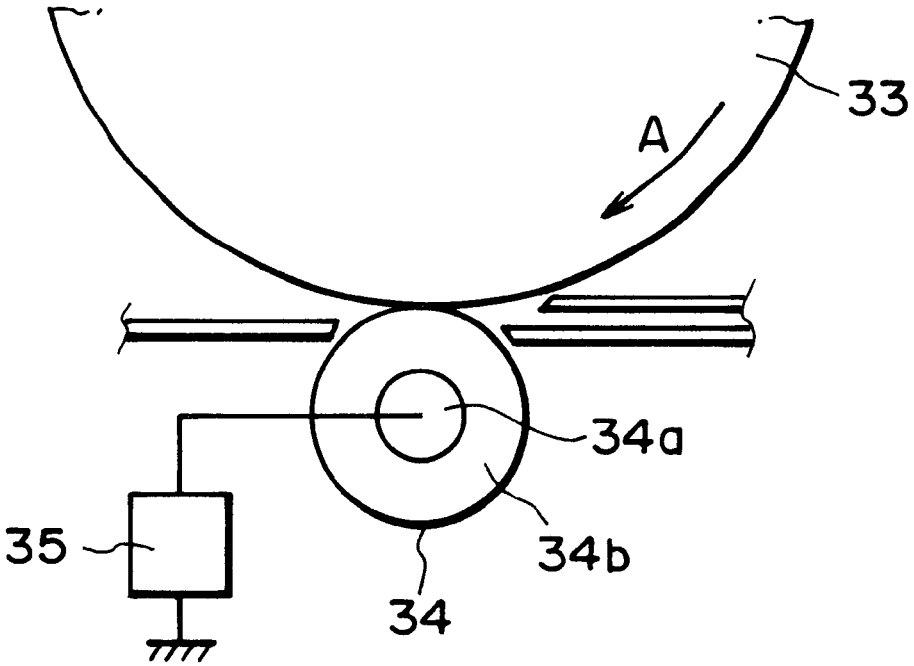
FIG. 4 illustrates an organization of a contact transfer member used in the image forming apparatus of the invention.

The transfer member used in the contact transfer step may preferably be a transfer roller as illustrated in FIG. 4 or a transfer belt. Referring to FIG. 4, a transfer roller 34 may comprise a core metal 34*a* and a conductive elastic layer 34*b* coating the core metal 34*a* and is abutted against a photosensitive member 33 so as to be rotated following the rotation of the photosensitive member 33 rotated in an indicated arrow A direction. The conductive elastic layer 34*b* may comprise an elastic material, such as polyurethane rubber or ethylene-propylene-diene rubber (EPDM), and an electroconductivity-imparting agent, such as carbon black, dispersed in the elastic material so as to provide a medium level of electrical resistivity (volume resistivity) of $1\times10^{6}$–$1\times10^{10}$ ohm.cm. The conductive elastic layer may be formed as a solid or foam rubber layer. The transfer roller 34 is supplied with a transfer bias voltage from a transfer bias voltage supply.

The image forming method according to the present invention is particularly effective in the case where such a contact transfer step is applied to a photosensitive member having a surface layer comprising a organic compound wherein the photosensitive member is liable to exhibit a stronger affinity with the binder resin of the toner particles than the other types of photosensitive member having an inorganic surface material, thus being liable to show a lower transferability.

The photosensitive member having organizations as mentioned above may also be used inclusive of various fine particles included in the surfacemost layer thereof in combination with such a contact transfer step.

The image forming method including such a contact transfer step may be particularly advantageously applicable to an image forming apparatus including a small-dia. photosensitive member having a diameter of at most 50 mm as an electrostatic latent image-bearing member. More specifically, as no independent cleaning step is included after the transfer step and before the charging step, the latitude of arrangement of the charging, exposure, developing and transfer means is increased and is combined with use of such a small dia.-photosensitive member to realize a reduction in entire size and space for installment of an image forming apparatus. This is also effective for an image forming apparatus including a belt-form photosensitive member having a curvature radius at an abutting position of at most 25 mm.

The toner carrying member used in the present invention may preferably have a surface roughness (in terms of JIS center line-average surface roughness (Ra)) in the range of 0.2–3.5 $\mu$m.

If Ra is below 0.2 $\mu$m, the toner on the toner carrying member is liable to be charged excessively to have an insufficient developing performance. If Ra exceeds 3.5 $\mu$m, the toner coating layer on the toner-carrying member is liable to be accompanied with irregularities, thus resulting images with density irregularity. Ra is further preferably in the range of 0.5–3.0 $\mu$m.

More specifically, the surface roughness (Ra) values described herein are based on values measured as center line-average roughness values by using a surface roughness meter ("Surfcorder SE-3OH", available from K.K. Kosaka Kenkyusho) according to JIS B-0601. More specifically, based on a surface roughness curve obtained for a sample surface, a length of a is taken along a center line of the roughness curve. The roughness curve is represented by a function Y=f(x) while setting the X-axis on the center line and a roughness scale (y) on the Y-axis along the length x portion. A center line-average roughness Ra of the roughness curve is determined by the following formula (VII):

$$Ra = (1/a) \cdot \int_0^a |f(x)| dx. \quad \text{(VII)}$$

The toner-carrying member may be provided with a surface roughness Ra in the above-mentioned range, e.g., by adjusting an abrasion state of the surface layer. More specifically, a coarse abrasion of the toner-carrying member surface provides a larger roughness, and a finer abrasion provides a smaller roughness.

It is also possible to adjust the surface roughness by forming a surface layer of a resin as described hereinafter together with fine particles dispersed therein while controlling the particle size and addition amount of the fine particles. The fine particles added for this purpose may include: electroconductive fine particles as mentioned below, and other organic and inorganic particles not completely soluble with the resin.

The toner-carrying member may preferably assume a form (generally called a "developing slave") which comprises an electroconductive cylinder, by itself or as a support, of a metal or alloy, such as aluminum or stainless steel. Such an electro-conductive cylinder can also be formed of a resin composition having sufficient mechanical strength and electroconductivity, or may be surfaced with an electroconductive rubber. Instead of a cylindrical shape as mentioned above, it is also possible to used a toner-carrying member in the form of the endless belt.

As the magnetic toner of the present invention has a high chargeability, it is desirable to control the total charge thereof for use in actual development, so that the toner-carrying member used in the present invention may preferably be surfaced with a resin layer containing electroconductive fine particles and/or lubricating particles dispersed therein.

The electroconductive fine particles dispersed in the coating resin layer of the toner-carrying member may preferably exhibit a resistivity of at most 0.5 ohm.cm as measured under a pressure of 14.7 MPa (120 kg/cm$^2$).

The electroconductive fine particles may preferably comprise carbon fine particles, crystalline graphite particles or a mixture of these, and may preferably have a particle size of 0.005–10 $\mu$m.

Examples of the resin constituting the surface layer of the developer-carrying member may include: thermoplastic resin, such as styrene resin, vinyl resin polyethersulfone resin, polycarbonate resin, polyphenylene oxide resin, polyamide resin, fluorine-containing resin, cellulose resin, and acrylic resin; thermosetting resins, such as epoxy resin, polyester resin, alkyd resin, phenolic resin, urea resin, silicone resin and polyimide resin; an thermosetting resins.

Among the above, it is preferred to use a resin showing a releasability, such as silicone resin or fluorine-containing resin; or a resin having excellent mechanical properties, such as polyethersulfone, polycarbonate, polyphenylene oxide, polyamide, phenolic resin, polyester, polyurethane resin or styrene resin. Phenolic resin is particularly preferred.

The electroconductive fine particles may preferably be used in 3–20 wt. parts per 10 wt. parts of the resin. In the case of using a mixture of carbon particles and graphite particles, the carbon particles may preferably be used in 1 to 50 wt. parts per 10 wt. parts of the graphite particles.

The coating layer containing the electro-conductive fine particles of the toner-carrying member may preferably have a volume resistivity of $1\times10^{-6}$ to $1\times10^{6}$ ohm.cm.

In the developing step, it is preferred to form a toner layer at a coating rate of 5–50 g/m$^2$ on the toner-carrying member. If the coating rate is below 5 g/m$^2$ on the toner-carrying member, it is difficult to obtain a sufficient image density and a toner layer irregularity is liable to be formed due to an excessive toner charge. If the toner coating rate exceeds 50 g/m$^2$, toner scattering is liable to occur.

In the present invention, it is particularly preferred that the toner coating rate is controlled by a regulating member which is disposed above the toner-carrying member and abutted against the toner-carrying member via the toner carried thereon, so as to provide the toner with a uniform turboelectric charge which is less liable to be affected in changes in environmental conditions and is thus less liable to cause toner scattering.

The toner layer thickness-regulating member may preferably comprise an elastic member so as to uniformly charge the magnetic toner.

In the developing region, the toner-carrying member and the photosensitive member are disposed opposite to each other with a certain gap therebetween. In order to obtain fog-free high-quality images, it is preferred to apply the magnetic toner in a layer thickness, which is smaller than the closest gap between the toner-carrying member and the photosensitive member, on the toner-carrying member and effect the development under application of an alternating voltage. The small toner layer thickness on the toner-carrying member may be achieved by the action of the toner layer thickness-regulating member. Thus, the development is effected in a state of no contact between the toner layer on the toner-carrying member and the photosensitive member (image-bearing member) in the developing region. As a result, it is possible to obviate development fog caused by injection of the developing bias voltage to the image-bearing member even if electroconductive fine power having a low resistivity is added into the toner.

More specifically, it is preferred that the toner-carrying member is disposed with a spacing of 100–1000 $\mu$m from the image-bearing member. If the spacing is below 100 $\mu$m, the developing performance with the toner is liable to be fluctuated depending on a fluctuation of the spacing, so that it becomes difficult to mass-produce image-forming apparatus satisfying stable image qualities. If the spacing exceeds 100 $\mu$m, the followability of toner onto the latent image on the image-bearing member is lowered, thus being liable to cause image quality lowering, such as lower resolution and lower image density. A spacing of 120–500 $\mu$m is further preferred.

In the present invention, the toner-carrying member surface may be moved in a direction which is identical to or opposite to the moving direction of the image-bearing member surface at the developing section. In the case of movement in the identical direction, the toner-carrying member may preferably be moved at a surface velocity which is at least 0.7 times the image-bearing member. Below 0.7 times, the image quality can be lowered in some cases. A higher surface speed ratio supplies a larger amount of toner to the developing section, thus increasing the frequency of attachment onto and returning from the latent image on the image-bearing member of the toner, i.e., more frequent repetition of removal from an unnecessary part and attachment onto a necessary part of the toner, to provide a toner image more faithful to a latent image. On the other hand, a surface speed ratio of at most 7 times is practical because of mechanical restriction. A surface speed ratio of 1.05–3.00 between the toner-carrying member and the image-bearing member is further preferred.

In the present invention, it is preferred to operate the developing step under application of an alternating electric field (AC electric field) between the toner-carrying member and the image-bearing member. The alternating developing bias voltage may be a superposition of a DC voltage with an alternating voltage (AC voltage).

The alternating bias voltage may have a waveform which may be a sine wave, a rectangular wave, a triangular wave, etc., as appropriately be selected. It is also possible to use pulse voltages formed by periodically turning on and off a DC power supply. Thus, it is possible to use an alternating voltage waveform having periodically changing voltage values.

It is preferred to form an AC electric field at a peak-to-peak intensity of $3\times10^6$–$10\times10^6$ V/m and a frequency of 100 to 5000 Hz between the toner-carrying member and the image-bearing member by applying a developing bias voltage.

If the AC electric field strength is below $3\times10^6$ V/m, the performance of recovery of transfer-residual toner is lowered, thus being liable to result in foggy images. Further, because of a lower developing ability, images having a lower density are liable to be formed. On the other hand, if the AC electric field exceeds $1\times10^7$ V/m, too large a developing ability is liable to result in a lower resolution because of collapsion of thin lines and image quality deterioration due to increased fog, a lowering in chargeability of the image-bearing member and image defects due to leakage of the developing bias voltage to the image-bearing member. If the frequency of the AC electric field is below 100 Hz, the frequency of toner attachment onto and toner removal from the latent image is lowered and the recovery of transfer-residual toner is liable to be lowered, thus being liable to result in a lower developing performance. If the frequency exceeds 5000 Hz, the amount of toner following the electric field change is lowered, thus being liable to result in a lowering in transfer-residual toner recovery and a lowering in developing performance.

The magnetization of the toner in a magnetic field of 79.6 kA/m is defined in the present invention for the following reason. Ordinarily, a magnetization at a saturated magnetism (i.e., a saturation magnetization) is used as a parameter for representing a magnetic property of a magnetic material, but a magnetization (intensity) of the magnetic toner in a magnetic field actually acting on the magnetic toner in the image forming apparatus is a more important factor in the present invention. In the case where a magnetic toner is used in an image forming apparatus, the magnetic field acting on the toner is on the order of several tens to a hundred and several tens kA/m in most commercially available image forming apparatus so as not to leak a large magnetic field out of the apparatus or suppress the cost of the magnetic field source. For this reason, a magnetic field of 79.6 kA/m (1000 oersted) is taken as a representative of magnetic field actually acting on a magnetic toner in the image forming apparatus to determine a magnetization at a magnetic field of 79.6 kA/m.

In order to obtain such a magnetic toner, a magnetic material is incorporated in the toner particles.

If the magnetization at a magnetic field of 79.6 kA/m of the toner is below 10 $Am^2/kg$(emu/g), it becomes difficult to convey the toner by means of a magnetic force and difficult to have the toner carrying member uniformly carry the toner. In case where the magnetization at a magnetic field of 79.6 kA/m is above 50 $Am^2/kg$(emu/g), the amount of magnetic powder contained in toner particles is liable to be excessively increased to result in a lower fixability.

In the present invention, it is preferred that the latent image forming step of writing image data onto a charged surface of an image-bearing member is a step of subjecting the charged surface of the image-bearing member to imagewise exposure for writing the image data, and the latent image-forming means is an imagewise exposure means. The imagewise exposure means for electrostatic latent image formation is not restricted to a laser scanning exposure means for forming digital latent image formation, but may also be an ordinary analog imagewise exposure means or those using other types of light emission devices, such as LED, or a combination of a light emission device such as a fluorescent lamp and a liquid crystal shutter, etc. Thus, any imagewise exposure means capable of forming electrostatic latent images corresponding to image data can be used.

The image-bearing member can also be an electrostatic recording dielectric member. In this case, the dielectric surface as an image-bearing surface may be primarily uniformly charged to a prescribed potential of a prescribed polarity and then subjected to selective charge removal by charge removal means, such as a charge-removal stylus head or an electron gun, to write in objective electrostatic latent image.

The magnetic powder used in the magnetic toner of the present invention has a uniform particle size distribution so that the magnetic powder is uniformly and well dispersed in the toner particles. Further, the toner particles have uniform shape and surface property. As a result, the individual toner particles have uniform charging speed and charge distribution, to result in few transfer-residual toner. Accordingly, when the magnetic toner of the present invention is used in the above-mentioned image forming method and image forming apparatus, the transfer-residual toner becomes smaller in amount, and the small amount of transfer-residual toner is quickly charged when passing through the charging section to be quickly recovered by the toner-carrying member or used for development. Moreover, because of the shape characteristic, the attachability of electroconductive fine powder onto the toner particles can be adequately controlled easily, so that the electroconductive fine powder can be effectively supplied to the charging section.

<5> Process Cartridge

The process cartridge of the present invention is constituted so as to be detachably mountable to a main assembly of the image forming apparatus of the present invention includes at least one of the image-bearing member and the charging means integrally supported together with the developing means. Such a process cartridge, similarly as the conventional one, may be constituted by supporting the above-mentioned selected means by a supporting member, such as a resinous frame, at prescribed process positions, and the resultant process cartridge may be mounted to a main assembly of the image forming apparatus along a guide means, such as rails.

The developing means constituting the process cartridge may include a toner, a toner vessel and a toner-carrying member which are preferably those described above.

As the developing means is included in a detachably mountable process cartridge, even when some of the charging means, the photosensitive member and the toner reach their end of life, only the relevant means or members are exchanged to provide an entirely operable apparatus without wasting still usable members.

Hereinbelow, the present invention will be more specifically described based on Production Examples an Examples, which should not be construed to restrict the scope of the present invention in any way.

A. Production of Magnetic Powder

Surface-treated magnetic powders 1–8 were prepared in the following manner.

Surface-treated Magnetic Powder 1

Into a ferrous sulfate aqueous solution, an aqueous solution of caustic soda in an amount of 1.0–1.1 equivalent of the iron of the ferrous sulfate, sodium hexametaphosphate containing 1.0 wt. % based on the iron of phosphorus and sodium silicate containing 1.0 wt. % based on the iron of silicon, were added and mixed therewith to form an aqueous solution containing ferrous hydroxide. While maintaining the pH of the aqueous solution at around 13, air was blown thereinto to cause oxidation at 80–90° C. Magnetic iron oxide particles formed after the oxidation was washed and once recovered by filtration. A portion of the moisture-containing product was taken out to measure a moisture content. Then, the remaining water-containing product, without drying, was re-dispersed in another aqueous medium, and the pH of the re-dispersion liquid was adjusted to ca. 6. Then, into the dispersion liquid under sufficient stirring, a silane coupling agent ($n—C_{10}H_{21}Si(OCH_3)_3$) in an amount of 1.0 wt. % of the magnetic iron oxide (calculated by subtracting the moisture content from the water-containing product magnetic iron oxide) was added to effect a coupling treatment for hydrophobization. The thus-hydrophobized magnetic iron oxide particles were washed, filtrated and dried in ordinary manners, followed further by disintegration of slightly agglomerated particles, to obtain Surface-treated magnetic powder 1, of which the physical properties are shown in Table 1 appearing hereinafter together with those of Surface-treated magnetic powders 2–8 prepared in the following manners.

Surface-treated Magnetic Powder 2

Surface-treated magnetic powder 2 was prepared in a similar manner as Surface-treated magnetic powder 1 except for changing the air blowing rate for the oxidation.

Surface-treated Magnetic Powder 3

Surface-treated magnetic powder 3 was prepared in a similar manner as Surface-treated magnetic powder 1 except for changing the coupling agent to $n—C_6H_{13}Si(OCH_3)_3$.

Surface-treated Magnetic Powder 4

Surface-treated magnetic powder 4 was prepared in a similar manner as Surface-treated magnetic powder 1 except for reducing the amount of the silane coupling agent to 0.2 wt. part.

Surface-treated Magnetic Powder 5

Into a ferrous sulfate aqueous solution, an aqueous solution of caustic soda in an amount of 1.0–1.1 equivalent of the iron of the ferrous sulfate, sodium hexametaphosphate containing 1.0 wt. % based on the iron of phosphorus and sodium silicate containing 1.0 wt. % based on the iron of silicon, were added and mixed therewith to form an aqueous solution containing ferrous hydroxide. While maintaining the pH of the aqueous solution at around 8, air was blown thereinto to cause oxidation at 80–90° C., thereby forming a slurry of magnetic iron oxide particles. From the slurry, the magnetic iron oxide particles were once recovered, and without being dried, subjected to the wet coupling treatment in the same manner as the production of Surface-treated magnetic powder 1, thereby obtaining Surface-treated magnetic powder 5.

Surface-treated Magnetic Powder 6

Into a ferrous sulfate aqueous solution, an aqueous solution of caustic soda in an amount of 1.0–1.1 equivalent of the iron of the ferrous sulfate, was added to form an aqueous solution containing ferrous hydroxide. While retaining the pH of the aqueous solution at ca. 13, air was blown thereinto to cause oxidation at 80–90° C., thereby forming a slurry liquid containing seed crystals.

Then, into the slurry liquid, a ferrous sulfate aqueous solution was added in an amount of 0.9–1.2 equivalent with respect to the initially added alkali (sodium in the caustic soda), and air was blown thereinto to proceed with the oxidation while maintaining the slurry at pH 8. Then, the magnetic iron oxide particles was washed, recovered by filtration and dried without surface treatment, followed by disintegration of the agglomerated particles to obtain untreated magnetic powder. Then, the untreated magnetic powder was stirred within a Henschel mixer (made by Mitsui Miike Kakoki), and 0.2 wt. % based on the magnetic powder of a silane coupling agent ($n—C_{16}H_{13}Si(OCH_3)_3$), was added thereto to effect a dry surface treatment, thereby obtaining Surface-treated magnetic powder 6.

Surface-treated Magnetic Powder 7

The procedure for production of Surface-treated magnetic powder 1 was repeated up to the oxidation. Then, the magnetic iron oxide particles formed after the oxidation was washed, filtrated, and dried without surface treatment, followed by disintegration to obtain untreated magnetic powder. Then, the untreated magnetic powder was further subjected to dry-surface treatment with 0.2 wt. % thereof of the silane coupling agent ($n—C_6H_{13}Si(OCH_3)_3$) in the same manners as in the production of Surface-treated magnetic powder 6, thereby obtaining Surface-treated magnetic powder 7.

Surface-treated Magnetic Powder 8

Into a flask equipped with a stirrer, an inert gas intake pipe, a reflux condenser and a thermometer, 200 wt. parts of deionized water containing 0.1 wt. part of polyvinyl alcohol ("PVA-205", made by Kuraray K.K.) was charged. Then, a preliminarily prepared polymerizable monomer mixture of 97.5 wt. parts of styrene, 2.5 wt. parts of glycidyl methacrylate and 8 wt. parts of benzoyl peroxide was added to the water, and the system was stirred at a high speed to form a uniform suspension liquid. Then, while flowing in nitrogen, the system was heated to 80° C. and subjected to 5 hours of polymerization at that temperature under stirring. Thereafter, the polymerizate was recovered by filtration, washed with water and dried to obtain an epoxy group-containing resin.

On the other hand, the procedure for production of Surface-treated magnetic powder 1 was repeated up to the oxidation. Then, the magnetic iron oxide particles formed after the oxidation was washed, filtrated, and dried without surface treatment, followed by disintegration to obtain untreated magnetic powder. The untreated magnetic powder in 80 wt. parts and 20 wt. parts of the above-prepared epoxy group-containing resin were kneaded at 180° C. for 100 rpm by means of Plasto-mill for laboratory use to react the magnetic powder and the resin. The kneaded product, after cooling, was pulverized to obtain Surface-treated magnetic powder 8.

Magnetic properties of Surface-treated magnetic powders 1–8 are inclusively shown in the following Table 1.

TABLE 1

| Surface-treated magnetic powder | | |
|---|---|---|
| No. | σr ($Am^2/kg$) | σs ($Am^2/kg$) |
| 1 | 6.8 | 58 |
| 2 | " | " |
| 3 | " | " |
| 4 | " | " |
| 5 | 4.2 | 35 |
| 6 | 13 | 78 |
| 7 | 6.8 | 58 |
| 8 | 6.8 | 58 |

B. Production of Electroconductive Fine Powder

Electroconductive fine powders 1–5 were prepared in the following manner.

Electroconductive Fine Powder 1

Zinc oxide primary particles having a primary particle size of 0.1–0.3 μm were agglomerated under pressure to obtain Electroconductive fine powder 1, which was white in color, and exhibited a volume-average particle size (Dv) of 3.7 μm, a particle size distribution including 6.6% by volume of particles of 0.5 μm or smaller (V % (D≦0.5 μm)=6.6% by volume) and 8% by number of particles of 5 μm or laser (N % (D≧5 μm)=8% by number), and a resistivity (Rs) of 80 ohm.cm.

As a result of observation through a scanning electron microscope (SEM) at magnifications of $3\times10^3$ and $3\times10^{14}$, Electroconductive fine powder 1 was found to include zinc oxide primary particles of 0.1–0.3 μm in primary particle size and agglomerated particles of 1–10 μm.

Electroconductive fine powder 1 also exhibited a transmittance of a mono-particle densest layer with respect to light of 740 nm in wavelength ($T_{740}$ (%)) of ca. 35% as measured by a transmission densitometer ("310%", available from X-Rite K.K.).

Some representative properties of Electroconductive powder 1 are shown in Table 2 appearing hereinafter together with those of Electroconductive fine powders 2–5 prepared in the following manner.

Electroconductive Fine Powder 2

Electroconductive fine powder 1 was pneumatically classified to obtain Electroconductive fine powder 2,which exhibited Dv=2.4 μm, V % (D≦0.5 μm)=4.1% by volume, N % (D≧5 μm)=1% by number, Rs=440 ohm.cm and $T_{740}$ (%)=35%

As a result of the SEM observation, Electroconductive fine powder 2 was found to include zinc oxide primary particles of 0.1–0.3 μm in primary particle size and agglomerate particles of 1–5 μm, but the amount of the primary particles was reduced than in Electroconductive fine powder 1.

Electroconductive Fine Powder 3

Electroconductive fine powder 1 was pneumatically classified to obtain Electroconductive fine powder 3, which exhibited Dv=1.5 μm, V % (D≦0.5 μm)=35% by volume, N % (D≧5 μm)=0% by number, Rs=1500 ohm.cm and $T_{740}$ (%)=35%

As a result of the SEM observation, Electroconductive fine powder 3 was found to include zinc oxide primary particles of 0.1–0.3 μm in primary particle size and agglomerate particles of 1–4 μm, but the amount of the primary particles was increased than in Electroconductive powder 1.

Electroconductive Fine Powder 4

White zinc oxide fine particles were used as Electroconductive fine powder 4, which exhibited Dv=0.3 μm, V % (≦0.5 μm)=80% by volume, N % (≧5 μm)=0% by number, primary particle sizes (Dp)=0.1–0.3 μm, Rs=100 ohm.cm and $T_{740}$ (%)=35%.

As a result of the TEM observation, Electroconductive fine powder 4 was found to comprise zinc oxide primary particles of Dp=0.1–0.3 μm and contain little agglomerate particles.

Electroconductive Fine Powder 5

Aluminum borate powder surface-coated with antimony tin oxide and having Dv=2.8 μm was pneumatically classified to remove coarse particles, and then subjected to a repetition of dispersion in aqueous medium and filtration to remove fine particles to recover electroconductive fine powder 5, which was grayish-white electroconductive fine powder and exhibited Dv=3.2 μm, V % (D≦0.5 μm)=0.4% by volume, and N % (D≧5 μm)=1% by number.

Representative properties of electroconductive fine powders 1–5 are inclusively shown in Table 2 below.

TABLE 2

| | | Electroconductive fine powder | | | | |
|---|---|---|---|---|---|---|
| | | Particle size distribution | | | | |
| Name | Material* | Dv (μm) | V % (≦0.5μm) (% vol.) | N % (≧5μm) (%.Num.) | Rs (ohm.cm) | $T_{740}$ (%) |
| 1 | zinc oxide | 3.7 | 6.6 | 8 | 80 | 35 |
| 2 | " | 2.4 | 4.1 | 1 | 440 | 35 |
| 3 | " | 1.5 | 35 | 0 | 1500 | 35 |
| 4 | " | 0.3 | 80 | 0 | 100 | 35 |
| 5 | C.A.B. | 3.2 | 0.4 | 1 | 40 | — |

*"" represents the same as above.
C.A.B. means coated aluminum borate.

C. Production of Magnetic Toners

Magnetic Toner A

Into 292 wt. parts of deionized water, 46 wt. parts of 1.0 mol/l-$Na_3PO_4$ aqueous solution was added, and after heating to 80° C., 67 wt. parts of 1.0 mol/l-$CaCl_2$ aqueous solution was gradually added thereto, to form an aqueous medium containing

| | |
|---|---|
| Styrene | 77 wt. part(s) |
| Lauryl methacrylate | 23 wt. part(s) |
| Saturated polyester resin (peak molecular weight (Mp) = 11000, Tg = 69° C.) | 3 wt. part(s) |
| Azo metal complex (negative charge control agent) | 0.5 wt. part(s) |
| Surface-treated magnetic powder 1 | 100 wt. part(s) |

The above ingredients were sufficiently dispersed and mixed by an attritor (made by Mitsui Miike Kakoki K.K.) to form a monomeric mixture. The monomeric mixture was heated to 80° C., and 20 wt. parts of an ester wax having a DSC heat-absorption peak temperature (Tabs) of 70° C. and 8 wt. parts of t-butyl peroxy-2-ethylhexanoate (polymerization initiator) was added thereto and mixed with each other to form a polymerizable composition.

The polymerizable composition was charged into the above-prepared aqueous medium and stirred at 80° C. in an $N_2$ atmosphere for 10 min. at 10,000 rpm by a TK homomixer (made by Tokushu Kika Kogyo K.K.) to disperse the droplets of the polymerizable composition in the aqueous medium. Then, the system was further stirred by a paddle stirrer and subjected to 4 hours of reaction at 80° C., followed by addition of 4 wt. parts of anhydrous sodium carbonate and further 2 hours of reaction. The suspension liquid after the reaction showed pH 10.5, and after cooling, was subjected to the following operation on a conveyer belt filter ("Eagle Filter", made by Sumitomo Jukikai Kogyo K.K.).

The alkaline suspension liquid was first de-watered on the belt and then showered with totally 1000 wt. parts of water for washing to remove sodium 2-ethylhexanoate (possibly formed by neutralization with sodium carbonate of 2-ethylhexanoic acid by-produced by decomposition of t-butyl peroxy-2-ethylhexanoate used as the polymerization initiator). Then, the polymerizate was further washed with 1000 wt. parts of dilute hydrochloric acid (pH 1.0), washed with 1000 wt. parts of water and then de-watered on the belt to obtain magnetic toner particles substantially free from 2-ethylhexanoic acid and calcium phosphate used as the dispersing agent. The moisture-containing magnetic toner particles thus obtained were further dried to obtain Magnetic toner particles A having Dv=7.2 μm.

100 wt. parts of Magnetic toner particles A and 0.8 wt. part of hydrophobic silica fine powder having a number-average primary particle size (Dp1) of 9 nm successively surface-treated with hexamethyl-disilazane and silicone oil were blended in a Henschel mixer to obtain Magnetic toner A. Some representative properties of Magnetic toner A are shown in Tables 3 and 4 appearing hereinafter together with those of Magnetic toners B-R and BB prepared in the following manner.

Magnetic Toner B

Magnetic toner B was prepared in the same manner as Magnetic toner A except for using Surface-treated magnetic powder 2 instead of Surface-treated magnetic powder 1.

Magnetic Toner C

Magnetic toner C was prepared in the same manner as Magnetic toner A except for using Surface-treated magnetic powder 3 instead of Surface-treated magnetic powder 1.

Magnetic Toner D

Magnetic toner D was prepared in the same manner as Magnetic toner A except for using Surface-treated magnetic powder 4 instead of Surface-treated magnetic powder 1.

Magnetic Toner E

Magnetic toner E was prepared in the same manner as Magnetic toner A except for using Surface-treated magnetic powder 5 instead of Surface-treated magnetic powder 1.

Magnetic Toner F 100 wt. parts of Magnetic toner particles A and 0.8 wt. part of hydrophobic silica fine powder (Dp1=9 nm) treated with hexamethyldisilazane were blended in a Henschel mixer to obtain Magnetic toner F.

Magnetic Toner G

The process for preparation of Magnetic toner A was repeated up to the high-speed stirring by the TK-homomixer to disperse the droplets of the polymerizable composition in the aqueous medium. Then, the system was further stirred by a paddle mixer and subjected to 6 hours of reaction at 80° C. The suspension liquid after the reaction showed pH 9.5. After the reaction, the alkaline suspension liquid was cooled and acidified to pH 1.0 by addition of dilute hydrochloric acid. Thereafter, the suspension liquid was subjected to filtration and washing with water on the conveyer belt filter, followed by drying to obtain Magnetic toner particles G exhibiting Dv=7.3 μm.

100 wt. parts of Magnetic toner particles G and 0.8 wt. part of the hydrophobic silica fine powder (treated with hexamethyldisilazane and silicone oil) used in production of Magnetic toner A were blended in a Henschel mixer to obtain Magnetic toner G.

Magnetic Toner H

The process for preparation of Magnetic toner G was repeated up to the 6 hours of reaction at 80° C. The alkaline suspension liquid (pH 9.5) was cooled and subjected to suction filtration through a Buchner funnel, followed by washing of the polymerizate particles with 100 wt. parts of water. Then, the polymerizate particles were re-dispersed in dilute hydrochloric acid of pH 1.0 and stirred therein for 1 hour. The slurry was further subjected to suction filtration through a Buchner funnel, and the polymerizate particles were sufficiently washed with water and then dried to obtain Magnetic toner particles H exhibiting Dv=7.0 $\mu$m.

100 wt. parts of Magnetic toner particles H and 0.8 wt. part of the hydrophobic silica fine powder (treated with hexamethyldisilazane and silicone oil) used in production of Magnetic toner A were blended in a Henschel mixer to obtain magnetic toner H.

Magnetic Toner I

Magnetic toner I was prepared in the same manner as Magnetic toner H except for using 200 wt. parts of alkaline aqueous solution (pH=11.0) instead of 100 wt. parts of water for washing the polymerizate particles.

Magnetic Toner J

Magnetic toner J was prepared in the same manner as Magnetic toner A except for increasing the amount of the ester wax to 51 wt. parts.

Magnetic Toner K

Magnetic toner K was prepared in the same manner as Magnetic toner A except for reducing the amount of the ester wax to 0.4 wt. part.

Magnetic toner L

Magnetic toner L was prepared in the same manner as Magnetic toner A except for using 20 wt. parts of low-molecular weight polyethylene wax (Tabs.=120° C.) instead of the ester wax.

Magnetic toner M

Magnetic toner M was prepared in the same manner as Magnetic toner A except for using 50 wt. parts of Surface-treated magnetic powder 2 instead of Surface-treated magnetic powder 1.

Magnetic Toner N

Magnetic toner N was prepared in the same manner as Magnetic toner A except for using 150 wt. parts of Surface-treated magnetic powder 2 instead of Surface-treated magnetic powder 1.

Magnetic Toner O

The aqueous dispersion medium containing $Ca_3(PO_4)_2$ and the monomeric mixture were prepared in the same manner as in the production of Magnetic toner A.

The monomeric mixture was heated to 60° C., and 20 wt. parts of the ester wax (Tabs.=70° C.) and 7 wt. parts of t-butyl peroxyneodecanoate (polymerization initiator) were added thereto and mixed with each other to form a polymerizable composition.

The polymerizable composition was charged into the above-prepared aqueous medium and stirred at 60° C. in an $N_2$ atmosphere for 10 min. at 10,000 rpm by a TK homomixer (made by Tokushu Kika Kogyo K.K.) to disperse the droplets of the polymerizable composition in the aqueous medium. Then, the system was further stirred by a paddle stirrer and subjected to 4 hours of reaction at 60° C., followed by addition of 4 wt. parts of anhydrous sodium carbonate and further 2 hours of reaction at 80° C. The suspension liquid after the reaction showed pH 10.5, and after cooling, was subjected to the following operation within a filter press (made by Kurita Kikai Seisakusho K.K.).

The alkaline suspension liquid was first introduced into the filter press to recover the polymerizate particles by filtration, and then the particles were washed with totally 1000 wt. parts of water poured into the filter frame so as to remove sodium neodecanoate (possibly formed by neutralization with sodium carbonate of neodecanoic acid by-produced by decomposition of t-butyl peroxyneodecanoate used as the polymerization initiator). Then, dilute hydrochloric acid of pH 1.0 was poured into the filter frame to dissolve and remove the calcium phosphate attached to the toner particle surfaces. Then, water was sufficiently poured into the filter frame to sufficiently wash the toner particles. Thereafter, the toner particles were pressed and de-watered by air blowing to obtain toner particles substantially free from neodecanoic acid and calcium phosphate used as the dispersing agent. The moisture-containing toner particles were then dried to obtain Magnetic toner particles O having Dv 7.1 $\mu$m.

100 wt. parts of Magnetic toner particles O and 0.8 wt. part of the hydrophobic silica fine powder (treated with hexamethyldisilazane and silicone oil) used in production of Magnetic toner A were blended in a Henschel mixer to obtain Magnetic toner O.

Magnetic Toner P

Magnetic toner P was prepared in the same manner as Magnetic toner A except for using 7 wt. parts of t-butyl peroxypivalate (polymerization initiator) instead of t-butyl peroxy-2-ethylhexanoate and using 70° C. as the polymerization temperature instead of 80° C.

Magnetic Toner Q

Magnetic toner Q was prepared in the same manner as Magnetic toner A except for using 8 wt. parts of benzoyl peroxide (polymerization initiator) instead of t-butyl peroxy-2-ethylhexanoate.

Magnetic Toner R

Magnetic toner R was prepared in the same manner as Magnetic toner A except for using 10 wt. parts of lauroyl peroxide (polymerization initiator) instead of t-butyl peroxy-2-ethylhexanoate.

Magnetic Toner BB

Magnetic toner BB was prepared in the same manner as Magnetic toner A except for using an ester wax (Tabs=65° C.) instead of the ester wax (Tabs-70° C.).

Some representative properties of Magnetic toners A-R and BB prepared above are inclusively shown in Tables 3 and 4 appearing hereinafter.

Magnetic Toner S (Comparative)

Into 292 wt. parts of deionized water, 46 wt. parts of 1.0 mol/l—$Na_3PO_4$ aqueous was added, and after heating at 80°

C., 67 wt. parts of 1.0 mol/l-$CaCl_2$ aqueous solution was gradually added thereto, to form an aqueous medium containing $Ca_3(PO_4)_2$.

| | |
|---|---|
| Styrene | 65 wt. part(s) |
| 2-Ethylhexyl acrylate | 35 wt. part(s) |
| Saturated polyester resin (Mp = 11000, Tg = 69° C.) | 10 wt. part(s) |
| Azo metal complex (negative charge control agent) | 0.5 wt. part(s) |
| Surface-treated magnetic powder 1 | 120 wt. part(s) |

The above ingredients were sufficiently dispersed and mixed by an attritor (made by Mitsui Miike Kakoki K.K.) to form a monomeric mixture. The monomeric mixture was heated to 60° C., and 20 wt. parts of an ester wax (Tabs.=70° C.) and 7 wt. parts of t-butyl peroxyneodecanoate (polymerization initiator) was added thereto and mixed with each other to form a polymerizable composition.

The polymerizable composition was charged into the above-prepared aqueous medium and stirred at 60° C. in an $N_2$ atmosphere for 10 min. at 10,000 rpm by a TK homomixer (made by Tokushu Kika Kogyo K.K.) to disperse the droplets of the polymerizable composition in the aqueous medium. Then, the system was further stirred by a paddle stirrer and subjected to 6 hours of reaction at 60° C. to form a slurry containing precursor particles, which was cooled to room temperature.

Into the slurry containing the precursor particles, 40.7 wt. parts of an aqueous emulsion prepared by mixing 13.0 wt. parts of styrene, 7.0 wt. parts of 2-ethylhexyl acrylate, 0.4 wt. part of t-butyl peroxyneodecanoate, 0.1 wt. part of sodium laurylsulfate and 20 wt. parts of water by means of an ultrasonic oscillator was added dropwise to swell the precursor particles.

Thereafter, while being stirred under a nitrogen atmosphere, the system was heated to 80° C. and reacted at 80° C. for 4 hours, followed by addition of 4 wt. parts of anhydrous sodium carbonate and further 2 hours of continued reaction at 80° C. The suspension liquid after the reaction showed pH 10.5, and after cooling, was subjected to the same post treatment as in the preparation of Magnetic toner A to obtain Magnetic toner particles S.

100 wt. parts of Magnetic toner particles S and 0.8 wt. part of the hydrophobic silica fine powder (treated with hexamethyldisilazane and silicone oil) used in production of Magnetic toner A were blended in a Henschel mixer to obtain Magnetic toner S.

Some representative properties of Magnetic toner S are shown in Tables 5 and 6 appearing hereinafter together with those of the magnetic toners prepared in the following manner.

Magnetic Toner T (Comparative)

Magnetic toner T was prepared in the same manner as Magnetic toner G except for using Surface-treated magnetic powder 6 instead of Surface-treated magnetic powder 1.

Magnetic Toner U (Comparative)

Magnetic toner U was prepared in the same manner as Magnetic toner G except for using Surface-treated magnetic powder 7 instead of Surface-treated magnetic powder 1.

Magnetic Toner V (Comparative)

Magnetic toner V was prepared in the same manner as Magnetic toner G except for using Surface-treated magnetic powder 8 instead of Surface-treated magnetic powder 1.

Magnetic Toner W (Comparative)

Magnetic toner W was prepared in the same manner as Magnetic toner G except for using 15 wt. parts of 2,2'-azobis (2,4-dimethylvaleronitrile) (polymerization initiator) instead of t-butyl peroxy-2-ethylhexanoate and using Surface-treated magnetic powder 6 instead of Surface-treated magnetic powder 1.

Magnetic Toner X (Comparative)

Magnetic toner X was prepared in the same manner as Magnetic toner W except for using Surface-treated magnetic powder 7 instead of Surface-treated magnetic powder 6.

Magnetic Toner Y (Comparative)

The aqueous dispersion medium containing $Ca_3(PO_4)_2$ and the monomeric mixture were prepared in the same manner as in the production of Magnetic toner A except for using 730 wt. parts of deionized water instead of 292 wt. parts of deionized water, and using Surface-treated magnetic powder 6 instead of Surface-treated magnetic powder 1.

The monomeric mixture was heated to 60° C., and 20 wt. parts of the ester wax (Tabs.=70° C.) and 15 wt. parts of 2,2'-azobis(2,4-dimethylvaleronitrile) (polymerization initiator) were added thereto and mixed with each other to form a polymerizable composition.

The polymerizable composition was charged into the above-prepared aqueous medium and stirred at 60° C. in an $N_2$ atmosphere for 10 min. at 10,000 rpm by a TK homomixer (made by Tokushu Kika Kogyo K.K.) to disperse the droplets of the polymerizable composition in the aqueous medium. Then, the system was further stirred by a paddle stirrer and subjected to 3 hours of reaction at 60° C. and further 7 hours of reaction at 80° C.

Then, the suspension liquid was cooled, and a mixture of the following ingredients was added dropwise through a metering pump and caused to be adsorbed by the polymerizate particles in the suspension liquid.

| | |
|---|---|
| Styrene | 45 wt. parts |
| Stearyl methacrylate | 5 wt. parts |
| Bis(t-butylperoxy)hexane | 4 wt. parts |

Thereafter, the system was heated to 70° C. and held at that temperature for 10 hours for the reaction. After the reaction, the suspension liquid was cooled, and dilute hydrochloric acid was added thereto to provide pH 1.0. Thereafter, the polymerizate was recovered by filtration, and dried to obtain Magnetic toner particles Y having Dv=7.8 $\mu$m.

100 wt. parts of Magnetic toner particles Y and 0.8 wt. part of the hydrophobic silica fine powder (treated with hexamethyldisilazane and silicone oil) used in production of Magnetic toner A were blended in a Henschel mixer to obtain Magnetic toner Y (comparative).

Magnetic Toner Z (Comparative)

Into 100 wt. parts of water containing 3 wt. parts of emulsifying agents (1 wt. part of "Emulgen 950", made by Kao K.K., and 2 wt. parts of "Neogen R", made by Daiichi Kogyo Seiyaku K.K.), the following ingredients were added.

| | |
|---|---|
| Styrene | 76 wt. parts |
| n-Butyl acrylate | 20 wt. parts |
| Acrylic acid | 4 wt. parts |

Further, 5 wt. parts of potassium persulfate was added as a catalyst, and polymerization was effected for 8 hours at 70° C. under stirring to obtain an acid polar group-containing resin emulsion having a solid content of 50%.

| | |
|---|---|
| The above resin emulsion | 200 wt. part(s) |
| Surface-treated magnetic powder 6 | 100 wt. part(s) |
| Ester wax (Tabs. = 70° C.) (The same as the one used in Production of Magnetic toner A) | 3 wt. part(s) |
| Azo metal complex (negative control agent) | 0.5 wt. part(s) |
| Water | 350 wt. part(s) |

The above mixer was held at 25° C. under stirring by a Disper. After ca. 2 hours of stirring, the dispersion liquid was heated to 60° C. and adjusted to pH 8.0 by addition of ammonia water. Then, the liquid was heated to 90° C. and held at that temperature for 5 hours to form polymerizate particles of ca. 8 μm. The dispersion liquid was cooled, and the polymerizate particles were recovered and washed with water to obtain Magnetic toner particles Z. As a result of observation through an electron microscope, Magnetic toner particles Z were found to be composed of associated particles of polymerizate particles and secondary particles of magnetic powder fine particles.

100 wt. parts of Magnetic toner particles Z and 0.8 wt. part of the hydrophobic silica fine powder (treated with hexamethyldisilazane and silicone oil) used in production of Magnetic toner A were blended in a Henschel mixer to obtain Magnetic toner Z.

Magnetic Toner AA (Comparative)

| | |
|---|---|
| Styrene/lauryl methacylate copolymer (77/23 by wt.) | 100 wt. part(s) |
| Saturated polyester resin (Mp = 11000, Tg = 69° C.) | 3 wt. part(s) |
| Azometal complex (negative charge control agent) | 0.5 wt. part(s) |
| Surface-treated magnetic powder 6 | 100 wt. part(s) |
| Ester wax (Tabs = 70° C., used in production of Magnetic toner A) | 20 wt. part(s) |

The above ingredients were blended by a blender, melt-kneaded by a twin-screw extruder heated at 140° C. The kneaded product, after cooling, was coarsely crushed by a hammer mill and then finely pulverized by a turbo-mill (made by Turbo Kogyo K.K.), followed by pneumatic classification and a sphering treatment by means of an impingement-type surface-treatment apparatus at a temperature of 50° C. and a rotating blade peripheral speed of 90 m/sec to obtain Magnetic toner particles AA.

100 wt. parts of Magnetic toner particles AA and 0.8 wt. part of the hydrophobic silica fine powder (treated with hexamethyldisilazane and silicone oil) used in production of Magnetic toner A were blended in a Henschel mixer to obtain magnetic toner AA (comparative).

Some representative properties of the above-prepared Magnetic toners S-Z and AA (all for comparative purpose) are inclusively shown in Tables 5 and 6.

Some magnetic toners further containing electroconductive fine powder were prepared in the following manner.

Magnetic Toner a 100 wt. parts of Magnetic toner particles A, 0.8 wt. part of the hydrophobic silica fine powder (treated with hexamethyldisilazane and silicone oil) used in production of Magnetic toner A and 1.5 wt. parts of Electroconductive fine powder 1 were blended in a Henschel mixer to obtain Magnetic toner a.

Magnetic Toner b

Magnetic toner b was prepared in the same manner as Magnetic toner a except for using Electroconductive fine powder 2 instead of Electroconductive fine powder 1.

Magnetic Toner c

Magnetic toner c was prepared in the same manner as Magnetic toner a except for using Electroconductive fine powder 3 instead of Electroconductive fine powder 1.

Magnetic Toner d

Magnetic toner d was prepared in the same manner as Magnetic toner a except for using Electroconductive fine powder 4 instead of Electroconductive fine powder 1.

Magnetic Toner e

Magnetic toner e was prepared in the same manner as Magnetic toner a except for using Electroconductive fine powder 5 instead of Electroconductive fine powder 1.

Magnetic Toner f

Magnetic toner f was prepared in the same manner as Magnetic toner a except for using Magnetic toner particles B instead of Magnetic toner particles A.

Magnetic Toner g (Comparative)

Magnetic toner g was prepared in the same manner as Magnetic toner a except for using Magnetic toner particles T instead of Magnetic toner particles A.

Magnetic Toner h (Comparative)

Magnetic toner h was prepared in the same manner as Magnetic toner a except for using Magnetic toner particles W instead of Magnetic toner particles A.

Magnetic Toner i (Comparative)

Magnetic toner i was prepared in the same manner as Magnetic toner a except for using Magnetic toner particles X instead of Magnetic toner particles A.

Magnetic Toner j (Comparative)

Magnetic toner j was prepared in the same manner as Magnetic toner a except for using Magnetic toner particles AA instead of Magnetic toner particles A.

Some representative properties of the above-prepared Magnetic toners a–j containing electroconductive fine powder are inclusively shown in Tables 7 and 8.

In Tables 3, 5 and 7, the dispersion states of the magnetic powder dispersion in the toner particles were evaluated based on the pictures taken through a TEM (transmission electron microscope) in the same manner as described above with respect to the determination of the D/C ratio. The sample particle pictures having a particle size falling within D1±10% (D1: a number-average particle size of toner particles measured by using a Coulter counter) are selected for evaluation. On each sample particle picture, a circle (or a shape similar to the contour of a sample particle picture) with a diameter which is a half that of the sample particle picture is drawn. Thus, the drawn circle (or similar shape) has an area which is one fourth of that of the sample particle section. Then, the number of particles of ≧0.03 μm is counted on the particle picture section and is identified as a. Also the number of particles of ≧0.03 μm is counted within the similar shape of ¼ area and identified as b. A ratio b/a closer to ¼ represents a better dispersion state of the magnetic powder in the toner particles. Based on the b/a values, the magnetic powder dispersion is evaluated at three levels of A: good, B: fair and C:poor and indicated in Tables 3, 5 and 7.

TABLE 3

| Magnetic toner (1) | | | | | | | | | | | | | | | |
|---|---|---|---|---|---|---|---|---|---|---|---|---|---|---|---|
| | | Initiator | | | Magnetic toner | | | | Surface-treated magnetic powder | | | | | Magnetic powder | N % of D/C ≦ 0.02 |
| Toner | Process*1 | Species*2 | Amount (wt. parts) | $R_{STY}$ (ppm) | am*3 | af*3 | Dv (μm) | Kn | No. | Amount | σF*4 | σr | | dispersion | (%) |
| A | Poly | BPO-2-EH | 8 | 30 | 0.985 | 1.00 | 7.2 | 18 | 1 | 100 | 30 | 3.2 | | A | 88 |
| B | " | " | " | 35 | 0.986 | " | 7.1 | 21 | 2 | " | 36 | 5.2 | | A | 86 |
| C | " | " | " | 25 | 0.985 | " | 7.0 | 19 | 3 | " | 30 | 3.1 | | A | 87 |
| D | " | " | " | 33 | 0.987 | " | 7.5 | 27 | 4 | " | 30 | 3.2 | | B | 95 |
| E | " | " | " | 35 | 0.978 | " | 7.2 | 19 | 5 | " | 26 | 2.2 | | A | 88 |
| F | " | " | " | 30 | 0.985 | " | 7.2 | 18 | 1 | " | 30 | 3.2 | | A | 88 |
| G | " | " | " | 35 | 0.988 | " | 7.3 | 21 | 1 | " | 32 | 3.2 | | A | 87 |
| H | " | " | " | 40 | 0.988 | " | 7.0 | 20 | 1 | " | 30 | 3.2 | | A | 87 |
| I | " | " | " | 35 | 0.988 | " | 7.2 | 20 | 1 | " | 31 | 3.2 | | A | 87 |
| J | " | " | " | 40 | 0.985 | " | 7.0 | 24 | 1 | " | 31 | 3.2 | | A | 85 |
| K | " | " | " | 30 | 0.988 | " | 7.0 | 19 | 1 | " | 30 | 3.2 | | A | 90 |
| L | " | " | " | 35 | 0.985 | " | 7.9 | 23 | 1 | " | 30 | 3.2 | | A | 89 |
| M | " | " | " | 40 | 0.988 | " | 7.1 | 18 | 1 | 50 | 22 | 2.1 | | A | 78 |
| N | " | " | " | 45 | 0.988 | " | 6.8 | 19 | 2 | 150 | 44 | 7.8 | | A | 94 |
| O | " | BPO-ND | 7 | 48 | 0.987 | " | 7.1 | 19 | 1 | 100 | 28 | 3.1 | | A | 85 |
| P | " | BPO-PV | " | 50 | 0.988 | " | 7.5 | 22 | 1 | " | 29 | 3.2 | | A | 88 |
| Q | " | BPO | 8 | 50 | 0.988 | " | 7.5 | 22 | 1 | " | 30 | 3.1 | | A | 88 |
| R | " | LPO | 10 | 60 | 0.975 | " | 6.9 | 28 | 1 | " | 29 | 3.1 | | A | 86 |
| BB | " | BPO-2-EH | 8 | 27 | 0.986 | " | 7.3 | 19 | 1 | " | 30 | 3.2 | | A | 0 |

*1Poly = polymerization, Poly/seed = seed-polymerization
*2BPO-2-EH = t-butylperoxy-2-ethylhexanoate
BPO-ND = t-butyl peroxyneodecanoate
BPO-PV = t-butyl peroxypivalate
LPO = lauroyl peroxide
*3am = average circularity (–)
af = mode circuilarity (–)
*4σF = magnetization at 79.6 kA/m

TABLE 4

| Magnetic toner (2) | | | | | | | | | |
|---|---|---|---|---|---|---|---|---|---|
| | | Wax | | Carboxylic acid *1 | | Filtration | Solid in | Treated silica | |
| Toner | B/A | Tabs. (° C.) | Amount (wt. parts) | Species *2 | Content (ppm) | before acid addition | pmn. (wt. %) | Treating agent *3 | Amount (wt. parts) |
| A | 0.0001 | 70 | 20 | 2-EHA | 22 | effected (belt) | 33 | HDMS + S.O. | 0.8 |
| B | 0.0002 | " | " | " | 25 | " | " | HDMS + S.O. | 0.8 |
| C | 0.0001 | " | " | " | 31 | " | " | " | " |
| D | 0.0006 | " | " | " | 32 | " | " | " | " |
| E | 0.0002 | " | " | " | 30 | " | " | " | " |
| F | 0.0001 | " | " | " | 22 | " | " | HDMS | " |
| G | 0.0001 | " | " | " | 8380 | none | " | HDMS + S.O. | " |
| H | 0.0001 | " | " | " | 3540 | effected (sucking) | " | " | " |
| I | 0.0001 | " | " | " | 600 | " | " | " | " |
| J | 0.0001 | " | 51 | " | 25 | effected (belt) | 20 | " | " |
| K | 0.0004 | " | 0.4 | " | 35 | " | " | " | " |
| L | 0.0002 | 120 | 20 | " | 30 | " | " | " | " |
| M | 0.0001 | 70 | " | " | 30 | " | " | " | " |
| N | 0.0005 | " | " | " | 30 | " | " | " | " |
| O | 0.0002 | " | " | NDA | 20 | effected (press) | 33 | " | " |
| P | 0.0001 | " | " | PVA | 150 | effected (belt) | " | " | " |
| Q | 0.0001 | " | " | BA | 150 | " | " | " | " |

TABLE 4-continued

| Magnetic toner (2) | | | | | | | | | |
|---|---|---|---|---|---|---|---|---|---|
| | | Wax | | Carboxylic acid *1 | | Filtration | Solid in | Treated silica | |
| Toner | B/A | Tabs. (° C.) | Amount (wt. parts) | Species *2 | Content (ppm) | before acid addition | pmn. (wt. %) | Treating agent *3 | Amount (wt. parts) |
| R | 0.0002 | " | " | SA | 180 | " | " | " | " |
| BB | 0.0001 | 65 | " | 2-EHA | 26 | " | " | " | " |

*1 Carboxylic acid formed by decomposition of initiator.

*2 2-EHA = 2-ethylhexanoic acid

NDA = neodecanoic acid

BA = benzoic acid

*3 HDMS = hexamethyldisilazane

S.O. = silicone oil

TABLE 5

| Magnetic toner (1) | | | | | | | | | | | | | | |
|---|---|---|---|---|---|---|---|---|---|---|---|---|---|---|
| | | Initiator | | | | | | | Surface-treated | | | | Magnetic | N % of |
| | | | Amount | $R_{STY}$ | Magnetic toner | | | | magnetic powder | | | | powder | D/C ≦ 0.02 |
| Toner | Process*1 | Species*2 | (wt. parts) | (ppm) | am*3 | af*3 | Dv (μm) | Kn | No. | Amount | σF*4 | σr | dispersion | (%) |
| S | Poly/seed | BPO-ND | 7 | 130 | 0.970 | 1.00 | 5.4 | 36 | 6 | 100 | 30 | 3.3 | B | 0 |
| T | Poly | BPO-2-EH | 8 | 35 | 0.965 | " | 8.2 | 42 | 6 | " | 58 | 10.8 | C | 100 |
| U | " | " | " | 40 | 0.965 | " | 6.9 | 39 | 7 | " | 30 | 3.3 | C | 100 |
| V | " | " | " | 44 | 0.963 | " | 7.0 | 38 | 8 | " | 30 | 3.5 | C | 100 |
| W | " | ABDV | 15 | 3500 | 0.968 | " | 8.3 | 38 | 6 | " | 60 | 11.3 | C | 100 |
| X | " | " | " | 3300 | 0.967 | " | 8.2 | 37 | 7 | " | 32 | 3.5 | C | 100 |
| Y | Poly/seed | ABDV/ | 15 | 2600 | 0.965 | " | 7.8 | 39 | 6 | " | 60 | 11.1 | C | 0 |
| | | BPOH | 4 | | | | | | | | | | | |
| Z | A. Poly | PPS | 5 | 1200 | 0.967 | 0.95 | 8.3 | 28 | 6 | " | 60 | 12.1 | C | 100 |
| AA | PV/SP | — | — | — | 0.956 | 0.96 | 8.7 | 33 | 6 | " | 31 | 10.7 | B | 99 |

*1, *3 and *4Same as in Table 3

A. Poly = associated polymerization

Poly/seed: seed polymerization

PV/SP = pulverization followed by sphering

*2BPO-2-EH = t-butyl peroxy-2-ethylhexanoate

ABDV = 2,2'-azobis(2,4-dimethylvaleronitrile)

BPOH = bis(t-butylperoxy)hexane

PPS = potassium persulfate

TABLE 6

| Magnetic toner (2) | | | | | | | | | |
|---|---|---|---|---|---|---|---|---|---|
| | | Wax | | Carboxylic acid *1 | | Filtration | Solid in | Treated silica | |
| Toner | B/A | Tabs. (° C.) | Amount (wt. parts) | Species *2 | Content (ppm) | before acid addition | pmn. (wt. %) | Treating agent *3 | Amount (wt. parts) |
| S | 0.0000 | 70 | 20 | NDA | 120 | none | 20 | HDMS + S.O. | 0.8 |
| T | 0.0019 | " | " | 2-EHA | 8530 | " | " | " | " |
| U | 0.0018 | " | " | " | 8700 | " | " | " | " |
| V | 0.0020 | " | " | " | 8650 | " | " | " | " |
| W | 0.0022 | " | " | — | — | " | " | " | " |
| X | 0.0015 | " | " | — | — | " | " | " | " |
| Y | 0.0000 | " | " | — | — | " | — | " | " |
| Z | 0.0253 | " | " | — | — | — | — | " | " |
| AA | 0.0017 | " | " | — | — | — | — | " | " |

*1, *2, *3 Same as in Table 4.

TABLE 7

| Toner | Process*1 | Initiator Species*2 | Initiator Amount (wt. parts) | $R_{STY}$ (ppm) | Magnetic toner am*3 | Magnetic toner af*3 | Magnetic toner Dv (μm) | Magnetic toner Kn | Surface-treated magnetic powder No. | Surface-treated magnetic powder Amount | σF*4 | σr | Magnetic powder dispersion | N % of D/C ≦ 0.02 (%) |
|---|---|---|---|---|---|---|---|---|---|---|---|---|---|---|
| a | Poly | BPO-2-EH | 8 | 30 | 0.985 | 1.00 | 7.2 | 18 | 1 | 100 | 30 | 3.2 | A | 88 |
| b | " | " | " | " | " | " | " | " | 1 | " | 30 | " | " | " |
| c | " | " | " | " | " | " | " | " | 1 | " | 30 | " | " | " |
| d | " | " | " | " | " | " | " | " | 1 | " | 30 | " | " | " |
| e | " | " | " | " | " | " | " | " | 1 | " | 30 | " | " | " |
| f | " | " | " | 35 | 0.986 | " | 7.1 | 21 | 2 | " | 36 | 5.2 | A | 86 |
| g | " | " | " | " | 0.965 | " | 8.2 | 42 | 6 | " | 58 | 10.8 | C | 100 |
| h | " | ABDV | 15 | 3500 | 0.968 | " | 8.3 | 38 | 6 | " | 38 | 11.3 | C | 100 |
| i | Poly/seed | ABDV/ BPOH | 15 4 | 2600 | 0.965 | " | 7.8 | 39 | 6 | " | 32 | 11.1 | C | 0 |
| j | PV/SP | — | — | — | 0.956 | 0.96 | 8.7 | 33 | 6 | " | 31 | 10.7 | B | 99 |

*1, *3 and *4Same as in Table 3.
PV/SP = pulverization followed by sphering
*2Same as in Table 5

TABLE 8

| Toner | B/A | Wax Tabs. (° C.) | Wax Amount (wt. parts) | Carboxylic acid *1 Species *2 | Carboxylic acid *1 Content (ppm) | Filtration before acid addition | Solid in pmn. (wt. %) | Treated silica Treating agent *3 | Treated silica Amount (wt. parts) | EFP used*4 |
|---|---|---|---|---|---|---|---|---|---|---|
| a | 0.0001 | 70 | 20 | 2-EHA | 22 | effected (belt) | 33 | HDMS + S.O. | 0.8 | 1 |
| b | " | " | " | " | " | " | " | " | " | 2 |
| c | " | " | " | " | " | " | " | " | " | 3 |
| d | " | " | " | " | " | " | " | " | " | 4 |
| e | " | " | " | " | " | " | " | " | " | 5 |
| f | 0.0002 | " | " | " | 25 | " | " | " | " | 1 |
| g | 0.0019 | " | " | " | 8530 | none | 20 | " | " | 1 |
| h | 0.0022 | " | " | — | — | " | " | " | " | 1 |
| i | 0.0000 | " | " | — | — | " | — | " | " | 1 |
| j | 0.0017 | " | " | — | — | — | — | " | " | 1 |

*1, *2, *3 Same as in Table 4.
*4Electroconductive fine powder used.

D. Production of Photosensitive Members

Photosensitive Member A

Figure 3:
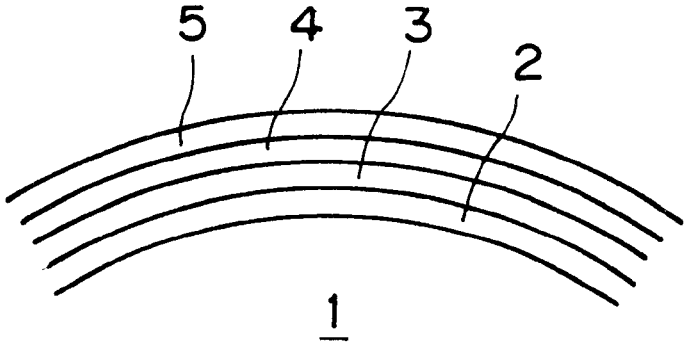
FIGS. 3 and 8 respectively illustrate a laminar structure of an image-bearing member used in the image forming apparatus of the invention.

Photosensitive member A having a laminar structure as shown in FIG. 3 was prepared by successively forming the following layers by dipping on a 30 mm-dia. aluminum cylinder support 1.

(1) First layer 2 was a 15 μm-thick electroconductive coating layer (electroconductive) layer, principally comprising phenolic resin with powder of tin oxide and titanium oxide dispersed therein.

(2) Second layer 3 was a 0.6 μm-thick undercoating layer comprising principally modified nylon and copolymer nylon.

(3) Third layer 4 was a 0.6 μm-thick charge generation layer comprising principally an azo pigment having an absorption peak in a long-wavelength region dispersed within butyral resin.

(4) Fourth layer was a 25 μm-thick charge transport layer comprising principally a hole-transporting triphenylamine compound dissolved in polycarbonate resin (having a molecular weight of $2\times10^4$ according to the Ostwald viscosity method) in a weight ratio of 8:10 and further containing 10 wt. % based on total solid of polytetrafluoroethylene powder (volume-average particle size (Dv)=0.2 μm) dispersed therein. The layer surface exhibited a contact angle with pure water of 95 deg. as measured by a contact angle meter ("CA-X", available from Kyowa Kaimen Kagaku K.K.).

EXAMPLE 1

An image forming apparatus having an organization generally as illustrated in FIG. 1 and obtained by remodeling a commercially available laser beam printer ("LBP-1760", made by Canon K.K.) was used.

As a photosensitive member 100 (image-bearing member), Photosensitive member A (organic photoconductive (OPC) drum) prepared above was used. The photosensitive member 100 was uniformly charged to a dark part potential (Vd) of −700 volts by applying a charging bias voltage comprising a superposition of a DC voltage of −700 volts and an AC of 2.0 kVpp from a charging roller 117 coated with electroconductive carbon-dispersed nylon abutted against the photosensitive member 100. The charged photosensitive member was then exposed at an image part to imagewise laser light 123 from a laser scanner 121 so as to provide a light-part potential ($V_L$) of −150 volts.

A developing sleeve 102 (toner-carrying member) was formed of a surface-blasted 18 mm-dia. aluminum cylinder coated with a ca. 7 μm-thick resin layer of the following composition exhibiting a roughness (JIS center line-average roughness Ra) of 1.1 μm. The developing sleeve 102 was equipped with a developing magnetic pole of 94 mT (940 Gauss) and a silicone rubber blade of 1.2 mm in thickness and 1.2 mm in free length as a toner layer thickness-regulating member. The developing sleeve 102 was disposed with a gap of 300 μm from the photosensitive member 100.

| | |
|---|---|
| Phenolic resin | 100 wt. parts |
| Graphite (Dv = ca. 7 μm) | 90 wt. parts |
| Carbon black | 10 wt. parts |

Then, a developing bias voltage of DC −450 volts superposed with an AC voltage of peak-to-peak 1600 volts and frequency of 2000 Hz was applied, and the developing sleeve was rotated at a peripheral speed of 77 mm/sec which was 110% of the photosensitive member peripheral speed (70 mm/sec) moved in identical directions.

A transfer roller 114 used was one identical to a roller 34 as shown in FIG. 4. More specifically, the transfer roller 34 had a core metal 34*a* and an electroconductive elastic layer 34*b* formed thereon comprising conductive carbon-dispersed ethylene-propylene rubber. The conductive elastic layer 34*b* exhibited a volume resistivity of $1\times10^8$ ohm.cm and a surface rubber hardness of 24 deg. The transfer roller 34 having a diameter of 20 mm was abutted against a photosensitive member 33 (photosensitive member 100 in FIG. 1) at a pressure of 59 N/m (60 g/cm) and rotated at an identical speed as that (70 mm/sec) of the photosensitive member 33 rotating in an indicated arrow A direction while being supplied with a transfer bias voltage of DC 1.5 kV.

A fixing device 126 was an oil-less heat-pressing type device for heating via a film (of "LBP-1760", unlike a roller-type one as illustrated). The pressure roller was one having a surface layer of fluorine-containing resin and a diameter of 30 mm. The fixing device was operated at a fixing temperature of 200° C. and a nip width set to 6 mm.

In this particular example (Example 1), Magnetic toner A was used for a print-out test on 5000 sheets operated in an intermittent mode (wherein an image pattern having only vertical lines at a print areal ratio of 7% was printed out while taking a pause period of 10 sec. for the developing device after printing on each sheet so as to promote the toner degradation by a provisional operation for re-starting of the developing device including toner stirring within the developing device. After printing on every 500 sheets, a solid black image pattern and a solid white image pattern were printed for test. Paper of 75 g/m$^2$ was used as the transfer (-receiving) material. The print-out test was performed in each of normal temperature/normal humidity environment (25° C./50% RH), high temperature/high humidity environment (32° C./85% RH) and low temperature/low humidity environment (15° C./15% RH). The evaluation was performed in the following manner.

Evaluation of Print-out Images

1) I.D. Change (Image Density Change)

The relative image densities of printed solid black images relative to corresponding printed solid white images on 500th and 5000th sheets were measured by a Macbeth reflection densitometer ("RD-918", available from Macbeth Co.), and evaluation was made based on a difference therebetween according to the following standard.

A: very good (difference<0.05)

B: good (difference=0.05 to below 0.10)

C: fair (difference=0.10 to below 0.20)

D: poor (difference≧0.20)

2) Image Quality

Image quality was evaluated overall and principally based on image uniformity of solid black image and thin line reproducibility according to the following standard.

A: Clear images with excellent thin line reproducibility and image uniformity.

B: Generally good images with slightly inferior thin line reproducibility and image uniformity.

C: Somewhat inferior images of practically no problem.

D: Practically unpreferable images with poor thin line reproducibility and image uniformity.

3) Fog Change

A toner image portion at a part just before the transfer step on the photosensitive member at the time of a solid white image formation was peeled off by applying and peeling a polyester adhesive tape, and the Macbeth image density of the peeled adhesive tape applied on white paper was measured relative to a blank of the adhesive tape on the paper and determined as a fog value. The above fog measurement was repeated at the time of formation of a solid white image on a 501th sheet and a 5001th sheet. The fog value on the 501th sheet was subtracted from that on the 5001th sheet to determine a fog difference, based on which the evaluation was made according to the following standard.

A: very good (fog difference<0.05)

B: good (fog difference=0.05 to below 0.15)

C: fair (fog difference=0.15 to below 0.30)

D: poor (fog difference≧0.30)

4) Transfer(ability)

Transfer-residual toner on the photosensitive member at the time of solid black image formation on a 1000th sheet was peeled off by applying and peeling a polyester adhesive tape, and the Macbeth image density of the peeled adhesive tape applied on white paper was measured relative to that of a blank of the adhesive tape applied on the paper to determine a transfer residue density difference (TRD difference), based on which evaluation was made according to the following standard.

A: very good (TRD difference<0.05)

B: good (TRD difference=0.05 to below 0.10)

C: fair (TRD difference=0.10 to below 0.20)

D: poor (TRD difference≧0.20)

Matching with Members of Image Forming Apparatus

1) Drum (Matching with Photosensitive Drum)

The photosensitive drum surface after the print-out test was evaluated by observation with eyes with respect to damages and sticking of transfer-residual toner together with influence of these on the printed images. Evaluation was performed according to the following standard.

A: Not observed at all.

B: Slight scars observed.

C: Sticking and scars observed.

D: Much sticking.

2) Blade (Matching with a Toner Layer Thickness-Regulation Blade)

After the print-out test, the silicone rubber blade (toner layer-thickness regulation member) was taken out of the developing device, and after being blown with air, the abutting portion thereof against the developing sleeve (toner-carrying member) was observed through a microscope with respect to toner sticking and damages.

A: Not observed at all.

B: Slight sticking observed.

C: Sticking and scars observed.

D: Much sticking.

The results of the evaluation in the three environments are shown in Tables 9–11, respectively together with those of the following Examples and Comparative Examples.

EXAMPLES 2–20

The print-out test and evaluation of Example 1 were repeated except for using Magnetic toners B–R, BB and a, respectively, instead of Magnetic toner A.

Comparative Examples 1–9

The print-out test and evaluation of Example 1 were repeated except for using Magnetic toners S–Z and AA.

TABLE 9

| Image formation in a normal temperature/normal humidity (25° C./50% RH) | | | | | | | |
|---|---|---|---|---|---|---|---|
| | | ID | Image | Fog | | Matching with | |
| Example | Toner | change | quality | change | Transfer | Drum | Blade |
| 1 | A | A | A | A | A | A | A |
| 2 | B | A | A | A | A | A | A |
| 3 | C | A | A | A | A | A | A |
| 4 | D | A | B | B | B | B | A |
| 5 | E | A | A | A | A | A | A |
| 6 | F | A | A | A | A | A | A |
| 7 | G | A | B | B | A | A | A |
| 8 | H | A | A | B | A | A | A |
| 9 | I | A | A | A | A | A | A |
| 10 | J | A | A | A | A | B | A |
| 11 | K | A | A | A | A | A | A |
| 12 | L | A | A | A | A | A | A |
| 13 | M | A | A | A | B | A | A |
| 14 | N | A | B | A | A | B | B |
| 15 | O | A | A | A | A | A | A |
| 16 | P | A | A | A | A | A | A |
| 17 | Q | A | A | A | A | A | A |
| 18 | R | A | A | A | A | A | A |
| 19 | BB | A | A | A | A | A | A |
| 20 | a | A | A | A | A | A | A |
| Comp. 1 | S | D | C | B | B | B | B |
| Comp. 2 | T | C | C | C | D | D | C |
| Comp. 3 | U | C | C | C | D | D | C |
| Comp. 4 | V | C | D | C | D | D | C |
| Comp. 5 | W | C | D | D | D | D | D |
| Comp. 6 | X | C | D | C | D | D | C |
| Comp. 7 | Y | D | D | D | D | D | D |
| Comp. 8 | Z | D | D | D | D | D | D |
| Comp. 9 | AA | D | D | D | D | D | D |

TABLE 10

| High temperature/high humidity (32° C./85% RH) | | | | | | | |
|---|---|---|---|---|---|---|---|
| | | ID | Image | Fog | | Matching with | |
| Example | Toner | change | quality | change | Transfer | Drum | Blade |
| 1 | A | A | A | A | A | A | A |
| 2 | B | B | B | B | B | B | B |
| 3 | C | A | A | A | A | A | A |
| 4 | D | B | B | B | B | B | A |
| 5 | E | A | A | A | A | A | A |
| 6 | F | A | B | A | B | A | A |
| 7 | G | B | B | B | A | A | A |
| 8 | H | B | A | B | A | A | A |
| 9 | I | B | A | A | A | A | A |
| 10 | J | A | A | A | B | B | B |
| 11 | K | A | B | A | A | A | A |
| 12 | L | A | B | A | B | B | B |
| 13 | M | A | B | A | B | A | A |
| 14 | N | C | B | B | B | B | B |
| 15 | O | A | A | A | A | A | A |
| 16 | P | A | A | A | A | A | A |
| 17 | Q | A | A | A | A | A | A |
| 18 | R | A | A | A | A | A | A |
| 19 | BB | A | A | A | A | A | A |
| 20 | a | A | A | A | A | A | A |
| Comp. 1 | S | C | D | C | B | B | B |
| Comp. 2 | T | C | D | C | D | D | C |
| Comp. 3 | U | C | C | C | D | D | C |
| Comp. 4 | V | C | D | C | D | D | C |
| Comp. 5 | W | D | D | D | D | D | D |
| Comp. 6 | X | C | D | C | D | D | C |
| Comp. 7 | Y | D | D | D | D | D | D |
| Comp. 8 | Z | D | D | D | D | D | D |
| Comp. 9 | AA | D | D | D | D | D | D |

TABLE 11

| Low temperature/low humidity (15° C./15% RH) | | | | | | | |
|---|---|---|---|---|---|---|---|
| | | ID | Image | Fog | | Matching with | |
| Example | Toner | change | quality | change | Transfer | Drum | Blade |
| 1 | A | A | A | A | A | A | A |
| 2 | B | B | B | B | B | A | B |
| 3 | C | A | A | A | A | A | A |
| 4 | D | A | B | B | B | B | A |
| 5 | E | A | A | A | A | A | A |
| 6 | F | A | B | A | B | A | A |
| 7 | G | B | B | B | A | A | A |
| 8 | H | B | A | B | A | A | A |
| 9 | I | B | A | A | A | A | A |
| 10 | J | A | A | A | B | B | B |
| 11 | K | A | B | A | A | A | A |
| 12 | L | A | B | A | B | B | B |
| 13 | M | B | B | A | B | A | A |
| 14 | N | A | B | B | B | B | B |
| 15 | O | A | A | A | A | A | A |
| 16 | P | A | A | A | A | A | A |
| 17 | Q | A | A | A | A | A | A |
| 18 | R | A | A | A | A | A | A |
| 19 | BB | A | A | A | A | A | A |
| 20 | a | A | A | A | A | A | A |
| Comp. 1 | S | C | C | D | D | B | B |
| Comp. 2 | T | C | D | C | D | D | C |
| Comp. 3 | U | C | C | C | D | D | C |
| Comp. 4 | V | C | D | C | D | D | C |
| Comp. 5 | W | D | D | D | D | D | D |
| Comp. 6 | X | C | D | C | D | D | C |
| Comp. 7 | Y | D | D | D | D | D | D |
| Comp. 8 | Z | D | D | D | D | D | D |
| Comp. 9 | AA | D | D | D | D | D | D |

EXAMPLE 21

The magnetic toner according to the present invention is also applicable to a cleanerless-mode image forming method (including a developing-cleaning step).

Photosensitive member B was prepared in the following manner and used as an image-bearing member in this Example.

Photosensitive member B was a negatively chargeable photosensitive member using an organic photoconductor ("OPC photosensitive member") having a sectional structure as shown in FIG. 8 and was prepared in the following manner.

A 30 mm-dia. aluminum cylinder was used as a substrate 11 on which the following first to fifth functional layers 12–16 were successively formed in this order respectively by dipping (except for the charge injection layer 16).

(1) First layer 12 was an electroconductive layer, a ca. 20 μm-thick conductor particle-dispersed resin layer (formed of phenolic resin with tin oxide and titanium oxide powder dispersed therein), for smoothening defects, etc., on the aluminum drum and for preventing the occurrence of moire due to reflection of exposure laser beam.

(2) Second layer 13 was a positive charge injection-preventing layer for preventing a positive charge injected from the A1 substrate 11 from dissipating the negative charge imparted by charging the photosensitive member surface and was formed as a ca. 1 μm-thick medium resistivity layer of ca. $10^6$ ohm.cm formed of methoxymethylated nylon.

(3) Third layer 14 was a charge generation layer, a ca. 0.3 μm-thick resinous layer containing a disazo pigment dispersed in butyral resin, for generating positive and negative charge pairs on receiving exposure laser light.

(4) Fourth layer 14 was a ca. 25 μm-thick charge transport layer formed by dispersing a hydrazone compound in a polycarbonate resin. This is a p-type semiconductor layer, so that the negative charge imparted to the surface of the photosensitive member cannot be moved through the layer but only the positive charge generated in the charge generation layer is transported to the photosensitive member surface.

(5) Fifth layer 16 was a charge injection layer containing electroconductive tin oxide ultrafine powder and ca. 0.25 μm-dia. tetrafluoroethylene resin particles dispersed in a photocurable acrylic resin. More specifically, a liquid composition containing low-resistivity antimony-doped tin oxide particles of ca. 0.3 μm in diameter in 100 wt. parts, tetrafluoroethylene resin particles in 20 wt. parts and a dispersing agent in 1.2 wt. parts, respectively per 100 wt. parts of the resin dispersed in the resin, was applied by spray coating, followed by drying and photocuring, to form a ca. 2.5 μm-thick charge injection layer 16.

The surfacemost layer of the thus-prepared photosensitive member exhibited a volume resistivity of $5\times10^{12}$ ohm.cm and a contact angle with water of 102 deg.

Charging member A (charging roller) was prepared in the following manner.

A SUS (stainless steel)-made roller of 6 mm in diameter and 264 mm in length was used as a core metal and coated with a medium resistivity roller-form foam urethane layer formed from a composition of urethane resin, carbon black (as electroconductive particles), a vulcanizing agent and a foaming agent, followed by cutting and polishing for shape and surface adjustment to obtain a charging roller having a flexible foam urethane coating layer of 12 mm in outer diameter and 234 mm in length. The thus-obtained Charging roller A exhibited a resistivity of $10^5$ ohm.cm and an Asker C hardness of 30 deg. with respect to the foam urethane layer. As a result of observation through a transmission electron microscope, the charging roller surface exhibited an average cell diameter of ca. 90 μm and a void percentage of 55%.

Figure 5:
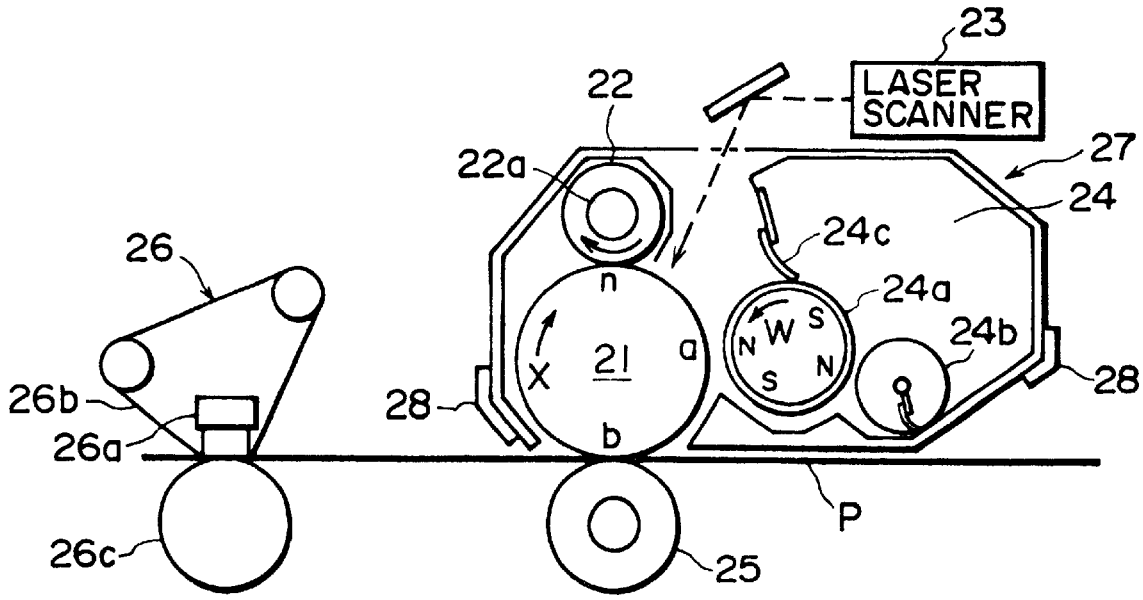

An image forming apparatus having an organization as shown in FIG. 5 was used in this Example.

The image forming apparatus shown in FIG. 5 is a laser beam printer (recording apparatus) according to a transfer-type electrohotographic process and including a developing-cleaning system (cleanerless system). The apparatus includes a process-cartridge from which a cleaning unit having a cleaning member, such as a cleaning blade, has been removed. The apparatus uses a mono-component magnetic toner and a non-contact developing system wherein a toner-carrying member is disposed so that a toner layer carried thereon is in no contact with a photosensitive member for development.

(1) Overall Organization of an Image Forming Apparatus

Referring to FIG. 5, the image forming apparatus includes a rotating drum-type OPC photosensitive member 21 (Photosensitive member B prepared above) (as an image-bearing member), which is driven for rotation in an indicated arrow X direction (clockwise) at a peripheral speed (process speed) of 94 mm/sec.

A charging roller 22 (Charging member A prepared above) (as a contact charging member) is abutted against the photosensitive member 21 at a prescribed pressing force in resistance to its elasticity. Between the photosensitive member 21 and the charging roller 22, a contact nip n is formed as a charging section. In this example, the charging roller 22 is rotated to exhibit a peripheral speed ratio of 100% (corr. to a relative movement speed ratio of 200%) in an opposite direction (with respect to the surface movement direction of the photosensitive member 21) at the charging section n. Prior to the actual operation, Electroconductive fine powder 1 is applied on the charging roller 22 surface at a uniform density of ca. $1\times10^4$ particles/mm$^2$.

The charging roller 22 has a core metal 22*a* to which a DC voltage of −700 volts is applied from a charging bias voltage supply S1. As a result, the photosensitive member 1 surface is uniformly charged at a potential (−680 volts) almost equal to the voltage applied to the charging roller 22 in this Example. This is described later again.

The apparatus also includes a laser beam scanner 23 (exposure means) including a laser diode, a polygonal mirror, etc. The laser beam scanner outputs laser light (wavelength=740 nm) with intensity modified corresponding to a time-serial electrical digital image signal, so as to scanningly expose the uniformly charged surface of the photosensitive member 21. By the scanning exposure, an electrostatic latent image corresponding to the objective image data is formed on the rotating photosensitive member 21.

The apparatus further includes a developing device 24, by which the electrostatic latent image on the photosensitive member 21 surface is developed to form a toner image thereon. The developing device 24 is a non-contact-type reversal development apparatus and included, in this Example, a negatively chargeable mono-component insulating developer (Magnetic toner a). As mentioned above, Magnetic toner a contained Electroconductive fine powder 1 externally added thereto.

The developing device 24 further included a non-magnetic developing sleeve 24*a* (as a developer-carrying member) of a surface-blasted 16 mm-dia. aluminum cylinder coated with a ca. 7 μm-thick resin layer of the following composition exhibiting a roughness (JIS center line-average roughness Ra) of 1.1 μm. The developing sleeve 24*a* was equipped with a developing magnetic pole 94 mT (940 Gauss) and a silicone rubber blade 24*c* of 1.2 mm in thickness and 1.2 mm in free length as a toner layer thickness-regulating member abutted at a linear pressure of 19.6 N/m (20 g/cm) against the sleeve 24*a*. The developing sleeve 24*a* was disposed with a gap of 300 μm from the photosensitive member 21.

| | |
|---|---|
| Phenolic resin | 100 wt. parts |
| Graphite (Dv = ca. 7 μm) | 90 wt. parts |
| Carbon black | 10 wt. parts |

In the developing region a, the developing sleeve 24*a* is rotated in an indicated arrow W direction to show a peripheral speed ratio of 120% of the surface moving speed of the photosensitive member 21 moving in an identical direction.

Magnetic toner a is applied as a thin coating layer on the developing sleeve 24*a* by means of an elastic blade 24*c* while also be charged thereby. In the actual operation, Magnetic toner a was applied at a rate of 15 g/m$^2$ on the develop sleeve 24*a*.

Magnetic toner A applied as a coating on the developing sleeve 24*a* is conveyed along with the rotation of the sleeve 24*a* to the developing section a where the photosensitive member 21 and the sleeve 24*a* are opposite to each other. The sleeve 24*a* is further supplied with a developing bias voltage from a developing bias voltage supply. In operation, the developing bias voltage was a superposition of DC voltage of −420 volts and a rectangular AC voltage of a frequency of 1600 Hz and a peak-to-peak voltage of 1500 volts (providing an electric field strength of $5\times10^6$ volts/m) to effect mono-component jumping development between the developing sleeve 24*a* and the photosensitive member 21.

The apparatus further includes a medium-resistivity transfer roller 25 (as a contact transfer means), which is abutted at a linear pressure of 98 N/m (100 g/cm) against the photosensitive member 21 to form a transfer nip b. To the transfer nip b, a transfer material P as a recording medium is supplied from a paper supply section (not shown), and a prescribed transfer bias voltage is applied to the transfer roller 25 from a voltage supply, whereby toner images on the photosensitive member 21 are successively transferred onto the surface of the transfer material P supplied to the transfer nip b.

In this Example, the transfer roller 25 had a resistivity of $5\times10^9$ ohm.cm and supplied with a DC voltage of +3000 volts to perform the transfer. Thus, the transfer material P introduced to the transfer nip b is nipped and conveyed through the transfer nip b, and on its surface, the toner images on the photosensitive member 21 surface are successively transferred under the action of an electrostatic force and a pressing force.

A fixing device 26 of, e.g., the heat fixing type is also included. The transfer material P having received a toner image from the photosensitive member 1 at the transfer nip b is separated from the photosensitive member 1 surface and introduced into the fixing device 26, where the toner image is fixed to provide an image product (print or copy) to be discharged out of the apparatus.

In the image forming apparatus used in this Example, the cleaning unit has been removed, transfer-residual toner particles remaining on the photosensitive member 1 surface after the transfer of the toner image onto the transfer material P are not removed by such a cleaning means but, along with the rotation of the photosensitive member 21, sent via the charging section n to reach the developing section a, where they are subjected to a developing-cleaning operation to be recovered.

In the image forming apparatus of this Example, three process units, i.e., the photosensitive member 21, the charging roller 22 and the developing device 24 are inclusively supported to form a process-cartridge 27, which is detachably mountable to a main assembly of the image forming apparatus via a guide and support member 28. A process-cartridge may be composed of other combinations of devices.

(2) Behavior of Electroconductive Fine Powder

Electroconductive fine powder mixed in the magnetic toner in the developing device 24 is moved together with the toner and transferred in an appropriate amount to the photosensitive member 21 at the time of developing operation of the developing device 24.

The toner image (composed of toner particles) on the photosensitive member 21 is positively transferred onto the transfer material P (recording medium) under an influence of a transfer bias voltage at the transfer section b. However, because of its electroconductivity, the electroconductive fine powder on the photosensitive member 21 is not positively transferred to the transfer material P but substantially remains in attachment onto the photosensitive member 21.

As no cleaning unit is involved in the image forming apparatus of this Example, the transfer-residual toner particles and the electroconductive fine powder remaining on the photosensitive member 21 after the transfer step are, along with the rotation of the photosensitive member 21, brought to the charging section n formed at the contact part between the photosensitive member 21 and the charging roller 22 (contact charging member) to be attached to and mixed with the charging roller 22. As a result, the photosensitive member is charged by direct charge injection in the presence of the electroconductive fine powder at the contact part n between the photosensitive member 21 and the charging roller 22.

By the presence of the electroconductive fine powder, the intimate contact and low contact resistivity between the charging roller 22 and the photosensitive member 21 can be maintained even when the transfer-residual toner particles are attached to the charging roller 22, thereby allowing the direct injection charging of the photosensitive member 21 by the charging roller 22.

More specifically, the charging roller 22 intimately contacts the photosensitive member 21 via the electroconductive fine powder, and the electroconductive fine powder rubs the photosensitive member 21 surface without discontinuity. As a result, the charging of the photosensitive member 21 by the charging roller 22 is performed not relying on the discharge charging mechanism but predominantly relying on the stable and safe direct injection charging mechanism, to realize a high charging efficiency that has not been realized by conventional roller charging. As a result, a potential almost identical to the voltage applied to the charging roller 22 can be imparted to the photosensitive member 21.

The transfer-residual toner attached to the charging roller 22 is gradually discharged or released from the charging roller 22 to the photosensitive member 21, and along with the movement of the photosensitive member 21, reaches the developing section a where the residual toner is recovered to the developing device 24 in the developing-cleaning operation.

The developing-cleaning step is a step of recovering the toner remaining on the photosensitive member 21 after the transfer step at the time of developing operation in a subsequent cycle of image formation (developing of a latent image formed by re-charging and exposure after a previous image forming cycle operation having resulted in the transfer-residual toner particles) under the action of a fog-removing bias voltage of the developing device (Vback, i.e., a difference between a DC voltage applied to the developing device and a surface potential on the photosensitive member). In an image forming apparatus adopting a reversal development scheme adopted in this Example, the developing-cleaning operation is effected under the action of an electric field of recovering toner particles from a dark-potential part on the photosensitive member and an electric field of attaching toner particles from the developing sleeve and a light-potential part on the photosensitive member, respectively, exerted by the developing bias voltage.

As the image-forming apparatus is operated, the electroconductive fine powder contained in the magnetic toner in the developing device 24 is transferred to the photosensitive member surface 2 at the developing section a, and moved via the transfer section to the charging section n along with the movement of the photosensitive member 21 surface, whereby the charging section n is successively supplied with fresh electroconductive fine powder. As a result, even when the electroconductive fine powder is reduced by falling, etc., or the electroconductive fine powder at the charging section is deteriorated, the chargeability of the photosensitive member 21 at the charging section is prevented from being lowered and good chargeability of the photosensitive member 21 is stably retained.

In this way, in the image forming apparatus including a contact charging scheme, a transfer scheme and a toner recycle scheme, the photosensitive member 21 (as an image-bearing member) can be uniformly charged at a low application voltage by using a simple charging roller 22. Further, the direct injection charging of the ozonless-type can be stably retained to exhibit uniform charging performance even though the charging roller 22 is soiled with transfer-residual toner particles. As a result, it is possible to provide an inexpensive image forming apparatus of a simple structure free from difficulties, such as generation of ozone products and charging failure.

As mentioned above, it is necessary for the electroconductive fine powder to have a resistivity of at most $1\times10^9$ ohm.cm. At a higher resistivity, the charge injection cannot be sufficiently effected even when the charging roller 22 intimately contacts the photosensitive member 21 via the electroconductive fine powder, and the electroconductive fine powder rubs the photosensitive member 21 surface, so that it becomes difficult to charge the photosensitive member 21 to a desired potential.

In a developing device wherein a magnetic toner directly contacts a photosensitive member, charges are injected to the photosensitive member via the electroconductive fine powder in the developer at the developing section a under the application of a developing bias voltage. However, a non-contact developing device is used in this embodiment, so that good images can be formed without causing charge injection to the photosensitive member by the developing bias voltage. Further, as the charge injection to the photosensitive member is not caused at the developing section, it is possible to provide a high potential difference between the sleeve 24*a* and the photosensitive member 21 as by application of an AC bias voltage. As a result, it becomes possible to uniformly apply the electroconductive fine powder onto the photosensitive member 21 surface to achieve uniform contact at the charging section to effect the uniform charging, thereby obtaining good image.

Owing to the lubricating effect (friction-reducing effect) of the electroconductive fine powder present at the contact part between the charging roller 22 and the photosensitive member 21, it becomes possible to easily and effectively provide a speed difference between the charging roller 22 and the photosensitive member 21. Owing to the lubricating effect, the friction between the charging roller 22 and the photosensitive member 21 is reduced, the drive torque is reduced, and the surface abrasion or damage of the charging roller 22 and the photosensitive member 21 can be reduced. As a result of the speed difference, it becomes possible to remarkably increase the opportunity of the electroconductive fine powder contacting the photosensitive member 21 at the contact part (charging section) n between the charging roller 22 and the photosensitive member 21, thereby allowing good direct injection charging.

In this embodiment, the charging roller 22 is driven in rotation to provide a surface moving direction which is opposite to that of the photosensitive member 21 surface at the charging section n, whereby the transfer-residual toner particles on the photosensitive member 21 brought to the charging section n are once recovered by the charging roller 22 to level the density of the transfer-residual toner particles present at the charging section n. As a result, it becomes possible to prevent charging failure due to localization of the transfer-residual toner particles at the charging section n, thereby achieving stabler charging performance.

(3) Evaluation

In this Example, Magnetic toner a (containing Electroconductive fine powder 1) was charged in a toner cartridge and subjected to a print-out test on 5000 sheets operated in an intermittent mode (wherein an image pattern having only vertical lines at a print areal ratio of 7% was printed out while taking a pause period of 10 sec. for the developing device after printing on each sheet so as to promote the toner degradation by a provisional operation for re-starting of the developing device including toner stirring within the developing device. After printing on every 500 sheets, a solid black image pattern and a solid white image pattern were printed for test. A4-size paper of 75 g/m2 was used as the transfer(-receiving) material. As a result, no problem such as lowering in developing performance was observed in the continual intermittent print-out test.

After the print-out test, a part on the charging roller 22 abutted against the photosensitive member 21 was inspected by application and peeling of an adhesive, whereby the charging roller 2 was almost completely coated with the almost white zinc oxide particles (Electroconductive fine powder 1) at a density of ca. $3\times10^5$ particles/mm$^2$ while a slight amount of transfer-residual toner was recognized. Further, as a result of observation through a scanning microscope of a part on the photosensitive member 21 abutted against the charging roller 22, the surface was covered with a tight layer of electroconductive fine powder of very fine particle size and no sticking of transfer-residual toner was observed.

Further, presumably because electroconductive fine powder 1 having a sufficiently low resistivity was present at the contact part n between the photosensitive member 21 and the charging roller 22, image defects attributable to charging failure was not observed from the initial stage until completion of the print-out test, thus showing good direct injection charging performance.

Further, Photosensitive member B having the surfacemost layer exhibiting a volume resistivity of $5\times10^{12}$ ohm.cm, character images were formed with a sharp contour exhibiting the maintenance of an electrostatic latent image and a sufficient chargeability even after the print-out test on 5000 sheets. The photosensitive member exhibited a potential of −670 volts in response to direct charging at an applied voltage of −700 volts after the intermittent printing-out on 5000 sheets, thus showing only a slight lowering in chargeability of −10 volts and no lowering in image quality due to lower chargeability.

Further, presumably partly owing to the use of Photosensitive member B having a surface showing a contact angle with water of 102 deg., the transfer efficiency was very excellent at both the initial stage and after the intermittent print-out on 5000 sheets. However, even after taking such a smaller amount of transfer-residual toner particles remaining on the photosensitive member after the transfer step after the intermittent printing-out on 5000 sheets into consideration, it is understandable that the recovery of the transfer-residual toner in the developing step was well effected judging from the fact that only a slight amount of transfer-residual toner was recognized on the charging roller 22 after the intermittent printing-out on 5000 sheets and the resultant images were accompanied with little fog at the non-image portion. Further, the scars on the photosensitive member after the intermittent printing-out on 5000 sheets were slight and the image defects appearing in the resultant images attributable to the scars were suppressed to a practically acceptable level.

The evaluation of the print-out test was performed in the following manner with respect to the print-out images and the matching with members of the image forming apparatus as follows.

Evaluation of Print-out Images

1) I.D. Change (Image Density Change)

The relative image densities of printed solid black images relative to corresponding printed solid white images on 500th and 5000th sheets were measured by a Macbeth reflection densitometer ("RD-918", available from Macbeth Co.), and evaluation was made based on a difference therebetween according to the following standard.

A: very good (difference<0.05)

B: good (difference=0.05 to below 0.10)

C: fair (difference=0.10 to below 0.20)

D: poor (difference≧0.20)

2) Image Quality

Image quality was evaluated overall and principally based on image uniformity of solid black image and thin line reproducibility according to the following standard.

A: Clear images with excellent thin line reproducibility and image uniformity.

B: Generally good images with slightly inferior thin line reproducibility and image uniformity.

C: Somewhat inferior images of practically no problem.

D: Practically unpreferable images with poor thin line reproducibility and image uniformity.

3) Fog Change

A toner image portion at a part just before the transfer step on the photosensitive member at the time of a solid white image formation was peeled off by applying and peeling a polyester adhesive tape, and the Macbeth image density of the peeled adhesive tape applied on white paper was measured relative to a blank of the adhesive tape on the paper and determined as a fog value. The above fog measurement was repeated at the time of formation of a solid white image on a 501th sheet and a 5001th sheet. The fog value on the 501th sheet was subtracted from that on the 5001th sheet to determine a fog difference, based on which the evaluation was made according to the following standard.

A: very good (fog difference<0.05)

B: good (fog difference=0.05 to below 0.15)

C: fair (fog difference=0.15 to below 0.30)

D: poor (fog difference≦0.30)

4) Transfer(ability)

Transfer-residual toner on the photosensitive member at the time of solid black image formation on a 1000th sheet was peeled off by applying and peeling a polyester adhesive tape, and the Macbeth image density of the peeled adhesive tape applied on white paper was measured relative to that of a blank of the adhesive tape applied on the paper to determine a transfer residue density difference (TRD difference), based on which evaluation was made according to the following standard.

A: very good (TRD difference<0.05)

B: good (TRD difference=0.05 to below 0.10)

C: fair (TRD difference=0.10 to below 0.20)

D: poor (TRD difference≧0.20)

5) Charge ΔV (Lowering in Chargeability)

The potential on the photosensitive member after the uniform charging was measured at the initial stage ($V_I$) and after the print-out test ($V_F$),and a difference between these values ($\Delta V=|V_F|-|V_I|$) was indicated as a measure of stable chargeability. A negatively large value of ΔV represents a larger lowering in chargeability.

6) Conductor Density (Density of Electroconductive Fine Powder)

The density of electroconductive fine powder present at the contact part between the photosensitive member and the contact charging member was measured by observation through a video microscope described hereinbefore. A density in the range of $1\times10^4$–$5\times10^5$ particles/mm$^2$ is generally preferred.

Matching with Members of Image-forming Apparatus

1) Blade (matching with a toner layer thickness-regulation blade)

After the print-out test, the silicone rubber blade (toner layer-thickness regulation member) was taken out of the developing device, and after being blown with air, the abutting portion thereof against the developing sleeve (toner-carrying member) was observed through a microscope with respect to toner sticking and damages.

A: Not observed at all.

B: Slight sticking observed.

C: Sticking and scars observed.

D: Much sticking.

The results of evaluation are shown in Table 12 hereinafter together with those of the following Examples and Comparative Examples.

EXAMPLES 22–24

The print-out test and evaluation of Example 21 were repeated except for using Photosensitive members C, D and E prepared in the following manner instead of Photosensitive member B.

Photosensitive Member C

Photosensitive member C was prepared in the same manner as Photosensitive member B except for omitting the tetrafluoroethylene resin particle and the dispersing agent for production of the fifth layer (charge injection layer 16). The surfacemost layer of the thus-prepared photosensitive member exhibited a volume resistivity of $2\times10^{12}$ ohm.cm and a contact angle with water of 78 deg.

Photosensitive Member D

Photosensitive member D was prepared in the same manner as Photosensitive member B except that the fifth layer (charge injection layer 16) was prepared from a composition containing 300 wt. parts of the low-resistivity antimony-doped tin oxide particles per 100 wt. parts of the photocurable acrylic resin. The surfacemost layer of the thus-prepared photosensitive member exhibited a volume resistivity of $2\times10^{7}$ ohm.cm and a contact angle with water of 88 deg.

Photosensitive Member E

Photosensitive member E having a four layer structure including the charge transport layer 15 as the surfacemost layer was prepared in the same manner as Photosensitive member B except for omitting the fifth layer (charge injection layer 16). The surfacemost layer of the thus-prepared photosensitive member exhibited a volume resistivity of $1\times10^{15}$ ohm.cm and a contact angle with water of 73 deg.

EXAMPLE 25

Figure 6:
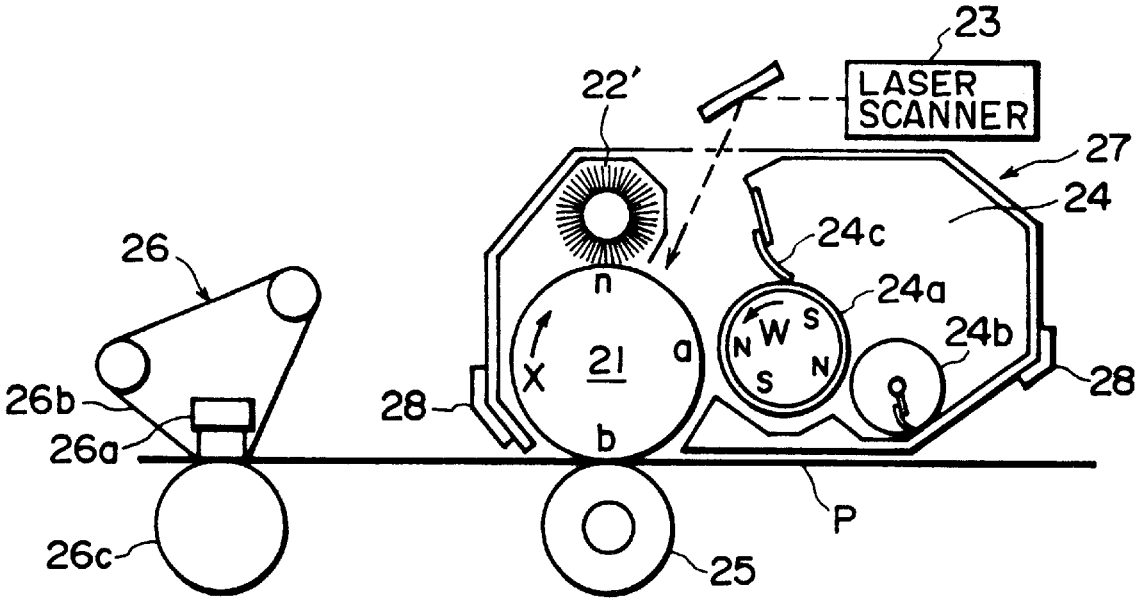
Figure 7:
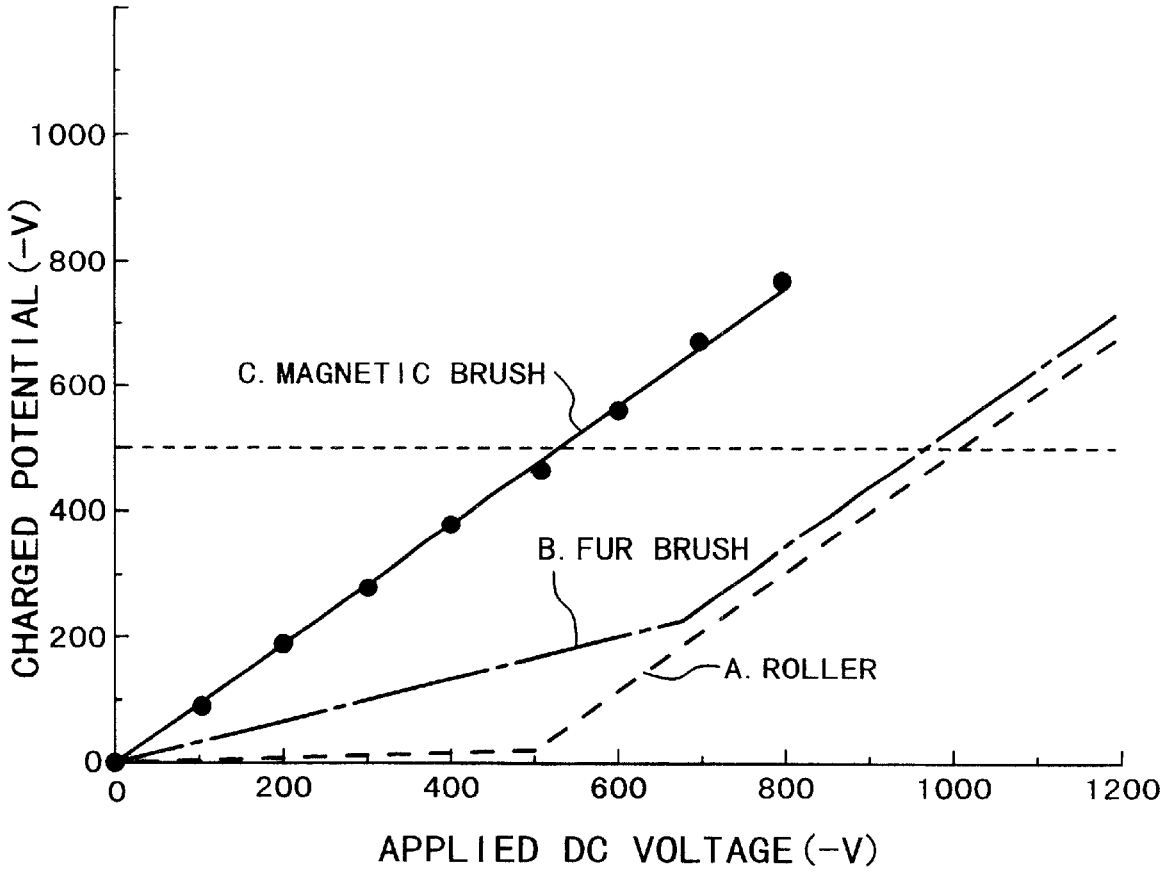
FIG. 7 is a graph showing charging performances of several contact charging members.

The print-out test and evaluation of Example 21 were repeated except for using Charging member B (charging brush roller) prepared in the following manner instead of Charging member A. The image-forming apparatus used in this Example is illustrated in FIG. 6, wherein Charging member B was used as a charging brush roller 22'.

Charging Member B

About a SUS roller of 6 mm in diameter and 264 mm in length as a core metal, a tape of piled electroconductive nylon fiber was spirally wound to prepare a charging brush roller (Charging member B). The electroconductive nylon fiber was formed from nylon in which carbon black was dispersed for resistivity adjustment and comprised yarns of 6 denier (composed of 50 filament of 30 denier). The nylon yarns in a length of 3 mm were planted at a density of $10^5$ yarns/in$^2$ to provide a brush roller exhibiting a resistivity of $1\times10^{7}$ ohm.cm.

EXAMPLES 26–30

The print-out test and evaluation of Example 21 were repeated except for using Magnetic toners b–f, respectively, instead of Magnetic toner a.

Comparative Examples 10–13

The print-out test and evaluation of Example 21 were repeated except for using Magnetic toner g–j, respectively instead of Magnetic toner a.

The results are inclusively shown in the following Table 12.

TABLE 12

| Example | Photosensitive member | Charging member | Toner | I.D. change | Image quality | Fog change | Transfer | Charge ΔV | Conductor density | Matching with blade |
|---|---|---|---|---|---|---|---|---|---|---|
| 21 | B | A | a | A | A | A | A | −10 | $1\times10^{5}$ | A |
| 22 | C | A | a | B | A | B | A | −20 | $1\times10^{5}$ | A |
| 23 | D | A | a | A | A | A | A | −10 | $1\times10^{5}$ | A |
| 24 | E | A | a | B | A | B | A | −40 | $6\times10^{3}$ | C |
| 25 | B | B | a | B | A | A | A | −40 | $2\times10^{2}$ | C |
| 26 | B | A | b | A | A | A | A | −20 | $3\times10^{4}$ | C |
| 27 | B | A | c | A | A | A | A | −30 | $8\times10^{4}$ | B |
| 28 | B | A | d | B | B | A | A | −50 | $4\times10^{3}$ | A |
| 29 | B | A | e | A | A | B | A | −20 | $3\times10^{4}$ | B |
| 30 | B | A | f | B | B | B | B | −10 | $1\times10^{5}$ | B |
| Comp. 10 | B | A | g | C | D | C | C | −10 | $1\times10^{5}$ | C |
| Comp. 11 | B | A | h | D | C | D | C | −10 | $1\times10^{5}$ | D |
| Comp. 12 | B | A | i | D | D | D | C | −10 | $1\times10^{5}$ | D |
| Comp. 13 | B | A | j | D | D | D | D | −10 | $1\times10^{6}$ | D |

a) Production of Magnetic Powder

Surface-treated magnetic powders 9–12 and Surface-untreated magnetic powder i were prepared in the following manner.

Surface-treated Magnetic Powder 9

Into a ferrous sulfate aqueous solution, an aqueous solution of caustic soda in an amount of 1.0–1.1 equivalent of the iron of the ferrous sulfate was added and mixed therewith to form an aqueous solution containing ferrous hydroxide. While maintaining the pH of the aqueous solution at around 8, air was blown thereinto to cause oxidation. Magnetic iron oxide particles formed after the oxidation was washed and once recovered by filtration. A portion of the water-containing product was taken out to measure a moisture content. Then, the remaining moisture-containing product, without drying, was re-dispersed in another aqueous medium, and the pH of the re-dispersion liquid was adjusted to ca. 6. Then, into the dispersion liquid under sufficient stirring, a silane coupling agent (n—$C_{10}H_{21}Si(OCH_3)_3$) in an amount of 1.0 wt. % of the magnetic iron oxide (calculated by subtracting the moisture content from the water-containing product magnetic iron oxide) was added to effect a coupling treatment for hydrophobization. The thus-hydrophobized magnetic iron oxide particles were washed, filtrated and dried in ordinary manners, followed further by disintegration of slightly agglomerated particles, to obtain Surface-treated magnetic powder 9, of which the physical properties are shown in Table 13 appearing hereinafter together with those of magnetic powders prepared in the following manners.

Surface-untreated Magnetic Powder i

The process for preparation of Surface-treated magnetic powder 9 was repeated up to the oxidation reaction. Magnetic iron oxide particles after the oxidation was washed, filtered out, and without surface-treatment, dried in ordinary manners, followed by disintegration of agglomerated particles, to obtain Surface-untreated magnetic powder i.

Surface-treated Magnetic Powder 10

The above-prepared Surface-untreated magnetic powder 1 was re-dispersed in water, and then into the re-dispersion liquid under sufficient stirring, a silane coupling a gent (n—$C_{10}H_{21}Si(OCH_3)_3$) in an amount of 1.0 wt. % of the magnetic iron oxide (calculated by subtracting the moisture content from the water-containing product magnetic iron oxide) was added to effect a coupling treatment for hydrophobization. The thus-hydrophobized magnetic iron oxide particles were washed, filtrated and dried in ordinary manners, followed further by disintegration of slightly agglomerated particles, to obtain Surface-treated magnetic powder 10.

Surface-treated Magnetic Powder 11

Surface-treated magnetic powder 11 was prepared in a similar manner as Surface-treated magnetic powder 9 except for changing the coupling agent to n—$C_6H_{13}Si(OCH_3)_3$.

Surface-treated Magnetic Powder 12

Surface-treated magnetic powder 12 was prepared in a similar manner as Surface-treated magnetic powder 9 except for changing the coupling agent to n—$C_{18}H_{37}Si(OCH_3)_3$.

Magnetic properties of Surface-treated magnetic powder 9–12 are shown in Table 13 below.

TABLE 13

| Surface-treated magnetic powder | σr ($Am^2/kg$) | σs ($Am^2/kg$) |
|---|---|---|
| 9 | 9.5 | 48 |
| 10 | " | " |
| 11 | " | " |
| 12 | " | " |

b) Electroconductive Fine Powder

Electroconductive fine powders 1–5 prepared above were used.

c) Production of Magnetic Toners

Magnetic Toner 1

Into 292 wt. parts of deionized water, 46 wt. parts of 1.0 mol/l-$Na_3PO_4$ aqueous solution was added, and after heating to 80° C., 67 wt. parts of 1.0 mol/l-$CaCl_2$ aqueous solution was gradually added thereto, to form an aqueous medium containing $Ca_3(PO_4)_2$.

| | | |
|---|---|---|
| Styrene | 88 | wt. part(s) |
| Stearyl methacrylate | 12 | " |
| Saturated polyester resin | 8 | " |
| Negative charge control agent (monoazo dye Fe compound) | 2 | " |
| Surface-treated magnetic powder 9 | 85 | " |

The above ingredients were sufficiently dispersed and mixed by an attritor (made by Mitsui Miike Kakoki K.K.) to form a monomeric mixture. The monomeric mixture was heated to 80° C., and 10 wt. parts of an ester wax (Tabs.=75° C.) and 6 wt. parts of t-butyl peroxy-2-ethylhexanoate (polymerization initiator) was added thereto and mixed with each other to form a polymerizable composition.

The polymerizable composition was charged into the above-prepared aqueous medium and stirred at 80° C. in an $N_2$ atmosphere for 10 min. at 10,000 rpm by a TK homomixer (made by Tokushu Kika Kogyo K.K.) to disperse the droplets of the polymerizable composition in the aqueous medium. Then, the system was further stirred by a paddle stirrer and subjected to 4 hours of reaction at 80° C., followed by addition of 4 wt. parts of anhydrous sodium carbonate and further 2 hours of continued reaction. The suspension liquid after the reaction showed pH 10.5, and after cooling, was subjected to the following operation on a conveyer belt filter ("Eagle Filter", made by Sumitomo Jukikai Kogyo K.K.).

The alkaline suspension liquid was first de-watered on the belt and then showered with totally 1000 wt. parts of water for washing to remove sodium 2-ethylhexanoate (possibly formed by neutralization with sodium carbonate of 2-ethylhexanoic acid by-produced by decomposition of t-butyl peroxy-2-ethylhexanoate used as the polymerization initiator). Then, the polymerizate was further washed with 1000 wt. parts of dilute hydrochloric acid (pH 1.0), washed with 1000 wt. parts of water and then de-watered on the belt to obtain magnetic toner particles substantially free from 2-ethylhexanoic acid and calcium phosphate used as the dispersing agent. The moisture-containing magnetic toner particles thus obtained were further dried to obtain Magnetic toner particles 1 having Dv=6.8 μm.

100 wt. parts of Magnetic toner particles 1 and 0.8 wt. part of hydrophobic silica fine powder (having a BET specific surface area (SBET) after the treatment) of 200 $m^2/g$) successively surface treated with hexamethyl-disilazane and silicone oil were blended in a Henschel mixer to obtain Magnetic toner 1. Some representative properties of Magnetic toner 1 are shown in Table 14 appearing hereinafter together with those of Magnetic toners prepared in the following manner.

Magnetic Toner 2

Magnetic toner 2 was prepared in the same manner as Magnetic toner 1 except for using Surface-treated magnetic powder 11 instead of Surface-treated magnetic powder 9.

Magnetic Toner 3

Magnetic toner 3 was prepared in the same manner as Magnetic toner 1 except for using Surface-treated magnetic powder 12 instead of Surface-treated magnetic powder 9.

Magnetic Toner 4

100 wt. parts of magnetic toner particles 1 and 1.1 wt. parts of hydrophobic silica fine powder ($S_{BET}$=200 $m^2/g$)

treated with hexamethyldisilazane were blended in a Henschel mixer to obtain magnetic toner 4.

Magnetic Toner 5

The process for preparation of Magnetic toner 1 was repeated up to the high-speed stirring by the TK-homomixer to disperse the droplets of the polymerizable composition in the aqueous medium. Then, the system was further stirred by a paddle mixer and subjected to 6 hours of reaction at 80° C. The suspension liquid after the reaction showed pH 9.5. After the reaction, the alkaline suspension liquid was cooled and acidified to pH 1.0 by addition of dilute hydrochloric acid. Thereafter, the suspension liquid was subjected to filtration and washing with water on the conveyer belt filter, followed by drying to obtain Magnetic toner particles 5 exhibiting Dv 6.6 $\mu$m.

100 wt. parts of Magnetic toner particles 5 and 1.1 wt. parts of the hydrophobic silica fine powder (treated with hexamethyldisilazane and silicone oil) used in production of Magnetic toner 1 were blended in a Henschel mixer to obtain Magnetic toner 5.

Magnetic Toner 6

The process for preparation of Magnetic toner 5 was repeated up to the 6 hours of reaction at 80° C. The alkaline suspension liquid (pH 9.5) was cooled and subjected to suction filtration through a Buchner funnel, followed by washing of the polymerizate particles with 100 wt. parts of water. Then, the polymerizate particles were re-dispersed in dilute hydrochloric acid of pH 1.0 and stirred therein for 1 hour. The slurry was further subjected to suction filtration through a Buchner funnel, and the polymerizate particles were sufficiently washed with water and then dried to obtain Magnetic toner particles 6 exhibiting Dv=6.7 $\mu$m.

100 wt. parts of Magnetic toner particles 6 and 1.1 wt. parts of the hydrophobic silica fine powder (treated with hexamethyldisilazane and silicone oil) used in production of Magnetic toner 1 were blended in a Henschel mixer to obtain magnetic toner 6.

Magnetic Toner 7

Magnetic toner 7 was prepared in the same manner as Magnetic toner 6 except for using 200 wt. parts of alkaline aqueous solution (pH=11.0) instead of 100 wt. parts of water for washing the polymerizate particles recovered from the acidified suspension liquid.

Magnetic Toner 8

Magnetic toner 8 was prepared in the same manner as Magnetic toner 1 except for increasing the amount of the ester wax to 51 wt. parts.

Magnetic Toner 9

Magnetic toner 9 was prepared in the same manner as Magnetic toner 1 except for reducing the amount of the ester wax to 0.4 wt. part.

Magnetic Toner 10

Magnetic toner 10 was prepared in the same manner as Magnetic toner 1 except for using 20 wt. parts of low-molecular weight polyethylene wax (Tabs.=120° C.) instead of the ester wax.

Magnetic Toner 11

Magnetic toner 11 was prepared in the same manner as Magnetic toner 1 except for using 50 wt. parts of Surface-treated magnetic powder 9.

Magnetic Toner 12

Magnetic toner 12 was prepared in the same manner as Magnetic toner 1 except for using 150 wt. parts of Surface-treated magnetic powder 9.

Magnetic Toner 13

The aqueous dispersion medium containing $Ca_3(PO_4)_2$ and the monomeric mixture were prepared in the same manner as in the production of Magnetic toner 1.

The monomeric mixture was heated to 60° C., and 20 wt. parts of the ester wax (Tabs.=75° C.) and 5 wt. parts of t-butyl peroxyneodecanoate (polymerization initiator) were added thereto and mixed with each other to form a polymerizable composition.

The polymerizable composition was charged into the above-prepared aqueous medium and stirred at 60° C. in an $N_2$ atmosphere for 10 min. at 10,000 rpm by a TK homomixer (made by Tokushu Kika Kogyo K.K.) to disperse the droplets of the polymerizable composition in the aqueous medium. Then, the system was further stirred by a paddle stirrer and subjected to 4 hours of reaction at 60° C., followed by addition of 4 wt. parts of anhydrous sodium carbonate and further 2 hours of reaction at 80° C. The suspension liquid after the reaction showed pH 10.5, and after cooling, was subjected to the following operation within a filter press (made by Kurita Kikai Seisakusho K.K.).

The alkaline suspension liquid was first introduced into the filter press to recover the polymerizate particles by filtration, and then the particles were washed with totally 1000 wt. parts of water poured into the filter frame so as to remove sodium neodecanoate (possibly formed by neutralization with sodium carbonate of neodecanoic acid by-produced by decomposition of t-butyl peroxyneodecanoate used as the polymerization initiator). Then, dilute hydrochloric acid of pH 1.0 was poured into the filter frame to dissolve and remove the calcium phosphate attached to the toner particle surfaces. Then, water was sufficiently poured into the filter frame to sufficiently wash the toner particles. Thereafter the toner particles were pressed and de-watered by air blowing to obtain toner particles substantially free from neodecanoic acid and calcium phosphate used as he dispersing agent. The moisture-containing toner particles were then dried to obtain Magnetic toner particles 13 having Dv=7.1 $\mu$m.

100 wt. parts of Magnetic toner particles 13 and 1.1 wt. parts of the hydrophobic silica fine powder (treated with hexamethyldisilazane and silicone oil) used in production of Magnetic toner 1 were blended in a Henschel mixer to obtain Magnetic toner 13.

Magnetic Toner 14

Magnetic toner 14 was prepared in the same manner as Magnetic toner 1 except for using 5 wt. parts of t-butyl peroxypivalate (polymerization initiator) instead of t-butyl peroxy-2-ethylhexanoate and using 70° C. as the polymerization temperature instead of 80° C.

Magnetic Toner 15

Magnetic toner 15 was prepared in the same manner as Magnetic toner 1 except for using 5 wt. parts of t-hexyl peroxypivalate (polymerization initiator) instead of t-butyl peroxy-2-ethylhexanoate.

Magnetic Toner 16

Magnetic toner 16 was prepared in the same manner as Magnetic toner 1 except for using 10 wt. parts of bis(3-methyl-3-methoxybutyl) peroxy-dicarbonate (polymerization initiator) instead of t-butyl peroxy-2-ethylhexanoate.

Magnetic Toner 17

Magnetic toner 17 was prepared in the same manner as Magnetic toner 1 except for using 5 wt. parts of benzoyl peroxide (polymerization initiator) instead of t-butyl peroxy-2-ethylhexanoate.

Magnetic Toner 18

Magnetic toner 18 was prepared in the same manner as Magnetic toner 1 except for using 20 wt. parts of stearoyl peroxide (polymerization initiator) instead of t-butyl peroxy-2-ethylhexanoate.

Magnetic Toner 19

Magnetic toner 19 was prepared in the same manner as Magnetic toner 1 except for using 15 wt. parts of ammonium persulfate (polymerization initiator) instead of t-butyl peroxy-2-ethylhexanoate.

Magnetic Toner 20 (Comparative)

Magnetic toner 20 was prepared in the same manner as Magnetic toner 1 except for using 85 wt. parts of Surface-untreated magnetic powder i instead of Surface-treated magnetic powder 9.

Magnetic Toner 21 (Comparative)

Magnetic toner 21 was prepared in the same manner as Magnetic toner 1 except for using 85 wt. parts of Surface-treated magnetic powder 10 instead of Surface-treated magnetic powder 9.

Magnetic Toner 22 (Comparative)

Magnetic toner 22 was prepared in the same manner as Magnetic toner 1 except for using using 15 wt. parts of 2,2'-azobis(2,4-dimethylvaleronitrile) instead of t-butyl peroxy-2-ethylhexanoate and using Surface-treated magnetic powder 10 instead of Surface-treated magnetic powder 9.

Magnetic Toner 23 (Comparative

The aqueous dispersion medium containing $Ca_3(PO_4)_2$ and the monomeric mixture were prepared in the same manner as in the production of Magnetic toner 1 except for using 730 wt. parts of deionized water instead of 292 wt. parts of deionized water.

The monomeric mixture was heated to 60° C., and 20 wt. parts of the ester wax (Tabs.=75° C.) and 15 wt. parts of 2,2'-azobis(2,4-dimethylvaleronitrile) (polymerization initiator) were added thereto and mixed with each other to form a polymerizable composition.

The polymerizable composition was charged into the above-prepared aqueous medium and stirred at 60° C. in an $N_2$ atmosphere for 10 min. at 10,000 rpm by a TK homomixer (made by Tokushu Kika Kogyo K.K.) to disperse the droplets of the polymerizable composition in the aqueous medium. Then, the system was further stirred by a paddle stirrer and subjected to 3 hours of reaction at 60° C. and further 7 hours of reaction at 80° C.

Then, the suspension liquid was cooled, and a mixture of the following ingredients was added dropwise through a metering pump and caused to be adsorbed by the polymerizate particles in the suspension liquid.

| | |
|---|---|
| Styrene | 45 wt. parts |
| Stearyl methacrylate | 5 " |
| Bis(t-butylperoxy)hexane | 4 " |

Thereafter, the system was heated to 70° C. and held at that temperature for 10 hours for the reaction. After the reaction, the suspension liquid was cooled, and dilute hydrochloric acid was added thereto to provide pH 1.0. Thereafter, the polymerizate was recovered by filtration, and dried to obtain Magnetic toner particles 23 having Dv=7.0 μm.

100 wt. parts of Magnetic toner particles 23 and 1.1 wt. parts of the hydrophobic silica fine powder (treated with hexamethyldisilazane and silicone oil) used in production of Magnetic toner 1 were blended in a Henschel mixer to obtain Magnetic toner 23 (comparative).

Magnetic Toner 24 (Comparative)

Into 100 wt. parts of water containing 3 wt. parts of emulsifying agents (1 wt. part of "Emulgen 950", made by Kao K.K., and 2 wt. parts of "Neogen R", made by Daiichi Kogyo Seiyaku K.K.), the following ingredients were added.

| | |
|---|---|
| Styrene | 76 wt. parts |
| n-Butyl acrylate | 20 " |
| Acrylic acid | 4 " |

Further, 5 wt. parts of potassium persulfate was added as a catalyst, and polymerization was effected for 8 hours at 70° C. under stirring to obtain an acid polar group-containing resin emulsion having a solid contact of 50%

| | |
|---|---|
| The above resin emulsion | 200 wt. part(s) |
| Surface-treated magnetic powder 9 | 100 " |
| Polyethylene dispersion ("Chemipearl WF-640", mfd. by Mitsui Sekiyu Kagaku K.K.) | 90 " |
| Monoazo Fe compound (negative control agent) | 2 " |
| Water | 350 " |

The above mixer was held at 25° C. under stirring by a Disper. After ca. 2 hours of stirring, the dispersion liquid was heated to 60° C. and adjusted to pH 8.0 by addition of ammonia water. Then, the liquid was heated to 90° C. and held at that temperature for 5 hours to form polymerizate particles of ca. 8 μm. The dispersion liquid was cooled, and the polymerizable particles were recovered and washed with water to obtain Magnetic toner particles 24. As a result of observation through an electron microscope, Magnetic toner particles 24 were found to be composed of associated particles of polymerizate particles and secondary particles of magnetic powder fine particles.

100 wt. parts of Magnetic toner particles 24 and 1.1 wt. parts of the hydrophobic silica fine powder (treated with hexamethyldisilazane and silicone oil) used in production of Magnetic toner 1 were blended in a Henschel mixer to obtain Magnetic toner 24.

Magnetic Toner 25 (Comparative)

| | | |
|---|---|---|
| Styrene/stearyl methacrylate copolymer (88/12 by wt.) | 100 | wt. part(s) |
| Saturated polyester resin | 8 | " |
| Monoazo dye Fe compound (negative charge control agent) | 2 | " |
| Surface-treated magnetic powder 9 | 100 | " |
| Ester wax (Tabs = 75° C., used in production of Magnetic toner 1) | 10 | " |

The above ingredients were blended by a blender, melt-kneaded by a twin-screw extruder heated at 140° C. The kneaded product, after cooling, was coarsely crushed by a hammer mill and then finely pulverized by a jet mill followed by pneumatic classification to obtain Magnetic toner particles 25 (Dv=10.4 $\mu$m).

100 wt. parts of Magnetic toner particles 25 and 0.8 wt. part of the hydrophobic silica fine powder (treated with hexamethyldisilazane and silicone oil) used in production of Magnetic toner 1 were blended in a Henschel mixer to obtain Magnetic toner 25 (comparative).

Magnetic Toner 26 (Comparative)

Magnetic toner 26 was prepared in the same manner as Magnetic toner 25 except that the product after the coarse crushing was finely pulverized by a turbo-mill (made by Turbo Kogyo K.K.) and then subjected to a sphering treatment by means of an impingement-type surface treatment apparatus at a temperature of 50° C. and a rotating blade peripheral speed of 90 m/sec to obtain Magnetic toner particles 26 (Dv=10.3 $\mu$m).

100 wt. parts of Magnetic toner particles 26 and 0.8 wt. part of the hydrophobic silica fine powder (treated with hexamethyldisilazane and silicone oil) used in production of Magnetic toner 1 were blended in a Henschel mixer to obtain Magnetic toner 26.

Some magnetic toners further containing electroconductive fine powder were prepared in the following manner.

Magnetic Toner 27

100 wt. parts of Magnetic toner particles 1, 0.8 wt. part of the hydrophobic silica fine powder (treated with hexamethyldisilazane and silicone oil) used in production of Magnetic toner 1 and 2.0 wt. parts of Electroconductive fine powder 1 were blended in a Henschel mixer to obtain Magnetic toner 27.

Magnetic Toner 28

Magnetic toner 28 was prepared in the same manner as Magnetic toner 27 except for using Electroconductive fine powder 2 instead of Electroconductive fine powder 1.

Magnetic Toner 29

Magnetic toner 29 was prepared in the same manner as Magnetic toner 27 except for using Electroconductive fine powder 3 instead of Electroconductive fine powder 1.

Magnetic Toner 30

Magnetic toner 30 was prepared in the same manner as Magnetic toner 27 except for using Electroconductive fine powder 4 instead of Electroconductive fine powder 1.

Magnetic Toner 31

Magnetic toner 31 was prepared in the same manner as Magnetic toner 1 except for using Electroconductive fine powder 5 instead of Electroconductive fine powder 1.

Magnetic Toner 32

Magnetic toner 32 was prepared in the same manner as Magnetic toner 1 except for using Magnetic toner particles 13 instead of Magnetic toner particles 1.

Magnetic Toner 33 (Comparative)

Magnetic toner 33 was prepared in the same manner as Magnetic toner 1 except for using Magnetic toner particles 20 instead of Magnetic toner particles 1.

Magnetic Toner 34 (Comparative)

Magnetic toner 34 was prepared in the same manner as Magnetic toner 1 except for using Magnetic toner particles 25 instead of Magnetic toner particles Magnetic Toner 35 (Comparative)

Magnetic toner 35 was prepared in the same manner as Magnetic toner 1 except for using Magnetic toner particles 26 instead of Magnetic toner particles Some representative properties of Magnetic toners 1–35 prepared above are inclusively shown in the following Table 14.

TABLE 14

| | | | | | Magnetic toner | | | | | | | | | | | | |
|---|---|---|---|---|---|---|---|---|---|---|---|---|---|---|---|---|---|
| | | | | | Toner | | Magnetic powder | | | | | Wax Tabs | Carboxylic | Filtration | Solid in | | Conductive |
| Toner | Process *1 | Initiator (wt. parts) | $R_{STY}$ (ppm) | am/af *3,*4 | Dv (μm) | Kn (%) | Species (wt. parts) | Dispersion | N % of D/C ≦ 0.02 | B/A | (° C.) (wt.parts) | acid (amt.) | before acid addition | pmn. (wt %) | Additive (wt. parts) | powder (wt. parts) |
| 1 | Poly. | a (6) | 80 | 0.988/1.00 | 6.8 | 18 | l (85) | A | 87 | 0.0001 | 75 (10) | q (32 ppm) | belt | 35 | t (1.1) | — |
| 2 | " | a (6) | 75 | 0.986/1.00 | 6.9 | 18 | m (85) | A | 88 | 0.0003 | 75 (10) | q (25 ppm) | belt | 35 | t (1.1) | — |
| 3 | " | a (6) | 70 | 0.985/1.00 | 7.0 | 19 | n (85) | A | 86 | 0.0003 | 75 (10) | q (31 ppm) | belt | 35 | t (1.1) | — |
| 4 | " | a (6) | 80 | 0.988/1.00 | 6.8 | 18 | l (85) | A | 87 | 0.0001 | 75 (10) | q (32 ppm) | belt | 35 | u (1.1) | — |
| 5 | " | a (6) | 90 | 0.987/1.00 | 6.6 | 19 | l (85) | A | 86 | 0.0002 | 75 (10) | q (1.5%) | — | 35 | t (1.1) | — |
| 6 | " | a (6) | 79 | 0.988/1.00 | 6.7 | 19 | l (85) | A | 90 | 0.0002 | 75 (10) | q (1900 ppm) | sucking | 35 | t (1.1) | — |
| 7 | " | a (6) | 79 | 0.988/1.00 | 6.7 | 19 | l (85) | A | 89 | 0.0002 | 75 (10) | q (638 ppm) | sucking | 35 | t (1.1) | — |
| 8 | " | a (6) | 90 | 0.985/1.00 | 6.6 | 34 | l (85) | A | 88 | 0.0002 | 75 (51) | q (35 ppm) | belt | 20 | t (1.1) | — |
| 9 | " | a (6) | 95 | 0.988/1.00 | 7.2 | 25 | l (85) | A | 83 | 0.0003 | 75 (0.4) | q (23 ppm) | belt | 30 | t (1.1) | — |
| 10 | " | a (6) | 90 | 0.986/1.00 | 7.0 | 26 | l (85) | A | 84 | 0.0003 | 120 (10) | q (25 ppm) | belt | 30 | t (1.1) | — |
| 11 | " | a (6) | 85 | 0.988/1.00 | 7.0 | 19 | l (50) | A | 69 | 0.0001 | 75 (10) | q (45 ppm) | belt | 35 | t (1.1) | — |
| 12 | " | a (6) | 75 | 0.985/1.00 | 7.9 | 23 | l (150) | A | 94 | 0.0002 | 75 (10) | q (30 ppm) | belt | 35 | t (1.1) | — |
| 13 | " | b (5) | 70 | 0.988/1.00 | 7.1 | 18 | l (85) | A | 83 | 0.0002 | 75 (10) | r (20 ppm) | filter press | 35 | t (1.1) | — |
| 14 | " | c (5) | 50 | 0.988/1.00 | 6.8 | 19 | l (85) | A | 84 | 0.0002 | 75 (10) | s (23 ppm) | belt | 35 | t (1.1) | — |
| 15 | " | d (5) | 48 | 0.987/1.00 | 7.1 | 19 | l (85) | A | 85 | 0.0002 | 75 (10) | s (33 ppm) | belt | 35 | t (1.1) | — |
| 16 | " | e (10) | 290 | 0.971/1.00 | 7.5 | 36 | l (85) | B | 83 | 0.0003 | 75 (10) | — | belt | 20 | t (1.1) | — |
| 17 | " | f (10) | 280 | 0.975/1.00 | 6.9 | 37 | l (85) | B | 89 | 0.0002 | 75 (10) | — | belt | 20 | t (1.1) | — |
| 18 | " | g (20) | 262 | 0.970/0.99 | 5.6 | 38 | l (85) | B | 89 | 0.0003 | 75 (10) | — | belt | 20 | t (1.1) | — |
| 19 | " | h (15) | 280 | 0.970/1.00 | 5.4 | 36 | l (85) | B | 91 | 0.0003 | 75(10) | — | belt | 20 | t (1.1) | — |
| 20 | Poly. | a (6) | 295 | 0.961/1.00 | 8.1 | 40 | o (85) | C | 100 | 0.0035 | 75 (10) | q (1.5%) | — | 20 | t (1.1) | — |
| 21 | " | a (6) | 250 | 0.970/1.00 | 8.2 | 38 | p (85) | B | 97 | 0.0017 | 75 (10) | q (1.7%) | — | 20 | t (1.1) | — |
| 22 | " | i (8) | 2400 | 0.968/1.00 | 6.9 | 39 | p (85) | C | 98 | 0.0011 | 75 (10) | — | — | 20 | t (1.1) | — |
| 23 | Poly/seed | i (15) j (4) | 1600 | 0.988/0.99 | 7.0 | 38 | p (70) | C | 38 | 0.0000 | 75 (10) | — | — | 20 | t (1.1) | — |
| 24 | A.Poly | k (5) | 3500 | 0.988/0.98 | 8.3 | 38 | p (90) | C | 100 | 0.0029 | 75 (10) | — | — | — | t (1.1) | — |
| 25 | PV | — | — | 0.920/0.96 | 10.4 | 30 | p (85) | B | 100 | 0.0019 | 75 (10) | — | — | — | t (0.8) | — |
| 26 | PV/SP | — | — | 0.967/0.98 | 10.3 | 28 | p (85) | B | 99 | 0.0011 | 75 (10) | — | — | — | t (0.8) | — |
| 27 | Poly. | a (6) | 80 | 0.988/1.00 | 6.8 | 18 | l (85) | A | 87 | 0.0001 | 75 (10) | q (32 ppm) | belt | 35 | t (1.1) | 1 (2.0) |
| 28 | " | a (6) | 80 | 0.988/1.00 | 6.8 | 18 | l (85) | A | 87 | 0.0001 | 75 (10) | q (32 ppm) | belt | 35 | t (1.1) | 2 (2.0) |
| 29 | " | a (6) | 80 | 0.988/1.00 | 6.8 | 18 | l (85) | A | 87 | 0.0001 | 75 (10) | q (32 ppm) | belt | 35 | t (1.1) | 3 (2.0) |
| 30 | " | a (6) | 80 | 0.988/1.00 | 6.8 | 18 | l (85) | A | 87 | 0.0001 | 75 (10) | q (32 ppm) | belt | 35 | t (1.1) | 4 (2.0) |
| 31 | " | a (6) | 80 | 0.988/1.00 | 6.8 | 18 | l (85) | A | 87 | 0.0001 | 75 (10) | q (32 ppm) | belt | 35 | t (1.1) | 5 (2.0) |
| 32 | " | b (5) | 70 | 0.988/1.00 | 7.1 | 18 | l (85) | A | 83 | 0.0002 | 75 (10) | r (20 ppm) | filter press | 35 | t (1.1) | 1 (2.0) |
| 33 | " | a (6) | 295 | 0.961/1.00 | 8.1 | 40 | o (85) | C | 100 | 0.0035 | 75 (10) | q (1.5%) | — | 35 | t (1.1) | 1 (2.0) |
| 34 | PV | — | — | 0.920/0.96 | 10.4 | 30 | l (85) | B | 100 | 0.0019 | 75 (10) | — | — | — | t (0.8) | 1 (2.0) |
| 35 | PV/SP | — | — | 0.967/0.98 | 10.3 | 28 | l (85) | B | 99 | 0.0010 | 75 (10) | — | — | — | t (0.8) | 1 (2.0) |

*1, *3, *4: Same as in Tables 3 and 5. Other notes appear in the following.

Additional Notes to Table 14

Initiators, etc. are represented by symbols as follows.

(Initiators)

a: t-butyl peroxy-2-ethylhexanoate b: t-butyl peroxydecanoate c: t-butyl peroxypivalate d: t-butyl peroxypivalate e: bis(3-methyl-3-methoxybutyl) peroxydicarbonate f: benzoyl peroxide g: stearoyl peroxide h: ammonium persulfate i: 2,2'-azobis(2,4-dimethylvaleronitrile)

j: bis(t-butylperoxy)hexane k: potassium persulfate (Magnetic Powder)

l: Surface-treated magnetic powder 9 m: Surface-treated magnetic powder 11 n: Surface-treated magnetic powder 12 o: Surface-untreated magnetic powder i p: Surface-treated magnetic powder 10

(Carboxylic Acid)

a: 2-ethylhexanoic acid r: neodecanoic acid s: pivalic acid (Additive)

t: silica treated with hexamethyldisilazane and silicone oil u: silica treated with hexamethyldisilazane d) Photosensitive Member Photosensitive members A–E prepared above were used.

EXAMPLE 31

An image forming apparatus having an organization generally as illustrated in FIG. 1 and obtained by remodeling a commercially available laser beam printer ("LBP-1760", made by Canon K.K.) was used for evaluation of Magnetic toner 1.

As a photosensitive member 100 (image-bearing member), Photosensitive member A (organic photoconductive (OPC) drum) prepared above was used. The photosensitive member 100 was uniformly charged to a dark part potential (Vd) of −700 volts by applying a charging bias voltage comprising a superposition of a DC voltage of −700 volts and an AC of 2.0 kVpp from a charging roller 117 coated with electroconductive carbon-dispersed nylon abutted against the photosensitive member 100. The charged photosensitive member was then exposed at an image part to imagewise layer light 123 from a laser scanner 121 so as to provide a light-part potential ($V_L$) of −150 volts.

A developing sleeve 102 (toner-carrying member) was formed of a surface-blasted 16 mm-dia. aluminum cylinder coated with a ca. 7 μm-thick resin layer of the following composition exhibiting a roughness (JIS center line-average roughness Ra) of 1.0 μm. The developing sleeve 102 was equipped with a developing magnetic pole 90 mT (900 Gauss) and a silicone rubber blade of 1.0 mm in thickness and 1.0 mm in free length as a toner layer thickness regulating member. The developing sleeve 102 was disposed with a gap of 390 μm from the photosensitive member 100.

| | | |
|---|---|---|
| Phenolic resin | 100 | wt. parts |
| Graphite (Dv = ca. 7 μm) | 90 | " |
| Carbon black | 10 | " |

Then, a developing bias voltage of DC −500 volts superposed with an AC voltage of peak-to-peak 1600 volts and frequency of 2000 Hz was applied, and the developing sleeve was rotated at a peripheral speed of 99 mm/sec which was 110% of the photosensitive member peripheral speed (90 mm/sec) in identical directions.

A transfer roller 115 used was one identical to a roller 34 as shown in FIG. 4. More specifically, the transfer roller 34 had a core metal 34*a* and an electroconductive elastic layer 34*b* formed thereon comprising conductive carbon-dispersed ethylene-propylene rubber. The conductive elastic layer 34*b* exhibited a volume resistivity of $1\times10^8$ ohm.cm and a surface rubber hardness of 24 deg. The transfer roller 34 having a diameter of 20 mm was abutted against a photosensitive member 33 (photosensitive member 100 in FIG. 1) at a pressure of 59 N/m (60 g/cm) and rotated at an identical speed as that (90 mm/sec) of the photosensitive member 33 rotating in an indicated arrow A direction while being supplied with a transfer bias voltage of DC 1.5 kV.

A fixing device 126 was an oil-less heat-pressing type device for heating via a film (of "LBP-1760", unlike a roller-type one as illustrated). The pressure roller was one having a surface layer of fluorine-containing resin and a diameter of 30 mm. The fixing device was operated at a fixing temperature of 190° C. and a nip width set to 7 mm.

In this particular example (Example 31), Magnetic toner 1 was first used for image formation on 200 sheets each in environments of normal temperature/normal humidity (25° C./60%RH) and high temperature/high humidity (32° C./85%RH) and then the image forming apparatus including the process cartridge was left overnight in an environment of low temperature/low humidity (15° C./20% RH), followed by image formation on 10 sheets in that environment. Paper of 80 g/m$^2$ was used as the transfer(-receiving) material. The evaluation was performed in the following manner.

Evaluation of Printed-out Images

1) I.D. (Image Density)

The relative image density of a printed solid black image (I.D.) relative to a corresponding solid solid white image on a 50th sheet in the normal temperature/normal humidity environment was measured by a Macbeth densitometer ("RD 918", available from Macbeth Co.) and evaluated according to the following standard.

A: Very good (I.D.≧1.40)

G: Good (I.D.=1.35 to below 1.40)

C: Fair (I.D.=1.00 to below 1.35)

D: Poor (I.D.<1.00)

2) Charge (Charging Stability)

The image density of a solid black image was measured on a 50th sheet each in the normal temperature/normal humidity environment and the high temperature/high humidity environment, and a difference (ΔID) was used as a measure of the charging stability according to the following standard:

A: Very good (ΔID≧0.05)

G: Good (ΔID=0.05 to below 1.10)

C: Fair (ΔID=0.10 to below 0.20)

D: Poor (ΔID<0.20)

3) Transfer(ability)

Transfer-residual toner on the photosensitive member at the time of solid black image formation on a 200th sheet in the high temperature/high humidity environment was peeled off by applying and peeling a polyester adhesive tape, and the Macbeth image density of the peeled adhesive tape applied on white paper was measured relative to that of a blank of the adhesive tape applied on the paper to determine a transfer residue density different (TRD difference), based on which evaluation was made according to the following standard.

A: very good (TRD difference<0.05)

B: good (TRD difference=0.05 to below 0.10)

C: fair (TRD difference=0.10 to below 0.20)

D: poor (TRD difference≧0.20)

4) Fixability

A printed solid black image on a 2nd sheet in the low temperature/low humidity environment was rubbed with a soft tissue paper under a load of 50 g/cm$^2$, and a density lowering after the rubbing was measured as a measure for evaluation of fixability according to the following standard.

A: <5%

B: 5% to below 10%

C: 10% to below 20%

D: ≧20%

Matching with Members of Image Forming Apparatus

1) Drum (Matching with Photosensitive Drum)

The photosensitive drum surface after the print-out test was evaluated by observation with eyes with respect to damages and sticking of transfer-residual toner together with influence of these on the printed images. Evaluation was performed according to the following standard.

A: Not observed at all.

B: Slight scars observed.

C: Sticking and scars observed.

D: Much sticking.

2) Fixer (Matching with Fixing Device)

The fixing film surface after the print-out test was evaluated by observation with eyes with respect to damages and sticking of transfer-residual toner together with influence of these on the printed images. Evaluation was performed according to the following standard.

A: Not observed at all.

B: Slight sticking observed.

C: Sticking and scars observed.

D: Much sticking.

The results of the evaluation are shown in Table 16 together with those of the following Examples and Comparative Examples.

EXAMPLES 32–50

The print-out test and evaluation of Example 31 were repeated except for using Magnetic toners 2–19, and 27, respectively, instead of Magnetic toner 1.

Comparative Examples 14–20

The print-out test and evaluation of Example 31 were repeated except for using Magnetic toners 20–26 instead of Magnetic toner 1.

TABLE 16

| | | Evaluation results | | | | | |
|---|---|---|---|---|---|---|---|
| | | | Charge | | | Matching with | |
| Example | Toner | I.D. | stability | transfer | fixability | Drum | Fixer |
| 31 | 1 | A | B | A | A | A | A |
| 32 | 2 | A | B | A | A | A | A |
| 33 | 3 | A | B | A | A | A | A |
| 34 | 4 | B | A | B | A | A | A |
| 35 | 5 | A | C | A | C | B | C |
| 36 | 6 | B | B | A | B | A | B |
| 37 | 7 | B | B | A | A | A | A |
| 38 | 8 | A | B | B | A | C | A |
| 39 | 9 | A | B | A | C | B | C |
| 40 | 10 | A | B | A | C | B | C |
| 41 | 11 | C | A | A | A | A | A |
| 42 | 12 | A | B | A | C | C | B |
| 43 | 13 | A | B | A | A | A | A |
| 44 | 14 | A | B | A | A | A | A |
| 45 | 15 | A | B | A | A | A | A |
| 46 | 16 | A | B | B | B | B | B |
| 47 | 17 | A | B | B | C | B | C |
| 48 | 18 | B | B | B | B | C | C |
| 49 | 19 | B | C | C | C | B | B |
| 50 | 27 | A | A | A | A | A | A |
| Comp. 14 | 20 | C | C | C | C | D | D |
| Comp. 15 | 21 | D | D | D | D | D | D |
| Comp. 16 | 22 | C | D | D | D | D | D |
| Comp. 17 | 23 | D | C | D | C | C | D |
| Comp. 18 | 24 | C | C | D | D | D | D |
| Comp. 19 | 25 | C | D | D | D | D | C |
| Comp. 20 | 26 | C | D | D | C | C | C |

EXAMPLE 51

Magnetic toner 27 (instead of Magnetic toner a) was used in a cleanerless image forming method similarly as in Example 21 except for modifying the developing conditions as follows.

The developing sleeve (toner-carrying member) was changed to a developing sleeve comprising a surface-blasted 16 mm-dia. aluminum cylinder coated with a ca. 7 μm-thick resin layer of the following composition exhibiting a roughness (JIS center line-average roughness Ra) of 1.0 Wm. and equipped with a magnet roll enclosed therein to provide a developing magnetic pole of 90 mT (900 Gauss) and also a urethane-made elastic blade of 1.0 mm in thickness and 1.5 mm in free length as a toner layer thickness-regulating member abutted at a linear pressure of 29.4 N/m (30 g/cm) against the sleeve. The sleeve was dispersed with a gap of 290 μm from the photosensitive drum.

| | | |
|---|---|---|
| Phenolic resin | 100 | wt. parts |
| Graphite (Dv = ca. 7 μm) | 90 | " |
| Carbon black | 10 | " |

In this Example, 120 g of Magnetic toner 27 was charged in a toner cartridge and first used for image formation (in an intermittent mode of taking a pause after printing on each sheet) for printing an image pattern at an areal ratio of 2% on 1000 sheets each in the environments of normal temperature/normal humidity (25° C./60% RH) and high temperature/high humidity (32° C./85% RH) until the toner in the cartridge was reduced to a small amount. A4-size paper of 80 g/m$^2$ was used as the transfer material. As a result, no lowering in developing performance was observed during the continual intermittent print test in any of the environments. No problem was observed either regarding the change in chargeability between the different embodiment.

After the intermittent printing on 1000 sheets in the normal temperature/normal humidity environment, a part on the charging roller 22 abutted against the photosensitive member 21 was injected by application and peeling of an adhesive, whereby the charging roller 22 was almost completely coated with the almost white zinc oxide particles (Electro-conductive fine powder 1) at a density of ca. $3\times10^5$ particles/mm$^2$ while a slight amount of transfer-residual toner was recognized. Further, as a result of observation through a scanning electron microscope of a part on the photosensitive member 21 abutted against the charging roller 22, the surface was covered with a tight layer of electroconductive fine powder of very fine particle size and no sticking of transfer-residual toner was observed.

Further, presumably because electroconductive fine powder 1 having a sufficiently low resistivity was present at the contact part n between the photosensitive member 21 and the charging roller 22, image defects attributable to charging failure was not observed from the initial stage until completion of the intermittent printing test on 1000 sheets, thus showing good direct injection charging performance.

Further, Photosensitive member B having the surfacemost layer exhibiting a volume resistivity of $5\times10^{12}$ ohm.cm, character images were formed with a sharp contour exhibiting the maintenance of an electrostatic latent image and a sufficient chargeability even after the intermittent print-out test on 1000 sheets. The photosensitive member exhibited a potential of −670 volts in response to direct charging at an applied voltage of −700 volts after the intermittent printing-out on 1000 sheets, thus showing only a slight lowering in chargeability of −10 volts and no lowering in image quality due to lower chargeability.

Further, presumably partly owing to the use of Photosensitive member B having a surface showing a contact angle with water of 102 deg., the transfer efficiency was very excellent at both the initial stage and after the intermittent print-out on 1000 sheets. However, even after taking such a smaller amount of transfer-residual toner particles remaining on the photosensitive member after the transfer step after the intermittent printing-out on 1000 sheets into consideration, it is understandable that the recovery of the transfer-residual toner in the developing step was well effected judging from the fact that only a slight amount of transfer-residual toner was recognized on the charging roller 2 after the intermittent printing-out on 1000 sheets and the resultant images were accompanied with little fog at the non-image portion. Further, the scars on the photosensitive member after the intermittent printing-out on 1000 sheets were slight and the image defects appearing in the resultant images attributable to the scars were suppressed to a practically acceptable level.

The evaluation of the print-out test was performed in the following manner with respect to the print-out images and the matching with members of the image forming apparatus as follows.

Evaluation of Printed-out Images

1) I.D. (Image Density)

The relative image density of a printed solid black image (I.D.) relative to a corresponding solid solid white image on a 500th sheet in the normal temperature/normal humidity environment was measured by a Macbeth densitometer ("RD 918", available from Macbeth Co.) and evaluated according to the following standard.

A: Very good (I.D.≧1.40)

G: Good (I.D.=1.35 to below 1.40)

C: Fair (I.D.=1.00 to below 1.35)

D: Poor (I.D.<1.00)

2) Charge (Charging Stability)

The image density of a solid black image was measured on a 500th sheet each in the normal temperature/normal humidity environment and the high temperature/high humidity environment, and a differenceΔID) was used as a measure of the charging stability according to the following standard:

A: Very good (ΔID≦0.05)

G: Good (ΔID=0.05 to below 1.10)

C: Fair (ΔID=0.10 to below 0.20)

D: Poor (ΔID<0.20)

3) Transfer(ability)

Transfer-residual toner on the photosensitive member at the time of solid black image formation on a 500th sheet in the high temperature/high humidity environment was peeled off by applying and peeling a polyester adhesive tape, and the Macbeth image density of the peeled adhesive tape applied on white paper was measured relative to that of a blank of the adhesive tape applied on the paper to determine a transfer residue density difference (TRD difference), based on which evaluation was made according to the following standard.

A: very good (TRD difference<0.05)

B: good (TRD difference=0.05 to below 0.10)

C: fair (TRD difference=0.10 to below 0.20)

D: poor (TRD difference≧0.20)

4) Fixability

The soiling occurring on back sides of printed image samples was observed with eyes from the 7id;. initial stage until the end of the print-out test and evaluated according to the following standard.

A: No soil at all.

B: Slight soil observed as a result of careful observation.

C: Several sheets were somewhat soiled.

D: A large number of sheets were soiled.

5) Charge ΔV (Lowering in Chargeability)

The potential on the photosensitive member after the uniform charging was measured at the initial stage ($V_I$) and after the print-out test ($V_F$),and a difference between these values ($\Delta V=|V_F|-|V_I|$) was indicated as a measure of stable chargeability. A negatively large value of ΔV represents a larger lowering in chargeability.

6) Conductor Density (Density of Electroconductive Fine Powder)

The density of electroconductive fine powder present at the contact part between the photosensitive member and the contact charging member was measured by observation through a video microscope described hereinbefore. A density in the range of $1\times10^4$–$5\times10^5$ particles/mm$^2$ is generally preferred.

Matching with Members of Image Forming Apparatus

1) Drum (Matching with Photosensitive Drum)

The photosensitive drum surface after the print-out test was evaluated by observation with eyes with respect to damages and sticking of transfer-residual toner together with influence of these on the printed images. Evaluation was performed according to the following standard.

A: Not observed at all.

B: Slight scars observed.

C: Sticking and scars observed.

D: Much sticking.

The results of the evaluation are shown in Table 16 together with those of the following Examples and Comparative Examples.

EXAMPLES 52–54

The print-out test and evaluation were performed in the same manner as in Example 51 except for using Photosensitive members C, D and E, respectively, instead of Photosensitive member B.

EXAMPLE 55

The print-out test and evaluation of Example 21 were repeated except for using Charging member B (charging brush roller) used in Example 25 instead of Charging member A. The image-forming apparatus used in this Example is illustrated in FIG. 6, wherein Charging member B was used as a charging brush roller 22'.

EXAMPLES 56–60

The print-out test and evaluation of Example 51 were repeated except for using Magnetic toners 28–32, respectively, instead of Magnetic toner 27.

Comparative Examples 21–23

The print-out test and evaluation of Example 21 were repeated except for using Magnetic toner 33–35, respectively, instead of Magnetic toner 27.

TABLE 17

| Example | Photosensitive member | Charging member | Toner | I.D. | Charge ΔID | Transfer | Fixability | Charge ΔV | Conductor density | Matching with drum |
|---|---|---|---|---|---|---|---|---|---|---|
| 51 | B | A | 27 | A | A | A | A | −20 | $1 \times 10^5$ | A |
| 52 | C | A | 27 | B | A | B | A | −30 | $1 \times 10^5$ | A |
| 53 | D | A | 27 | A | A | A | A | −20 | $1 \times 10^5$ | A |
| 54 | E | A | 27 | B | B | B | A | −40 | $6 \times 10^3$ | C |
| 55 | B | B | 27 | B | B | A | A | −40 | $2 \times 10^2$ | C |
| 56 | B | A | 28 | A | A | A | A | −20 | $3 \times 10^4$ | A |
| 57 | B | A | 29 | A | A | A | A | −10 | $8 \times 10^4$ | A |
| 58 | B | A | 30 | B | B | A | A | −50 | $4 \times 10^2$ | B |
| 59 | B | A | 31 | A | A | B | A | −20 | $3 \times 10^4$ | A |
| 60 | B | A | 32 | A | A | A | A | −20 | $1 \times 10^5$ | A |
| Comp. 21 | B | A | 33 | D | D | D | C | −60 | $1 \times 10^5$ | D |
| Comp. 22 | B | A | 34 | C | C | D | C | −60 | $1 \times 10^5$ | D |
| Comp. 23 | B | A | 35 | C | C | D | C | −60 | $1 \times 10^5$ | D |

What is claimed is:

1. A magnetic toner, comprising:

(a) magnetic toner particles each comprising at least a binder resin and magnetic toner, and (b) inorganic fine powder externally blended with the magnetic tone particles;

(c) wherein the magnetic toner has an average circularity of at least 0.970, the magnetic toner has a magnetization of 10–50 $Am^2/kg$ at a magnetic field of 79.6 kA/m, the magnetic powder comprises at least magnetic iron oxide, the magnetic toner particles retain carbon in an amount of A and iron in an amount of B at surfaces thereof as measured by X-ray photoelectron spectroscopy, satisfying: $B/A<0.001$, the binder resin comprises a resin formed by polymerization of a monomer comprising at least styrene monomer, the magnetic toner has a residual styrene monomer content of less than 300 ppm, and the magnetic toner contains at least 50% by number of toner particles satisfying a relationship of $$D/C \leqq 0.02,$$

wherein C represents a volume-average particle size of the magnetic toner, and D represents a minimum distance between a surface of a magnetic toner particle and magnetic powder particles contained in the magnetic toner particle.

2. The magnetic toner according to claim 1, wherein the magnetic toner has a residual magnetization of below 7 $Am^2/kg$ at a magnetic field of 79.6 kA/m.

3. The magnetic toner according to claim 1, wherein the magnetic toner has a residual magnetization of below 10 $Am^2/kg$ at a magnetic field of 79.6 kA/m.

4. The magnetic toner according to claim 1, wherein the magnetic toner has a residual magnetization of below 5 $Am^2/kg$ at a magnetic field of 79.6 kA/m.

5. The magnetic toner according to claim 1, wherein the magnetic toner contains at least 65% by number of toner particles satisfying $D/C \leqq 0.02$.

6. The magnetic toner according to claim 1, wherein the magnetic toner contains at least 75% by number of toner particles satisfying $D/C \leqq 0.02$.

7. The magnetic toner according to claim 1, wherein the magnetic toner contains 10–200 wt. parts of the magnetic powder per 100 wt. parts of the binder resin.

8. The magnetic toner according to claim 1, wherein the magnetic toner shows a heat-absorption peak in a range of 40–110° C. on a DSC curve obtained by differential scanning calorimetry.

9. The magnetic toner according to claim 1, wherein the magnetic toner shows a heat-absorption peak in a range of 45–90° C. on a DSC curve obtained by differential scanning calorimetry.

10. The magnetic toner according to claim 8, wherein the toner particles further contain a wax giving the heat-absorption peak on the DSC curve.

11. The magnetic toner according to claim 9, wherein the toner particles further contain a wax giving the heat-absorption peak on the DSC curve.

12. The magnetic toner according to claim 1, wherein the magnetic toner contains 0.5–50 wt. parts of a wax per 100 wt. parts of the binder resin.

13. The magnetic toner according to claim 1, wherein the binder resin comprises a resin formed by polymerization of the monomer comprising at least styrene monomer in the presence of a peroxide polymerization initiator.

14. The magnetic toner according to claim 13, wherein the peroxide polymerization initiator comprises an organic peroxide.

15. The magnetic toner according to claim 14, wherein the organic peroxide comprises at least one species selected from the group consisting of peroxy esters, peroxy dicarbonates, diacyl peroxides, peroxy ketals, and dialkyl peroxides.

16. The magnetic toner according to claim 14, wherein the organic peroxide is a peroxy ester or a diacyl peroxide.

17. The magnetic toner according to claim 13, wherein the peroxide polymerization initiator comprises a diacyl peroxide, and the magnetic toner contains at most 2000 wt. ppm of a carboxylic acid originated from the diacyl peroxide.

18. The magnetic toner according to claim 17, wherein the magnetic toner contains at most 1000 wt. ppm of a carboxylic acid originated from the diacyl peroxide.

19. The magnetic toner according to claim 17, wherein the magnetic toner contains at most 500 wt. ppm of a carboxylic acid originated from the diacyl peroxide.

20. The magnetic toner according to claim 13, wherein the peroxide polymerization initiator comprises a peroxy ester, and the magnetic toner contains at most 2000 wt. ppm of a carboxylic acid originated from the peroxy ester.

21. The magnetic toner according to claim 20, wherein the magnetic toner contains at most 1000 wt. ppm of a carboxylic acid originated from the peroxy ester.

22. The magnetic toner according to claim 20, wherein the magnetic toner contains at most 500 wt. ppm of a carboxylic acid originated from the peroxy ester.

23. The magnetic toner according to claim 1, wherein the magnetic powder contains phosphorus in an amount of 0.05–5.0 wt. % of iron.

24. The magnetic toner according to claim 1, wherein the magnetic powder contains silicon in an amount of at most 5.0 wt. % of iron.

25. The magnetic toner according to claim 1, wherein the magnetic powder has been surface-treated for hydrophobization.

26. The magnetic toner according to claim 1, wherein the magnetic powder has been surface-treated with a coupling agent in an aqueous medium.

27. The magnetic toner according to claim 1, wherein the inorganic fine powder comprises hydrophobized inorganic fine powder having a number-average primary particle size of 4–80 nm.

28. The magnetic toner according to claim 1, wherein the inorganic fine powder comprises fine powder having a number-average primary particle size of an inorganic oxide selected from the group consisting of silica, titanium oxide, alumina and double oxides of these.

29. The magnetic toner according to claim 1, wherein the inorganic fine powder has been surface-treated with at least silicone oil.

30. The magnetic toner according to claim 1, wherein the inorganic fine powder has been simultaneously treated with at least a silane compound and silicone oil.

31. The magnetic toner according to claim 1, wherein the inorganic fine powder has been treated with at least a silane compound and then with silicone oil.

32. The magnetic toner according to claim 1, wherein the magnetic toner has a mode circularity of at least 0.99.

33. The magnetic toner according to claim 1, wherein the magnetic toner contains electroconductive fine powder having a volume-average particle size smaller than that of the magnetic toner.

34. The magnetic toner according to claim 33, wherein the electroconductive fine powder has a resistivity of at most $1\times10^9$ ohm.cm.

35. The magnetic toner according to claim 33, wherein the electroconductive fine powder has a resistivity of at most $1\times10^6$ ohm.cm.

36. The magnetic toner according to claim 33, wherein the electroconductive fine powder is non-magnetic.

37. A process for producing a magnetic toner including:

a polymerization step of polymerizing a monomer composition comprising at least styrene monomer and magnetic powder by suspension polymerization in the presence of a peroxide polymerization initiator in an aqueous medium; to form magnetic toner particles, and a step of blending the magnetic toner particles with at least inorganic fine powder to provide a magnetic toner, comprising: magnetic toner particles each comprising at least a binder resin and magnetic toner, and inorganic fine powder; wherein the magnetic toner has an average circularity of at least 0.970, the magnetic toner has a magnetization of 10–50 $Am^2/kg$ at a magnetic field of 79.6 kA/m, the magnetic powder comprises at least magnetic iron oxide, the magnetic toner particles retain carbon in an amount of A and iron in an amount of B at surfaces thereof as measured by X-ray photoelectron spectroscopy, satisfying: $B/A<0.001$, the binder resin comprises a resin formed by polymerization of a monomer comprising at least styrene monomer, the magnetic toner has a residual styrene monomer content of less than 300 ppm, and the magnetic toner contains at least 50% by number of toner particles satisfying a relationship of $$D/C\leqq0.02,$$

wherein C represents a volume-average particle size of the magnetic toner, and D represents a minimum distance between a surface of a magnetic toner particle and magnetic powder particles contained in the magnetic toner particle.

38. The process according to claim 37, wherein the peroxide polymerization initiator comprises an organic peroxide.

39. The process according to claim 38, wherein the organic peroxide comprises at least one species selected from the group consisting of peroxy esters, peroxy dicarbonates, diacyl peroxides, peroxy ketals, and dialkyl peroxides.

40. The process according to claim 38, wherein the organic peroxide is a peroxy ester or a diacyl peroxide.

41. The process according to claim 37, wherein the suspension polymerization is performed at a weight ratio between the monomer composition and the aqueous medium of 20:80–60:40.

42. The process according to claim 37, wherein the suspension polymerization is performed at a weight ratio between the monomer composition and the aqueous medium of 30:70–50:50.

43. The process according to claim 37, further including a separation step after the polymerization step of substantially separating the toner particles and the aqueous medium in an alkaline state.

44. The process according to claim 43, further including a step of contacting the toner particles after the separation step with water of below pH 4 prepared by addition of an acid.

45. The process according to claim 37, further including a step of adjusting the aqueous medium to pH 10–12 by adding an alkali to the aqueous medium.

46. The process according to claim 37, wherein the magnetic powder contains phosphorus in an amount of 0.05–5.0 wt. % of iron.

47. The process according to claim 37, wherein the magnetic powder contains silicon in an amount of at most 5.0 wt. % of iron.

48. An image forming method, comprising at least:

a charging step of charging an image-bearing member by a charging member supplied with a voltage, an electrostatic latent image forming step of forming an electrostatic latent image on the charged image-bearing member, a developing step of transferring a toner carried on a toner-carrying member onto the electrostatic latent image formed on the image-bearing member to form a toner image on the image-bearing member, and a transfer step of electrostatically transferring the toner image formed on the image-bearing member onto a transfer material, wherein the toner is a magnetic toner according to claim 1.

49. The image forming method according to claim 48, wherein the charging step is a step of applying a voltage to a contact charging member disposed in contact with the image-bearing member to charge the image-bearing member.

50. The image forming method according to claim 48, wherein the developing step also functions as a cleaning step of recovering a portion of the toner remaining on the image-bearing member after transferring the toner image to the transfer material in the transfer step.

51. The image forming method according to claim 49, wherein the magnetic toner contains electroconductive fine powder which is attached to the image-bearing member in the developing step, remains on the image-bearing member after the transfer step, and is present at or in proximity to the contact position between the contact charging member and the image-bearing member in the charging step.

52. The image forming method according to claim 51, wherein in the charging step, the electro-conductive fine powder is present in a density of $1\times10^3$–$5\times10^5$ particles/$mm^2$ at the contact position between the contact charging member and the image-bearing member.

53. The image forming method according to claim 49, wherein in the charging step, the contact charging member and the image-bearing member are moved with a relative surface speed difference therebetween at the contact position.

54. The image forming method according to claim 49, wherein in the charging step, the contact charging member and the image-bearing member are moved with their surface moving directions which are opposite to each other at the contact position.

55. The image forming method according to claim 49, wherein the contact charging member is a roller member having an Asker C hardness of at most 50 deg.

56. The image forming method according to claim 49, wherein the contact charging member is a roller member having a surface provided with concavities having an average sphere-equivalent diameter of 5–300 $\mu$m and arranged to occupy 15–80% by area of the surface.

57. The image forming method according to claim 49, wherein the contact charging member is an electroconductive brush member.

58. The image forming method according to claim 49, wherein the contact charging member has a volume resistivity of $1\times10^3$–$1\times10^8$ ohm.cm.

59. The image forming method according to claim 49, wherein in the charging step, the contact charging member is supplied with a DC voltage alone or in superposition with an AC voltage having a peak-to-peak voltage of below 2×Vth, wherein Vth represents a discharge initiation voltage and DC voltage application.

60. The image forming method according to claim 49, wherein in the charging step, the contact charging member is supplied with a DC voltage alone or in superposition with an AC voltage having a peak-to-peak voltage of below Vth, wherein Vth represents a discharge initiation voltage under DC voltage application.

61. The image forming method according to claim 48, wherein the image-bearing member has a surfacemost layer having a volume resistivity of $1\times10^9$–$1\times10^{14}$ ohm.cm.

62. The image forming method according to claim 48, wherein the image-bearing member has a surfacemost layer comprising a resin and at least electro-conductive fine particles comprising a metal oxide dispersed in the resin.

63. The image forming method according to claim 48, wherein the image-bearing member has a surface exhibiting a contact angle with water of at least 85 deg.

64. The image forming method according to claim 48, wherein the image-bearing member has a surfacemost layer comprising a resin and at least one species of lubricating fine particles selected from the group consisting of fluorine-containing resin particles, silicone resin particles and polyolefin resin particles and dispersed in the resin.

65. The image forming method according to claim 48, wherein the image-bearing member is a photosensitive member comprising a photoconductive substance.

66. The image forming method according to claim 48, wherein in the electrostatic latent-image forming step, the charged image-bearing member is exposed to imagewise exposure light to form an electrostatic latent image.

67. The image forming method according to claim 48, wherein in the developing step, the toner-carrying member is moved at a surface speed which is 0.7–7.0 times that of the image-bearing member at the developing position.

68. The image forming method according to claim 48, wherein in the developing step, the toner-carrying member is moved at a surface speed which is 1.05–3.00 times that of the image-bearing member at the developing position.

69. The image forming method according to claim 48, wherein the toner-carrying member has a surface roughness Ra of 0.2–3.5 $\mu$m.

70. The image forming method according to claim 48, wherein in the developing step, the toner is formed in a layer of 5–50 g/m$^2$ on the toner-carrying member and transferred onto the electrostatic latent image on the image-bearing member.

71. The image forming method according to claim 48, wherein the toner is applied on the toner-carrying member in an amount controlled by a toner layer thickness-regulating member abutted against the toner-carrying member.

72. The image forming method according to claim 71, wherein the toner layer thickness regulating member is an elastic member.

73. The image forming method according to claim 48, wherein the toner-carrying member is disposed opposite to the image-bearing member at the developing position with a gap of 100–1000 $\mu$m therebetween.

74. The image forming method according to claim 48, wherein in the developing step, the magnetic toner is applied on the toner-carrying member in a thickness which is smaller than a gap disposed between the toner-carrying member and the image-bearing member at the developing position.

75. The image forming method according to claim 48, wherein in the developing step, an AC bias electric field of a peak-to-peak intensity of $3\times10^6$–$1\times10^7$ volts/m and a frequency of 100–5000 Hz is applied as a developing bias electric field between the toner-carrying member and the image-bearing member.

76. The image forming method according to claim 48, wherein in the transfer step, a transfer member is abutted against the image-bearing member via the transfer material to transfer the toner image on the image-bearing member to the transfer material.

77. An image forming apparatus, comprising:

an image-bearing member for carrying an electrostatic latent image thereon, a charging means including a charging member supplied with a voltage for charging the image-bearing member, a latent image forming means for forming an electrostatic latent image on the image-bearing member, a developing means including a toner-carrying member for transferring a toner carried on the toner-carrying member onto the electrostatic latent image to form a toner image on the image-bearing member, and a transfer means for electrostatically transferring the toner image on the image-bearing member onto a transfer material, wherein the toner is a magnetic toner according to claim 1.

78. The image forming apparatus according to claim 77, wherein said charging means includes a contact charging member disposed in contact with the image-bearing member at a contact position and supplied with a voltage to charge the image-bearing member.

79. A process cartridge detachably mountable to a main assembly of an image forming apparatus including an image-bearing member for carrying an electrostatic latent image thereon, a charging means including a charging member supplied with a voltage for charging the image-bearing member; a latent image forming means for forming an electrostatic latent image on the image-bearing member; a developing means including a toner-carrying member for transferring a toner carried on the toner-carrying member onto the electrostatic latent image to form a toner image on the image-bearing member; and a transfer means for electrostatically transferring the toner image on the image-bearing member onto a transfer material;

wherein said process cartridge comprises the charging means integrally supported together with at least one of the image-bearing member and the charging means, and said toner is a magnetic toner according to claim 1.

80. The process cartridge according to claim 79, wherein the charging member is a contact charging member disposed in contact with the image-bearing member at a contact position and supplied with a voltage to charge the image-bearing member.

81. The process cartridge according to claim 79, wherein the developing means also functions as a cleaning means for recovering a portion of the toner remaining on the image-bearing member after transferring the toner image to the transfer material.

82. The process cartridge according to claim 79, wherein the magnetic toner contains electro-conductive fine powder which is attached to the image-bearing member from the developing means, remains on the image-bearing member after passing by the transfer means, and is present at or in proximity to the contact position between the contact charging member and the image-bearing member.

83. The image forming method according to claim 82, wherein the electroconductive fine powder is present in a density of $1\times10^3$–$5\times10^5$ particles/mm$^2$ at the contact position between the contact charging member and the image-bearing member.

84. The image forming method according to claim 80, wherein the contact charging member and the image-bearing member are moved with a relative surface speed difference therebetween at the contact position.

85. The image forming method according to claim 80, wherein the contact charging member and the image-bearing member are moved with their surface moving directions which are opposite to each other at the contact position.

86. The image forming method according to claim 80, wherein the contact charging member is a roller member having an Asker C hardness of at most 50 deg.

87. The process cartridge according to claim 80, wherein the contact charging member is a roller member having a surface provided with concavities having an average sphere-equivalent diameter of 5–300 $\mu$m and arranged to occupy 15–80% by area of the surface.

88. The process cartridge according to claim 80, wherein the contact charging member is an electroconductive brush member.

89. The process cartridge according to claim 80, wherein the contact charging member has a volume resistivity of $1\times10^3$–$1\times10^8$ ohm.cm.

90. The process cartridge according to claim 80, wherein the contact charging member is supplied with a DC voltage alone or in superposition with an AC voltage having a peak-to-peak voltage of below 2×Vth, wherein Vth represents a discharge initiation voltage and DC voltage application.

91. The process cartridge according to claim 80, wherein the contact charging member is supplied with a DC voltage alone or in superposition with an AC voltage having a peak-to-peak voltage of below Vth, wherein Vth represents a discharge initiation voltage and DC voltage application.

92. The process cartridge according to claim 79, wherein the image-bearing member has a surfacemost layer having a volume resistivity of $1\times10^9$–$1\times10^{14}$ ohm.cm.

93. The process cartridge according to claim 79, wherein the image-bearing member has a surfacemost layer comprising a resin and at least electro-conductive fine particles comprising a metal oxide dispersed in the resin.

94. The process cartridge according to claim 79, wherein the image-bearing member has a surface exhibiting a contact angle with water of at least 85 deg.

95. The process cartridge according to claim 79, wherein the image-bearing member has a surfacemost layer comprising a resin and at least one species of lubricating fine particles selected from the group consisting of fluorine-containing resin particles, silicone resin particles and polyolefin resin particles and dispersed in the resin.

96. The process cartridge according to claim 79, wherein the image-bearing member is a photosensitive member comprising a photoconductive substance.

97. The process cartridge according to claim 79, wherein the charged image-bearing member exposed to imagewise exposure light to form an electrostatic latent image by the latent image forming means.

98. The process cartridge according to claim 79, wherein the toner-carrying member in the developing means is moved at a surface speed which is 0.7–7.0 times that of the image-bearing member at the developing position.

99. The process cartridge according to claim 79, wherein the toner-carrying member in the developing means is moved at a surface speed which is 1.05–3.00 times that of the image-bearing member at the developing position.

100. The process cartridge according to claim 79, wherein the toner-carrying member has a surface roughness Ra of 0.2–3.5 $\mu$m.

101. The process cartridge according to claim 79, wherein the toner is formed in a layer of 5–50 g/m$^2$ on the toner-carrying member and transferred onto the electrostatic latent image on the image-bearing member by the developing means.

102. The process cartridge according to claim 72, wherein the developing means further includes a toner layer thickness-regulating member abutted against the toner-carrying member for applying the toner on the toner-carrying member in a controlled thickness.

103. The process cartridge according to claim 102, wherein the toner layer thickness-regulating member in an elastic member.

104. The process cartridge according to claim 79, wherein the toner-carrying member is disposed opposite to the image-bearing member at the developing position with a gap of 100–1000 $\mu$m therebetween.

105. The process cartridge according to claim 79, wherein the magnetic toner is applied on the toner-carrying member in a thickness which is smaller than a gap disposed between the toner-carrying member and the image-bearing member at the developing position.

106. The process cartridge according to claim 79, wherein the developing means further includes a bias voltage application means for forming an AC bias electric field of a peak-to-peak intensity of $3\times10^6$–$1\times10^7$ volts/m and a frequency of 100–5000 Hz as a developing bias electric field between the toner-carrying member and the image-bearing member.

107. An image forming method, comprising at least:

a charging step of charging an image-bearing member by a charging member supplied with a voltage, an electrostatic latent image forming step of forming an electrostatic latent image on the charged image-bearing member;

a developing step of transferring a toner carried on a toner-carrying member onto the electrostatic latent image formed on the image-bearing member to form a toner image on the image-bearing member, and a transfer step of electrostatically transferring the toner image formed on the image-bearing member onto a transfer material, wherein the toner is a magnetic toner according to any one of claims 2 to 36.

108. An image forming apparatus, comprising:

an image-bearing member for carrying an electrostatic latent image thereon, a charging means including a charging member supplied with a voltage for charging the image-bearing member, a latent image forming means for forming an electrostatic latent image on the image-bearing member, a developing means including a toner-carrying member for transferring a toner carried on the toner-carrying member onto the electrostatic latent image to form a toner image on the image-bearing member, and a transfer means for electrostatically transferring the toner image on the image-bearing member onto a transfer material, wherein the toner is a magnetic toner according to any one of claims 2 to 36.

109. A process cartridge detachably mountable to a main assembly of an image forming apparatus including an image-bearing member for carrying an electrostatic latent image thereon, a charging means including a charging member supplied with a voltage for charging the image-bearing member; a latent image forming means for forming an electrostatic latent image on the image-bearing member; a developing means including a toner-carrying member for transferring a toner carried on the toner-carrying member onto the electrostatic latent image to form a toner image on the image-bearing member; and a transfer means for electrostatically transferring the toner image on the image-bearing member onto a transfer material;

wherein said process cartridge comprises the charging means integrally supported together with at least one of the image-bearing member and the charging means, and said toner is a magnetic toner according to any one of claims 2 to 36.

* * * * *

UNITED STATES PATENT AND TRADEMARK OFFICE

CERTIFICATE OF CORRECTION

PATENT NO. : 6,465,144 B2
DATED : October 15, 2002
INVENTOR(S) : Akira Hashimoto et al.

It is certified that error appears in the above-identified patent and that said Letters Patent is hereby corrected as shown below:

Title page,
Item [56], References Cited, FOREIGN PATENT DOCUMENTS,
"3-9045 2/2000" should read -- 3-9045 2/91 --; and
"3-103878 10/2000" should read -- 3-103878 10/91 --.
Item [57], ABSTRACT, "electrohotographic" should read -- electrophotographic --.

Column 2,
Line 13, "are" should read -- is --; and
Line 49, "such a" should read -- such as --.

Column 3,
Line 53, "are however" should read -- are, however, --.

Column 5,
Line 44, "the toner" should read -- whether the toner --; and
Line 56, "disclosed" should read -- are disclosed --.

Column 6,
Line 1, "disclosed" should read -- been disclosed --.

Column 7,
Line 54, "image-baring" should read -- image-bearing --.

Column 8,
Line 19, "mechanism" should read -- mechanisms --; and
Line 29, "wile" should read -- while --.

Column 11,
Line 47, "comprising" should read -- comprises --.

Column 15,
Line 27, "ing" should read -- ing images --; and
Line 35, "left a" should read -- left --.

Column 17,
Line 16, "dimethyl aminoethyl" should read -- dimethylaminoethyl --; and
Line 42, "is" should read -- it is --.

UNITED STATES PATENT AND TRADEMARK OFFICE

CERTIFICATE OF CORRECTION

PATENT NO. : 6,465,144 B2
DATED : October 15, 2002
INVENTOR(S) : Akira Hashimoto et al.

It is certified that error appears in the above-identified patent and that said Letters Patent is hereby corrected as shown below:

Column 18,
Line 16, "a low" should read -- low --.

Column 21,
Line 46, "metal" should read -- metals --.

Column 22,
Line 57, "50" should read -- 5.0 --.

Column 23,
Line 4, "power" should read -- powder --.

Column 29,
Line 62, "measure" should read -- measured --.

Column 30,
Line 8, "an" should read -- and --; and
Line 23, "electro-conductive" should read -- electroconductive --.

Column 31,
Line 20, "C., this" should read -- C. This --.

Column 33,
Line 35, "particle" should read -- particles --.

Column 35,
Line 12, "monoment" should read -- monomet --; and
Line 15, "presentset" should read -- present --.

Column 36,
Line 37, "In" should read -- In a --; and
Line 42, "ca" should read -- ca. --.

Column 37,
Line 2, "rom" should read -- from --; and
Line 11, "10,000" should read -- 10,000, --.

UNITED STATES PATENT AND TRADEMARK OFFICE

CERTIFICATE OF CORRECTION

PATENT NO. : 6,465,144 B2
DATED : October 15, 2002
INVENTOR(S) : Akira Hashimoto et al.

It is certified that error appears in the above-identified patent and that said Letters Patent is hereby corrected as shown below:

Column 38,
Line 18, "by sing" should read -- by using --; and
Line 22, "a a" should read -- a --.

Column 39,
Line 11, "an" should read -- and --; and
Line 50, "and" should read -- are --.

Column 42,
Line 6, "u,: image" should read -- image --.

Column 45,
Line 47, "124." should read -- 124, --.

Column 46,
Line 1, "such a" should read -- such as --;
Line 46, "R means" should read -- means --; and
Line 63, "blow" should read -- below --.

Column 47,
Line 22, "at at least" should read -- at least at --.

Column 51,
Line 14, "$5x10^5$)" should read -- $5x10^5$--.

Column 55,
Line 17, "1(Ø0)" should read -- 100 (V), --.

Column 57,
Line 5, "of" should read -- of a --.

Column 61,
Line 34, "toner carrying" should read -- toner --; and
Line 54, "(VII)" should read -- (VII). --.

Column 62,
Line 12, "used" should read -- use --; and
Line 35, "an" should read -- and --.

UNITED STATES PATENT AND TRADEMARK OFFICE

CERTIFICATE OF CORRECTION

PATENT NO. : 6,465,144 B2
DATED : October 15, 2002
INVENTOR(S) : Akira Hashimoto et al.

It is certified that error appears in the above-identified patent and that said Letters Patent is hereby corrected as shown below:

Column 63,
Line 56, "be" should be deleted.

Column 64,
Line 44, "In" should read -- In a --.

Column 65,
Line 28, "includes" should read -- including --; and
Line 47, "an" should read -- and --.

Column 69,
Line 33, "containing" should read -- containing $Ca_3(PO_4)_2$. --.

Column 77,
Table 3, "t-butylperoxy-2-ethylkhexanoate" should read
-- t-butyl peroxy-2-ethylkhexanoate --.

Column 83,
Line 66, "ther" should read -- there --; and
Line 67, "ebetween" should read -- between --.

Column 89,
Line 25, "$5x10^9$" should read -- $5x10^8$ --; and

Column 93,
Line 49, "ther" should read -- there --; and
Line 50, "ebetween" should read -- between --.

Column 95,
Table 12, "i" should read -- I --.

Column 97,
Line 25, "a gent" should read -- agent --.

Column 98,
Line 47, "(SBET)" should read -- ($S_{BET}$) -- and "treatment)" should read -- treatment) --.

UNITED STATES PATENT AND TRADEMARK OFFICE

CERTIFICATE OF CORRECTION

PATENT NO. : 6,465,144 B2
DATED : October 15, 2002
INVENTOR(S) : Akira Hashimoto et al.

It is certified that error appears in the above-identified patent and that said Letters Patent is hereby corrected as shown below:

Column 100,
Line 43, "he" should read -- the --.

Column 101,
Line 40, "using using" should read -- using --; and
Line 45, "(Comparative" should read -- (Comparative) --.

Column 102,
Line 37, "50%" should read -- 50%. --.

Column 104,
Line 40, "particles" should read -- particles 1. --; and
Line 46, "particles" should read -- particles 1. --.

Column 105,
Table 14, "75(10)" should read -- 75 (10) --.

Column 108,
Line 47, "solid solid" should read -- solid --.

Column 110,
Line 46, "1.0 Wm." should read -- 1.0 μm, --.

Column 111,
Line 67, "solid solid" should read -- solid --.

Column 112,
Line 15, "difference ΔID)" should read -- difference (ΔID) --;
Line 17, "standard:" should read -- standard. --; and
Line 43, "7id;." should be deleted.

Column 120,
Lines 23 and 28, "image forming method" should read -- process cartridge --; and
Lines 32 and 36, "image forming method" should read -- process cartridge --.

UNITED STATES PATENT AND TRADEMARK OFFICE

CERTIFICATE OF CORRECTION

PATENT NO. : 6,465,114 B2
DATED : October 15, 2002
INVENTOR(S) : Akira Hashimoto et al.

It is certified that error appears in the above-identified patent and that said Letters Patent is hereby corrected as shown below:

Column 121,
Line 14, "exposed" should read -- is exposed --; and
Line 39, "in an" should read -- is an --.

Signed and Sealed this

Twenty-fourth Day of February, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,465,144 B2
DATED : October 15, 2002
INVENTOR(S) : Akira Hashimoto et al.

It is certified that error appears in the above-identified patent and that said Letters Patent is hereby corrected as shown below:

Title page,
Item [56], References Cited, FOREIGN PATENT DOCUMENTS,
"3-9045 2/2000" should read -- 3-9045 2/91 --; and
"3-103878 10/2000" should read -- 3-103878 10/91 --.
Item [57], ABSTRACT, "electrohotographic" should read -- electrophotographic --.

Column 2,
Line 13, "are" should read -- is --; and
Line 49, "such a" should read -- such as --.

Column 3,
Line 53, "are however" should read -- are, however, --.

Column 5,
Line 44, "the toner" should read -- whether the toner --; and
Line 56, "disclosed" should read -- are disclosed --.

Column 6,
Line 1, "disclosed" should read -- been disclosed --.

Column 7,
Line 54, "image-baring" should read -- image-bearing --.

Column 8,
Line 19, "mechanism" should read -- mechanisms --; and
Line 29, "wile" should read -- while --.

Column 11,
Line 47, "comprising" should read -- comprises --.

Column 15,
Line 27, "ing" should read -- ing images --; and
Line 35, "left a" should read -- left --.

Column 17,
Line 16, "dimethyl aminoethyl" should read -- dimethylaminoethyl --; and
Line 42, "is" should read -- it is --.

UNITED STATES PATENT AND TRADEMARK OFFICE

CERTIFICATE OF CORRECTION

PATENT NO. : 6,465,144 B2
DATED : October 15, 2002
INVENTOR(S) : Akira Hashimoto et al.

It is certified that error appears in the above-identified patent and that said Letters Patent is hereby corrected as shown below:

Column 18,
Line 16, "a low" should read -- low --.

Column 21,
Line 46, "metal" should read -- metals --.

Column 22,
Line 57, "50" should read -- 5.0 --.

Column 23,
Line 4, "power" should read -- powder --.

Column 29,
Line 62, "measure" should read -- measured --.

Column 30,
Line 8, "an" should read -- and --; and
Line 23, "electro-conductive" should read -- electroconductive --.

Column 31,
Line 20, "C., this" should read -- C. This --.

Column 33,
Line 35, "particle" should read -- particles --.

Column 35,
Line 12, "monoment" should read -- monomet --; and
Line 15, "presentset" should read -- present --.

Column 36,
Line 37, "In" should read -- In a --; and
Line 42, "ca" should read -- ca. --.

Column 37,
Line 2, "rom" should read -- from --; and
Line 11, "10,000" should read -- 10,000, --.

UNITED STATES PATENT AND TRADEMARK OFFICE

CERTIFICATE OF CORRECTION

PATENT NO. : 6,465,144 B2
DATED : October 15, 2002
INVENTOR(S) : Akira Hashimoto et al.

It is certified that error appears in the above-identified patent and that said Letters Patent is hereby corrected as shown below:

Column 38,
Line 18, "by sing" should read -- by using --; and
Line 22, "a a" should read -- a --.

Column 39,
Line 11, "an" should read -- and --; and
Line 50, "and" should read -- are --.

Column 42,
Line 6, "u,: image" should read -- image --.

Column 45,
Line 47, "124." should read -- 124, --.

Column 46,
Line 1, "such a" should read -- such as --;
Line 46, "R means" should read -- means --; and
Line 63, "blow" should read -- below --.

Column 47,
Line 22, "at at least" should read -- at least at --.

Column 51,
Line 14, "$5x10^5$)" should read -- $5x10^5$--.

Column 55,
Line 17, "1(Ø0)" should read -- 100 (V), --.

Column 57,
Line 5, "of" should read -- of a --.

Column 61,
Line 34, "toner carrying" should read -- toner --; and
Line 54, "(VII)" should read -- (VII). --.

Column 62,
Line 12, "used" should read -- use --; and
Line 35, "an" should read -- and --.

UNITED STATES PATENT AND TRADEMARK OFFICE

CERTIFICATE OF CORRECTION

PATENT NO. : 6,465,144 B2
DATED : October 15, 2002
INVENTOR(S) : Akira Hashimoto et al.

It is certified that error appears in the above-identified patent and that said Letters Patent is hereby corrected as shown below:

Column 63,
Line 56, "be" should be deleted.

Column 64,
Line 44, "In" should read -- In a --.

Column 65,
Line 28, "includes" should read -- including --; and
Line 47, "an" should read -- and --.

Column 69,
Line 33, "containing" should read -- containing $Ca_3(PO_4)_2$. --.

Column 77,
Table 3, "t-butylperoxy-2-ethylkhexanoate" should read
-- t-butyl peroxy-2-ethylkhexanoate --.

Column 83,
Line 66, "ther" should read -- there --; and
Line 67, "ebetween" should read -- between --.

Column 89,
Line 25, "$5x10^9$" should read -- $5x10^8$ --; and

Column 93,
Line 49, "ther" should read -- there --; and
Line 50, "ebetween" should read -- between --.

Column 95,
Table 12, "i" should read -- I --.

Column 97,
Line 25, "a gent" should read -- agent --.

Column 98,
Line 47, "(SBET)" should read -- ($S_{BET}$) -- and "treatment)" should read -- treatment) --.

UNITED STATES PATENT AND TRADEMARK OFFICE

CERTIFICATE OF CORRECTION

PATENT NO. : 6,465,144 B2
DATED : October 15, 2002
INVENTOR(S) : Akira Hashimoto et al.

It is certified that error appears in the above-identified patent and that said Letters Patent is hereby corrected as shown below:

Column 100,
Line 43, "he" should read -- the --.

Column 101,
Line 40, "using using" should read -- using --; and
Line 45, "(Comparative" should read -- (Comparative) --.

Column 102,
Line 37, "50%" should read -- 50%. --.

Column 104,
Line 40, "particles" should read -- particles 1. --; and
Line 46, "particles" should read -- particles 1. --.

Column 105,
Table 14, "75(10)" should read -- 75 (10) --.

Column 108,
Line 47, "solid solid" should read -- solid --.

Column 110,
Line 46, "1.0 Wm." should read -- 1.0 μm, --.

Column 111,
Line 67, "solid solid" should read -- solid --.

Column 112,
Line 15, "difference ΔID)" should read -- difference (ΔID) --;
Line 17, "standard:" should read -- standard. --; and
Line 43, "7id;." should be deleted.

Column 120,
Lines 23 and 28, "image forming method" should read -- process cartridge --; and
Lines 32 and 36, "image forming method" should read -- process cartridge --.

UNITED STATES PATENT AND TRADEMARK OFFICE

CERTIFICATE OF CORRECTION

PATENT NO. : 6,465,144 B2
DATED : October 15, 2002
INVENTOR(S) : Akira Hashimoto et al.

It is certified that error appears in the above-identified patent and that said Letters Patent is hereby corrected as shown below:

Column 121,
Line 14, "exposed" should read -- is exposed --; and
Line 39, "in an" should read -- is an --.

This certificate supersedes Certificate of Correction issued February 24, 2004.

Signed and Sealed this

Tenth Day of August, 2004

JON W. DUDAS
*Acting Director of the United States Patent and Trademark Office*